US012441524B2

(12) United States Patent
Knobel et al.

(10) Patent No.: US 12,441,524 B2
(45) Date of Patent: Oct. 14, 2025

(54) CHILD RESISTANT GLASS CONTAINER

(71) Applicant: CR Packaging LLC, Allston, MA (US)

(72) Inventors: Simon Knobel, Vail, CO (US); Matthew Hayes, Boston, MA (US); Alexander Gonzalez, Brighton, MA (US); Jeffrey Clark, Watertown, MA (US)

(73) Assignee: CR Packaging LLC, Allston, MA (US)

( * ) Notice: Subject to any disclaimer, the term of this patent is extended or adjusted under 35 U.S.C. 154(b) by 0 days.

(21) Appl. No.: 17/429,290

(22) PCT Filed: Feb. 7, 2020

(86) PCT No.: PCT/US2020/017237

§ 371 (c)(1),
(2) Date: Aug. 6, 2021

(87) PCT Pub. No.: WO2020/163732

PCT Pub. Date: Aug. 13, 2020

(65) Prior Publication Data

US 2023/0059374 A1 Feb. 23, 2023

Related U.S. Application Data

(60) Provisional application No. 62/896,954, filed on Sep. 6, 2019, provisional application No. 62/849,593, filed
(Continued)

(51) Int. Cl.
*B65D 50/04* (2006.01)
*B65D 21/02* (2006.01)
(Continued)

(52) U.S. Cl.
CPC ..... *B65D 50/046* (2013.01); *B65D 21/022* (2013.01); *B65D 43/0212* (2013.01);
(Continued)

(58) Field of Classification Search
CPC ..... B65D 50/046; B65D 21/022; B65D 43/0212; B65D 45/30
See application file for complete search history.

(56) References Cited

U.S. PATENT DOCUMENTS 4,666,052 A 5/1987 Ou-Yang
4,746,008 A 5/1988 Heverly et al.
(Continued)

FOREIGN PATENT DOCUMENTS

CH 613 907 A5 10/1979
GB 2 164 325 A 3/1986
(Continued)

OTHER PUBLICATIONS

Internaational Search Report issued May 1, 2020 in corresponding PCT Application No. PCT/US2020/017237.

*Primary Examiner* — Jeffrey R Allen
(74) *Attorney, Agent, or Firm* — Fox Rothschild LLP; Peter F. Corless

(57) ABSTRACT

Disclosed herein are child-resistant containers. Also disclosed are methods using the modular containers and methods of storing substances in containers. The containers have a glass base and a plastic cap and provide for child-resistant containers. A user can releasably remove the cap from base with a squeeze and lift sequence on the sides of the cap. For example, the user squeezes opposite sides of the container cap, which releases a locking mechanism and allows for removal of the cap by lifting or pulling the container cap off from the container base. The containers are modular and stackable.

29 Claims, 57 Drawing Sheets

Related U.S. Application Data on May 17, 2019, provisional application No. 62/825,976, filed on Mar. 29, 2019, provisional application No. 62/802,381, filed on Feb. 7, 2019.

(51) Int. Cl.
*B65D 43/02* (2006.01)
*B65D 45/30* (2006.01)
*B65D 81/30* (2006.01)

(52) U.S. Cl.
CPC ..... *B65D 45/30* (2013.01); *B65D 81/30* (2013.01); *B65D 2543/00101* (2013.01); *B65D 2543/00296* (2013.01); *B65D 2543/00527* (2013.01); *B65D 2543/00537* (2013.01)

(56) References Cited

U.S. PATENT DOCUMENTS

| | | | | |
|---|---|---|---|---|
| 5,647,939 | A | 7/1997 | Gee et al. | |
| 6,513,344 | B1 | 2/2003 | Pollock | |
| 8,448,814 | B2 | 5/2013 | Yamamoto et al. | |
| 2017/0183133 | A1 | 6/2017 | Simonsen | |
| 2018/0057226 | A1 | 3/2018 | Austin et al. | |
| 2018/0127175 | A1* | 5/2018 | Daley | A61J 1/1418 |
| 2018/0311111 | A1 | 11/2018 | Knobel et al. | |
| 2018/0312297 | A1* | 11/2018 | Knobel | B65D 21/0204 |

FOREIGN PATENT DOCUMENTS

| | | | |
|---|---|---|---|
| GB | 2 287 015 | A | 9/1995 |
| WO | 92/12909 | A1 | 8/1992 |
| WO | 2018/204220 | A1 | 11/2018 |

* cited by examiner

200

SECTION A-A

500

600

SECTION A-A

DETAIL A
SCALE 2 : 1

DETAIL V
SCALE 2 : 1

SECTION B-B

2000

SECTION Y-Y

2400C

2400D

2900A

2900B

3200C

3200D

CHILD RESISTANT GLASS CONTAINER

CROSS-REFERENCE TO RELATED PATENT APPLICATION

This Application is a National Phase application filed under 35 USC 371 of PCT International Application No. PCT/US2020/017237 with an International Filing Date of Feb. 7, 2020, which claims priority to U.S. Provisional No. 62/802,381 filed on Feb. 7, 2019, entitled, "Child Resistant Glass Container", U.S. Provisional No. 62/825,976 filed on Mar. 29, 2019, entitled, "Child Resistant Glass Container", U.S. Provisional No. 62/849,593 filed on May 17, 2019, entitled, "Child Resistant Glass Container", and U.S. Provisional No. 62/896,954 filed on Sep. 6, 2019, entitled, "Child Resistant Glass Container", the entire contents all of which are hereby incorporated by reference.

TECHNICAL FIELD

The present disclosure relates to a child-resistant glass container that can be used for storage and in modular inventory systems.

BACKGROUND

Containers intended for storing substances or materials are often designed to prevent opening by a child and yet can be manipulated by adults, including seniors, to gain access to the substance. These "child-resistant" containers are typically used for over the counter and prescription medications. Other child-resistant containers are used for other household items, that are toxic if swallowed or ingested, such as laundry detergent and cleaners. These systems are in place to prevent children from inadvertently gaining access to the contents of these containers.

Generally, child resistant containers include a multi-step opening process or require steps to be completed simultaneously. A certain level of mental and physical dexterity is required for opening such a container, making it difficult for children to access the contents within. For example, use of a certain amount of pressure or force while a second action is completed is needed to open such a container prevents children from being able to open and access the contents of the container.

A challenge in creating child resistant containers is making the container easy enough for the elderly and other individuals to be able to use. For example, some child resistant containers offer a screw-cap or pop-top closure, and although they are efficient for child resistance, these devices pose a degree of hardship for individuals with wrist and finger joint inflammation or arthritis.

Currently available child resistant containers are also often inadequate in protecting the contents from degradation upon exposure to environmental factors such as light including ultraviolet (UV) radiation, moisture, temperature, bacteria, physical damage or air.

Also, most screw cap medicine containers lack external features favorable for counting, sorting, and stacking and do not allow for efficient inventory management.

SUMMARY

In view of the above, there remains a need for improved containers that are easy to use for an elderly or disabled individual, while providing child-resistant features. Also, there remains a need for a container where the contents are protected for improved shelf-life, such as being liquid-tight, air-tight, non-stick, or having other desirable properties. Finally, there remains a need for containers that can be adapted for efficient stacking and can be part of a larger storage and inventory system. Such features allow for the containers to be used in the automation in packaging and distribution centers. The container is part of a storage system that allows easy storage, inventory, inventory reconciliation, and distribution in bulk quantities.

The present disclosure relates to a container. The container is generally polygonal in shape, for example, generally square, rectangular, diamond, quadrilateral, or rhomboid in shape. Also, parts of the container, such as the container base, are made substantially of glass. Parts of the container are modular, including components that are able to stack on each other, or combination of components that are stackable. The modular container can be used as part of an inventory system. Inventory systems, modular systems for inventory and transport, and the like are disclosed in U.S. patent applications Ser. Nos. 15/966,113 and 15/966,118, the contents of which are hereby incorporated by reference in their entirety.

The containers described herein are configured to be child-resistant. The disclosed containers provide improved packaging and storage of substances or materials in a controlled environment. The containers provide, for example, an air-tight, liquid-tight, water-tight, humidity-controlled, light-controlled, non-stick, anti-static, or any combination thereof, environment.

Accordingly, in one aspect, the present disclosure is directed to a child-resistant container. The child-resistant container includes a substantially symmetrical container base. The container base includes a closed bottom end, an open top end, a first cap engagement mechanism, and a second cap engagement mechanism. The container base has a neck and a foot/support.

In some embodiments, the first cap engagement mechanism is disposed on a first side of the container base, and the second cap engagement mechanism is disposed on a second side of the container base opposite from the first cap engagement mechanism.

In some embodiments, the first cap engagement mechanism and the second cap engagement mechanism each comprise a pair of ramps positioned between the open top end and the closed bottom end, wherein the pair of ramps extend from and are substantially perpendicular to the open top end, and a ridge substantially perpendicular to and disposed between the pair of ramps.

In some embodiments, the child-resistant container further comprises one or more markings on a third side and/or a fourth side of the container base.

In some embodiments, the container base includes a glass, a polymer glass, a glass-ceramic, a ceramic material, or a combination thereof. For example, the glass is selected from the group consisting of an amber glass, a green glass, an opal glass, and a transparent glass.

In some embodiments, the child-resistant container further includes a container cap, wherein the container cap is sized and configured to mate with the container base.

In some embodiments, the closed bottom end of the container base further includes a recessed portion configured to mate with an elevated portion of a top end of the container cap.

In some embodiments, the container cap includes one or more base engagement elements. In some embodiments, each of the one or more base engagement elements comprise an upper row of teeth and a lower row of teeth. Each row of teeth has 1, 2, 3, 4, 5, 6, or more teeth.

In some embodiments, one of the one or more base engagement elements is configured to engage with the first cap engagement mechanism (e.g., the pair of ramps and the ridge). In some embodiments, each of the one or more base engagement elements are disposed on an interior side of the container cap.

In some embodiments, engagement of the container base with the container cap enables the one or more base engagement elements to lockably mate with the first and second cap engagement mechanisms to provide a child resistant container.

In some embodiments, the container cap includes a polymer, a plastic, or a combination thereof. For example, the polymer includes a thermoplastic elastomer (TPE), a thermoplastic vulcanizate (TPV), a thermoplastic polyurethane (TPU), polypropylene, polypropylene copolymer, ultra-clarified polypropylene, colored polypropylene, PET, PETE, polycarbonate, polystyrene, or a combination thereof.

In some embodiments, the container cap further includes an annular sealing ring positioned on an inner surface of the top end of the cap. The annular sealing ring includes a thermoplastic elastomer (TPE), a thermoplastic vulcanizate (TPV), or a thermoplastic polyurethane (TPU).

In some embodiments, the container is substantially air-tight, liquid-tight, light resistant, temperature resistant, moisture resistant, bacteria resistant, tamper resistant, child resistant or a combination thereof.

In another aspect, the present disclosure is directed to a child-resistant container. The container includes a substantially square glass container base and a substantially square plastic container cap. In some embodiments, the container cap is sized and configured to mate with the container base. In other embodiments, the glass container base includes a closed bottom end, an open top end and a pair of cap engagement elements. In one embodiment, the glass container base includes a neck and a foot/support. In some embodiments, the pair of cap engagement elements are disposed on opposite sides of the container base. In some embodiments, each of the pair of cap engagement element comprise a pair of ramps, wherein the pair of raised protrusions extend from and are substantially perpendicular to the open top end, and a ridge substantially perpendicular to and disposed between the pair of raised protrusions.

In some embodiments, the container cap further includes an elevated portion of a top end, wherein the elevated portion is configured to mate with a recessed portion of the closed bottom end of the container base.

In some embodiments, the container cap further includes one or more base engagement elements, wherein each of the one or more base engagement elements comprise an upper row of teeth and a lower row of teeth, and wherein the upper row and the lower row of teeth are configured to engage with the pair of ramps and the ridge of the container base.

In some embodiments, the container cap includes a thermoplastic elastomer (TPE), a thermoplastic vulcanizate (TPV), a thermoplastic polyurethane (TPU), polypropylene, polypropylene copolymer, ultra-clarified polypropylene, colored polypropylene, PET, PETE, polycarbonate, polystyrene, or a combination thereof.

In some embodiments, each row of teeth includes 1, 2, 3, 4, 5, 6 or more teeth.

In some embodiments, the glass is selected from the group consisting of a flint glass, an amber glass, a green glass, an opal glass, and a transparent glass.

The modular containers disclosed herein are sized and configured to stack on top of each other. In some embodiments, the container cap includes an elevated portion at a top end of the cap and the container base includes a receiving portion defined by a recessed floor of the base. The elevated portion of the cap is adapted to engage the receiving portion of the container base so the child-resistant container can stack on another child-resistant container Other materials or additives can be added to the container base, container cap or both. For example, in one embodiment, the container cap and/or base further comprise a liner. In some embodiments, the liner is thermoformed, die-cut, or injection molded. In another embodiment, the liner includes a polymer, for example a fluoropolymer. In some embodiments, the fluoropolymer is FEP (fluorinated ethylene propylene), PTFE (polytetrafluoroethylene) or PFA (perfluoroalkoxy alkanes).

In another embodiment, the container cap and/or base comprise polytetrafluoroethylene (PTFE) coatings. In one embodiment, clear plastisol is applied to an exterior surface of the glass base to prevent breaking and makes the glass opaque. In another embodiment, oleic acid vapor is added to prevent glass from sticking together on production line. In yet another embodiment, $SiO_2$ vapor is deposited to a plastic cap to provide a flexible layer of glass.

In some embodiments, the container includes a tamper evident element. For example, the tamper evident element is a seal, a tape, or a combination thereof. In another embodiment, the modular container includes an RFID tag.

In some embodiments, the child-resistant container includes a writing surface compatible with a pen, a pencil, or a marker.

In some embodiments, the container base comprise one or more anti-rotation locks symmetrically disposed on the outer surface of the container base.

In some embodiments, the container base further includes an insert defining two or more compartments within the container base.

In some embodiments, the container cap includes a polymer. For example, the polymer includes a thermoplastic elastomer (TPE), a thermoplastic vulcanizate (TPV), a thermoplastic polyurethane (TPU), polypropylene, polypropylene copolymer, ultra-clarified polypropylene, colored polypropylene, PET, PETE, polycarbonate, polystyrene, or a combination thereof.

Another aspect of the present disclosure includes a method of affecting a child-resistant closure of a container. The method includes providing a child-resistant container comprising a container base and a container cap and sliding the container cap over the open end of the container base, wherein the first and second cap engagement elements engage with and couple to the one or more base engagement elements.

In some embodiments, the method of affecting a child-resistant closure of a container further includes removing the container cap by simultaneously applying about 1 to about 10 pounds of external compression force to opposite sides of the container cap and pulling the container cap off of the container base. In one embodiment, a user applies about 2 to about 8 pounds of external compression force to opposite sides of the container cap and pulling the container cap off the container base. In another embodiment, a user applies about 3 to about 7 pounds of external compression force to opposite sides of the container cap and pulling the container cap off the container base. In another embodiment, a user applies about 4 to about 6 pounds of external compression force to opposite sides of the container cap and pulling the container cap off the container base.

Additional embodiments of the disclosure will be set forth in part in the description which follows. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

Features and advantages of the claimed subject matter will be apparent from the following description of embodiments consistent herewith, which the description should be considered in conjunction with the accompanying drawings.

DETAILED DESCRIPTION

Figure 1:
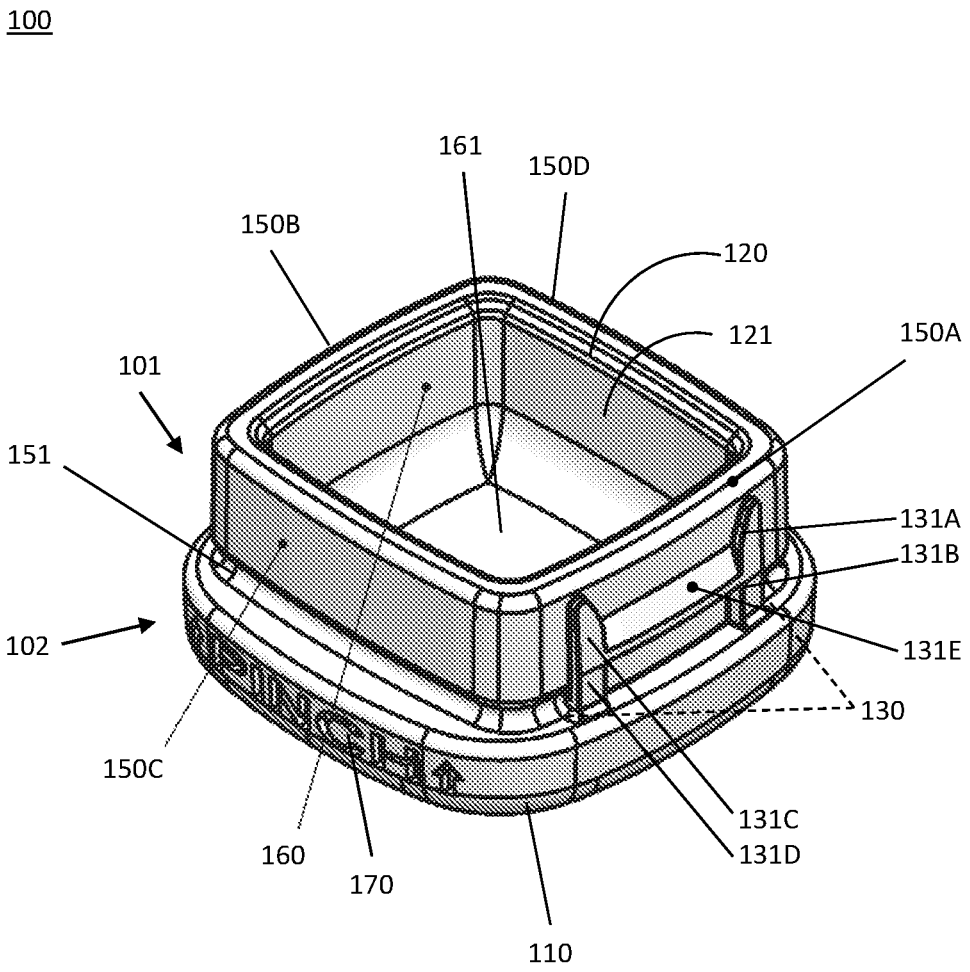
FIG. 1 illustrates a top perspective view of an embodiment of a container base.

The present disclosure relates to containers. The containers are modular and/or child-resistant. Aspects of present disclosure include methods for using the child-resistant containers (e.g., for creating child-resistance and for storing or holding a material). The containers can be understood more readily by reference to the following detailed description of the disclosure. It will be apparent to those skilled in the art that various modifications can be made without departing from the scope of the invention.

As used in the specification and the appended claims, the singular forms "a," "an" and "the" include plural referents unless the context clearly dictates otherwise. Thus, for example, reference to "an element" includes two or more elements.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

As used herein, the terms "cap engagement element" and "cap engagement mechanism" are used interchangeably. Similarly, the terms "base engagement element" and "base engagement mechanism" are used interchangeably.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including matters of logic with respect to arrangement of steps or operational flow; plain meaning derived from grammatical organization or punctuation; and the number or type of aspects described in the specification.

It is understood that the containers, materials and devices disclosed herein have certain functions. Disclosed herein are certain structural requirements for performing the disclosed functions, and it is understood that there are a variety of structures that can perform the same function that are related to the disclosed structures, and that these structures will typically achieve the same result.

The containers described herein can be part of the modular container system. Embodiments of the containers are configured to be child-resistant. The disclosed containers provide an improved packaging and storage of substances or materials in a controlled environment, providing, for example, an air-tight, liquid-tight, water-tight, humidity-controlled, light-controlled, or any combination thereof, environment. The containers comprise a container base and a container cap. The container base is made up of any suitable material. For example, the base is made from glass (e.g., any non-crystalline amorphous solid) or other glass-like materials (e.g., porcelain, thermoplastics). The container is generally polygonal in shape. For example, the container base and/or container cap are generally square, rectangular, diamond, quadrilateral, triangular, or rhomboid in shape. In some aspects, the container base and/or the container cap is substantially square, square, and/or square with rounded edges. The sides of the container are planar or substantially planar such that they are slightly concave or convex.

Child-Resistant Containers

As disclosed herein, the containers generally comprise a base and a cap. The combination and attachment of the base with the cap provides a child-resistant container. In some embodiments, the base can be attached or tethered to the cap. In other embodiments, the base and the cap are not tethered.

The cap and the base are sized and shaped to enable attachment with each other. The container is also sized and shaped to provide a container that is substantially air-tight, liquid-tight or both. These properties regulate the amount of air, oxygen, water, water vapor, humidity, and/or liquids that can enter or leave the container when in a closed position. The container can also have light-blocking (e.g., UV) properties. The container can also have other desirable properties, such as non-stick surfaces, anti-static surfaces, tamper resistance, child-resistance, or combinations thereof. The container can also prevent or impede the growth of micro-organisms such as bacteria and fungus.

The base of the container has a neck and a foot or support. The foot or support forms a closed bottom end and the neck forms an open top end. The neck has attachment means (e.g., a cap engagement mechanism) for attaching to a cap. The cap also has attachment means (e.g., a base engagement mechanism) for attaching to a base, such as the neck of the base.

The overall shape of the container is generally square or square with rounded corners when viewed from the top (e.g., horizontal cross-section). The container is generally square, square with rounded corners, generally rectangular, or rectangular with rounded corners when viewed from the side (e.g., vertical cross-section). The container cap can form a substantially flush side or edge with the base (e.g., the foot or support of the base) when in a closed configuration. The length to width ratio of the base and/or the cap is about 1:1 (i.e., generally square). The height of the base, relative to the length and/or width, can vary and can be smaller or larger than the length and/or width. A height that is substantially the same to the length and width forms a generally cube-shaped structure. A height that is different (e.g., larger or smaller) than the length and width forms a generally rectangular cuboid or rectangular prism shaped structure. Embodiments of the container base and/or container cap are substantially symmetrical in shape.

In some aspects, the container base is generally a unitary structure. In some aspects, the base neck extends from the support or foot. In some aspects, the diameter of the neck is less than the diameter of the support. See, e.g., FIGS. 1-2. When a container cap is placed on a container base, the cap sits flush with the support. This can add to the child-resistance of the container. For example, a flush side can prevent children from getting under the cap by using nails/teeth to open.

As described herein, the base and/or cap can be composed from a variety of materials. The base generally has a rigid structure. This is generally non-deformable under normal conditions (e.g., user hand strength). The cap generally has a non-rigid or semi-rigid structure. The cap is generally deformable and/or elastic under normal conditions. Non-limiting examples of materials to form a rigid or non-deformable structure includes glass and metals. The container base can be made from glass, polymer glass, glass-ceramic, and/or a ceramic material. For example, the glass can be flint glass, amber glass, green glass, opal glass, transparent glass, recycled glass, tempered glass, soda lime glass, borosilicate glass or others. Non-limiting examples of materials to form a deformable and/or elastic structure includes plastics, polymers, and rubbers.

As described herein, the container cap is configured to associate with the container base. The container base forms an enclosure for containing materials, and the container cap encloses the open top end of the base. One aspect of the child-resistant container is the container is configured to store, hold and/or preserve a substance or a material as well as providing a mechanism for child-resistance. In a closed configuration, the container is substantially child-resistant, that is, a child would have a difficult time removing the container cap from the container base.

Container Base

FIGS. 1-17 and 20-44 illustrate various embodiments of the child-resistant containers and container bases described herein. Child-resistant container base is generally symmetrical in shape. For example, the container base has a length to width ratio of about 1:1. In some embodiments, the base is generally polygonal in shape. In some embodiments, the container base is generally square, rectangular, diamond, quadrilateral, or rhomboid in shape. In one some embodiment, the container base is substantially square, square, and/or square with rounded edges. The sides, edges and/or corners of the container base can have a slight curvature, such that the base is generally and substantially square in shape with rounded corners or edges. The containers described herein are stackable (e.g. FIGS. 7A-11) and have features to make them child-resistant. Other features will be readily apparent in light of the foregoing.

The container bases described herein can be sized and configured so that the base (e.g., cavity) has a total storage volume of about 1 ml (milliliter) to about 2000 ml, about 2 ml to about 1000 ml, about 3 ml to about 500 ml, about 4 ml to about 100 ml, about 5 ml to about 50 ml, or about 5 ml to about 10 ml. In some embodiments, the volume of the container base is 1 ml, 2 ml, 3 ml, 4 ml, 5 ml, 6 ml, 7 ml, 8 ml, 9 ml, 10 ml, 11 ml, 12 ml, 13 ml, 14 ml, 15 ml, 16 ml, 17 ml, 18 ml, 19 ml, 20 ml, 25 ml, 30 ml, 40 ml, 50 ml, 60 ml, 70 ml, 80 ml, 90 ml, 100 ml, 150 ml, 200 ml, 250 ml, 300 ml, 350 ml, 400 ml, 450 ml, 500 ml, 600 ml, 700 ml, 750 ml, 1000 ml, 1250 ml, 1500 ml, or 2000 ml. In some embodiments, the storage volume of the container base is less than 1 ml or greater than 2000 ml.

Referring to FIG. 1, child-resistant container base 100 has foot/support having closed bottom end 110 and neck 102 having open top end 120. Neck 101 has four sides 150A, 150B, 150C and 150D. Inner wall 160 of sides 150A, 150B, 150C, and 150D of the container base 100 and inner floor 161 define a cavity 121. Inner floor 161 is substantially flat or slightly rounded and can have rounded corners and/or edges.

Cap engagement mechanism 130 is positioned on side 150A. In some embodiments, another cap engagement mechanism is positioned on side 150B (e.g., FIG. 3A). Cap engagement mechanism 130 includes ramps 131A/131B and 131C/131D. Ramps 131A/131B and 131C/131D can be each a unitary element or separate elements. Ridge 131E connects ramps 131A/131B and 131C/131D. Ridge 131E is substantially parallel to transfer neck 151 and open top end 120. Cap engagement element 130, having ramps 131A/131B and 131C/131D and ridge 131E, is in an "H" configuration. Ramps 131A/131B generally extends from open top end 120 to transfer neck 151. Ramps 131C/131D generally extends from open top end 120 to transfer neck 151. Cap engagement element is a retention feature that provides child-resistance such that a container cap snaps or locks into place with the container base.

Sides 150A, 150B, 150C and 150D are slightly convex (e.g., curved) and unite to form a substantially square shaped container base. The edges between each of sides 150A, 150B, 150C and 150D are curved. In some aspects, the sides of the neck can be at right (90°) angles to each other. Sides 150A, 150B, 150C and 150D are substantially perpendicular relative to the container base support or foot.

Container base 100 also has a transfer neck 151 around the circumference of the container base. Transfer neck 151 allows machinery to move container base 100 during manufacturing. Transfer neck 151 is held during transfers of base 100 during the glass manufacturing process. Transfer neck 151 separates neck 101 from support 102 of container base 100. Connecting ramps 131B, 131D are disposed over or on top of parts of transfer neck 151 on sides 150A, 150B.

One or more markings 170 can be placed on container base 100. The one or more markings 170 can be on one or more sides of the container. The markings are used to instruct the user of the container how to remove a container cap from the container base. The markings on the container base distinguishes one side of the container from another side. The markings can be, for example, words, letters, symbols. For example, "PINCH," "PRESS," "SQUEEZE," and/or "↑" can be used. A user squeezes, pinches, or presses inwardly at the positions on a container cap, just above the markings, while simultaneously pulling the container cap upward, to remove the container cap from the container base.

Figure 2:
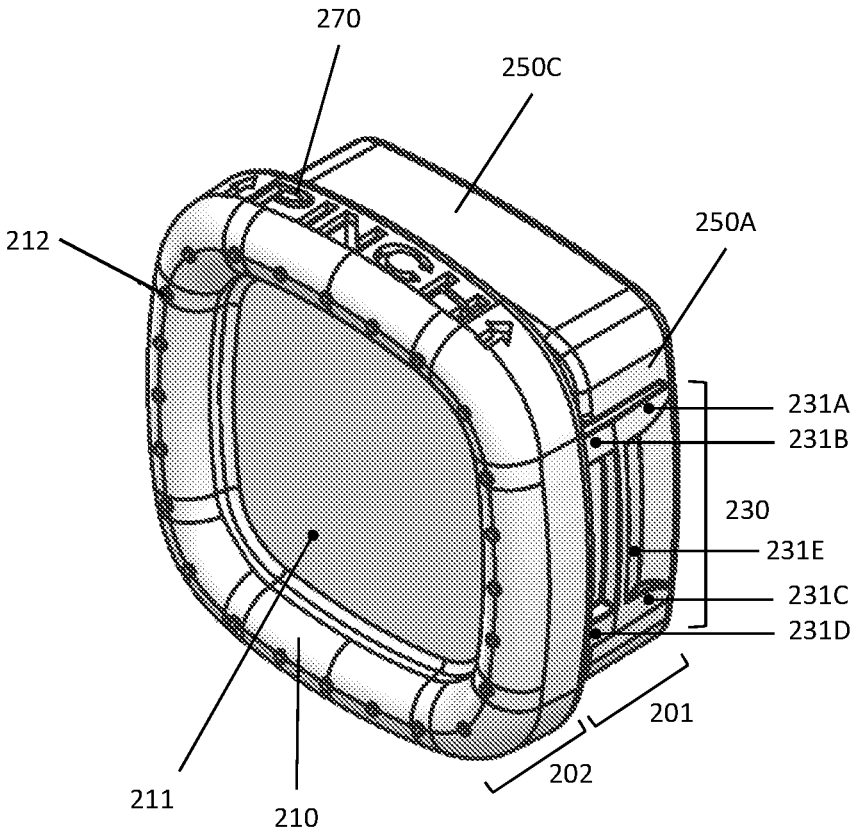
FIG. 2 illustrates a bottom perspective view of an embodiment of a container base.

Referring to FIG. 2, container base 200 is shown in a bottom perspective view. Container base 200 has a generally unitary structure and has neck 201 and support or foot 202. Sides 250A and 250C are shown in FIG. 2. Cap engagement element 230 is positioned on side 250A and on the neck portion 201 of container base 200. Cap engagement element 230 has ramps 231A/231B and 231C/231D. Ramps 231A/231B and 231C/231D are connected by ridge 231E in an "H" configuration. Ramps 231A/231B and 231C/231D generally extend from at or near the open top end of the container base to at or near the transfer neck and/or support 202.

Closed bottom end 210 has a recessed portion 211. Recessed portion 211 is sized and configured to receive a top end of a container cap to allow for containers to stack upon each other. Closed bottom end 210 also has one or more stipples 212. Stipples 212 are formed as part of the manufacturing process.

Markings 270 on container foot 202 is found on side that does not have a cap engagement element (e.g., 230).

Figure 3A:
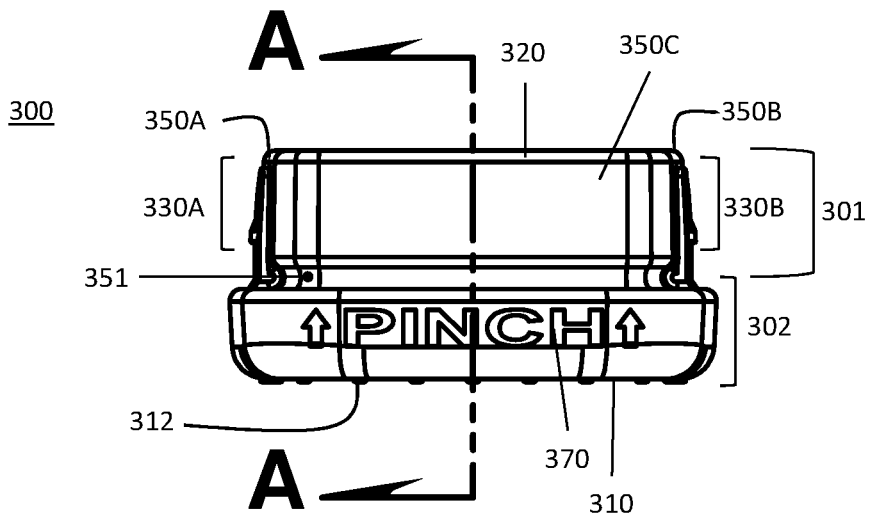
FIG. 3A illustrates a side view of an embodiment of a container base.
Figure 3B:
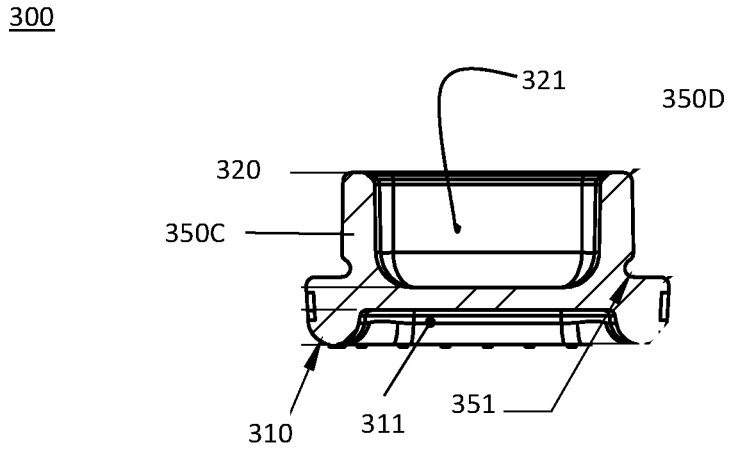
FIG. 3B illustrates a cross-sectional view (Section A-A) of the embodiment of the container base of FIG. 3A.

FIGS. 3A and 3B illustrate a side view and cross-sectional view of a container base 300, respectively. Container base 300 has neck 301 and support/foot 302. Neck 301 has an open top end 320 and support/foot 302 has a closed bottom end 310. One or more stipples 312 are found on closed bottom end 310. Cap engagement elements 330A and 330B are positioned on sides 350A and 350B, respectively. One or more markings 370, on support/foot 302, is found on side 350C.

Section A-A (FIG. 3B) shows cavity 321 of container base 300, defined by sides 350A, 350B, 350C and 350D. Cavity 321 of container base has a total volume of about 1 ml (milliliter) to about 2000 ml.

Recessed portion 311 of closed bottom end 310 is configured to receive a container cap (not shown). Transfer neck 351 separates neck 301 and support/foot 302.

Figure 4A:
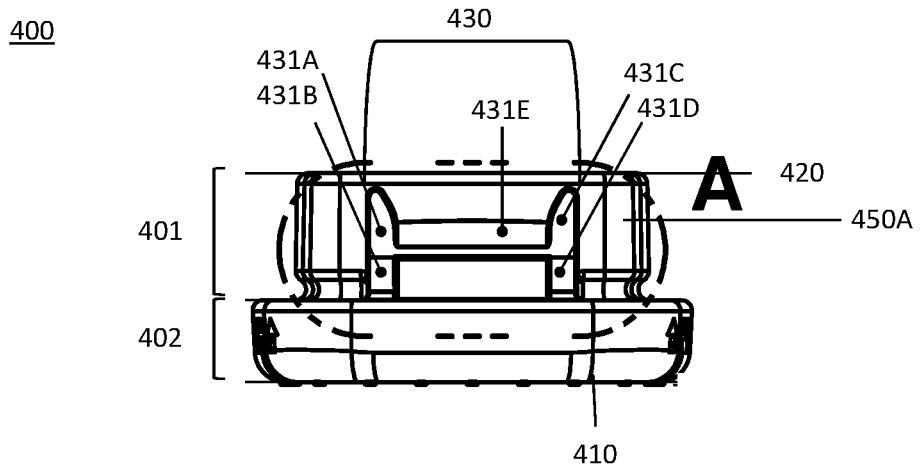
FIG. 4A illustrates a side view of an embodiment of a container base.
Figure 4B:
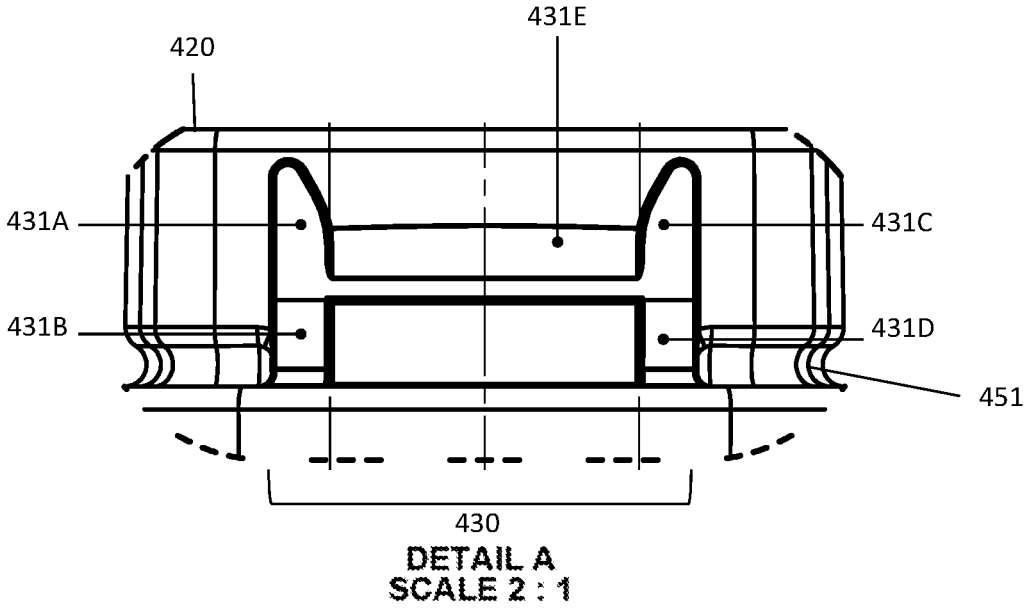
FIG. 4B illustrates a cross-sectional view (Detail A) of the embodiment of the container base of FIG.

FIGS. 4A and 4B illustrate another side view and cross-sectional view of container base 400, respectively. Neck 401, having an open top end 420, and support 402, having a closed bottom end 410, make up container base 400. Positioned on side 450A is cap engagement element 430. Cap engagement element 430 is made up of ramps 431A/431B and 431C/431D, and ridge 431E connecting the two ramps. The ramps 431A/431B and 431C/431D and ridge 431E generally for an "H" shaped-retention mechanism.

Detail A (FIG. 4B) illustrates the cap engagement mechanism 430. Ramps 431A and 431B are a single unit or individual units that form a single unit. Similarly, ramps 431C and 431D are a single unit or individual units that form a single unit. Ramps 431A and 431C extend to or near to the open top end 420 of the container base 400. Ramps 431A and 431C have generally rounded ends. Ramps 431B and 431D extend to or near to the support/foot 402 and over or on top of transfer neck 451. Transfer neck 451 extends circumferentially around neck 401.

Figure 5:
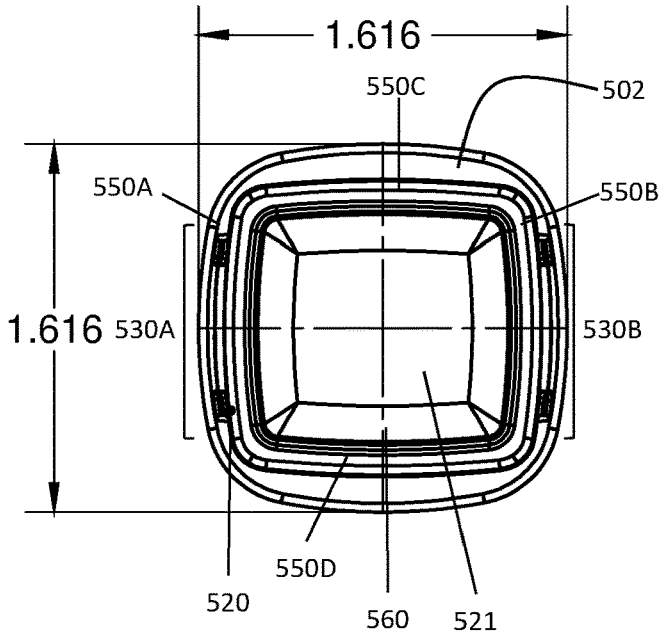
FIG. 5 illustrates a top view of an embodiment of a container base.

Referring to FIG. 5, generally symmetrical container base 500 has sides 550A, 550B, 550C and 550D. Positioned on sides 550A and 550B are cap engagement elements 530A and 530B, respectively. Container base 500 has an open top end 520 and one or more inner walls 560. Sides 550A, 550B, 550C and 550D define cavity 521. Portions of foot/support 502 are shown because the diameter of the foot 502 is greater than the diameter of the neck. Sides 550A, 550B, 550C and 550D form a generally square-shaped neck, having rounded corners.

Figure 6:
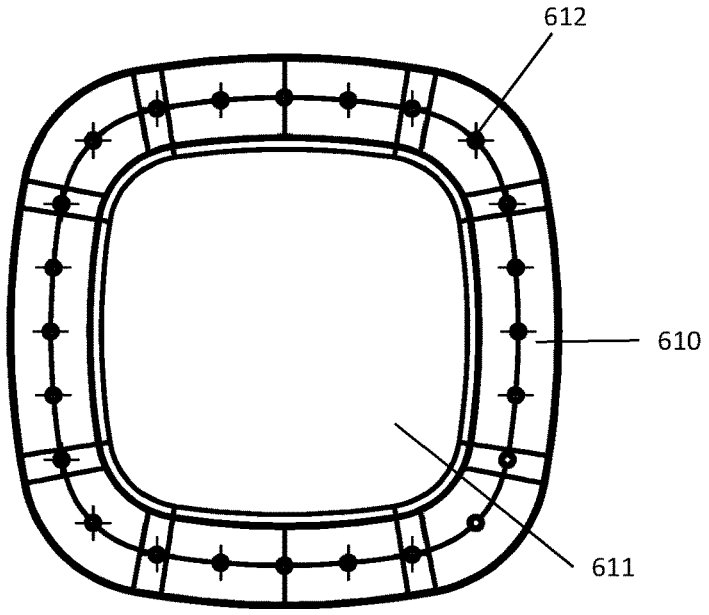
FIG. 6 illustrates a bottom view of an embodiment of a container base.

FIG. 6 is a bottom view of foot/support of container base 600, having a closed bottom end 610, with stipples 612 and a recessed portion 611, sized and configured to receive a container cap.

The child-resistant containers described herein are stackable, as illustrated in FIGS. 7A-11. That is, one container base can be stacked on top of another container having a container cap. The elevated portion of a container cap from one container is configured to sit inside of a recessed portion of container base. The child-resistant containers have configurations to allow for self-stacking. See FIGS. 7A-7B.

Referring to FIGS. 7A-11 are various embodiments of a container base sitting on top of container cap. As described here, a recessed portion of the container base is sized and configured to receive a top end of a container cap.

Figure 7A:
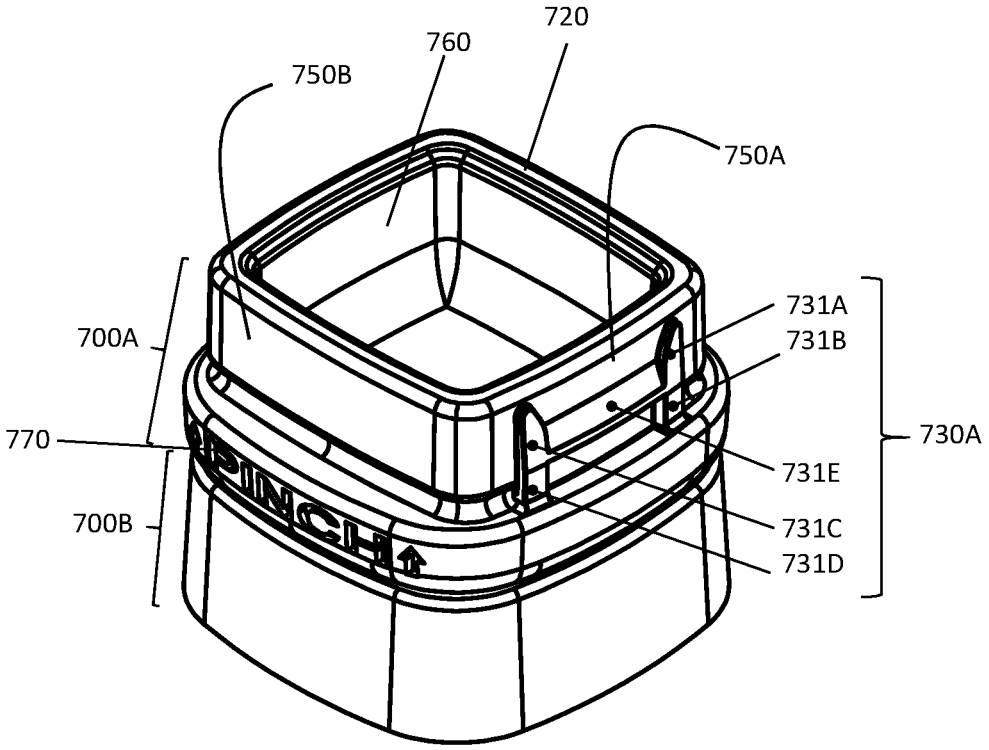
FIG. 7A illustrates a top perspective view of an embodiment of a container base stacked on top of a container cap.

As shown in FIG. 7A, container base 700A sits on top of container cap 700B. Since both container base 700B and container cap 700A are symmetrical, base 700B is sized to sit on top of the cap 700A in any configuration (i.e., the cap and/or base can be rotated 90, 180 or 270 degrees and will fit or stack together). Container base 700A has an open top end 720. Positioned on side 750A is cap engagement element 730A having ramps 731A/731B and 731C/731D, and ridge 731E in an "H" configuration. Inner wall 760 forms a cavity of the container base 700A. Below side 750B are one or more markings 770.

Figure 7B:
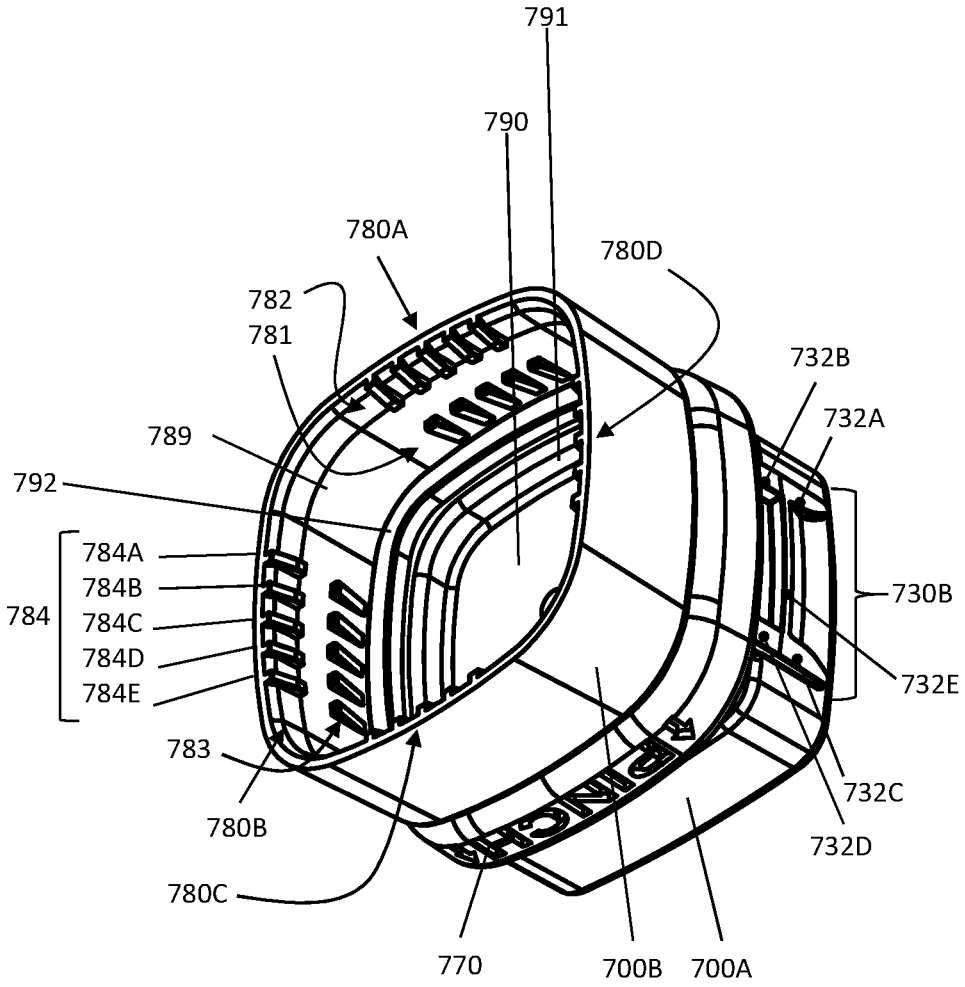
FIG. 7B illustrates a bottom perspective view of the embodiment of a container base stacked on top of a container cap of FIG. 7A.

FIG. 7B is a bottom perspective view of the container base/cap combination as illustrated in FIG. 7A. Container cap 700B has one or more interior sides 789. Positioned on each side 789 is a base engagement element 780A, 780B, 780C and 780D. Each base engagement element has two rows of teeth. For example, base engagement element 780A has an upper row of teeth 781 and a lower row of teeth 782. Each row of teeth can have 1, 2, 3, 4, 5, or more teeth. For example, lower row of teeth 784 of base engagement element 780B has teeth 784A, 784B, 784C, 784D and 784E. Similarly, upper row 783 of base engagement element 780B has five (5) teeth. The upper and lower row of teeth of each base engagement element is capable to engage with a cap engagement mechanism as described herein to provide for a child-resistant container. For example, base engagement element 780B can engage with cap engagement mechanism 730B, having ramps 732A/732B and 732C/732D and ridge 732E. Upper row of teeth 783 securely fits between ramps 732A and 732C. Lower row of teeth 784 securely fits between ramps 732B and 732D and beneath ridge 732E. Ramps 732A/732B and 732C/732D prevent rotation of cap 700B around container base 700A.

Container cap 700B, with a closed top end and an open bottom end, has a substantially flat roof 790 and ramped edges 791 that lead up to interior sides 789. Annular ring 792 is placed within the cap 700B so that it sits on top of the ramped edges 791 to provide a seal. Annular sealing ring 792 comprises a thermoplastic elastomer (TPE), a thermoplastic vulcanizate (TPV), or a thermoplastic polyurethane (TPU). The annular seal provided by the annual sealing ring can help provide a barrier between the container environment and the external environment. Materials being stored in the container may be sensitive to air, water, oxygen, light, UV, humidity, temperature, bacteria, or combinations thereof. Annular ring 792 helps create a container where the contents are protected for improved shelf-life, such as being liquid-tight, air-tight, and other desirable properties.

Figure 8:
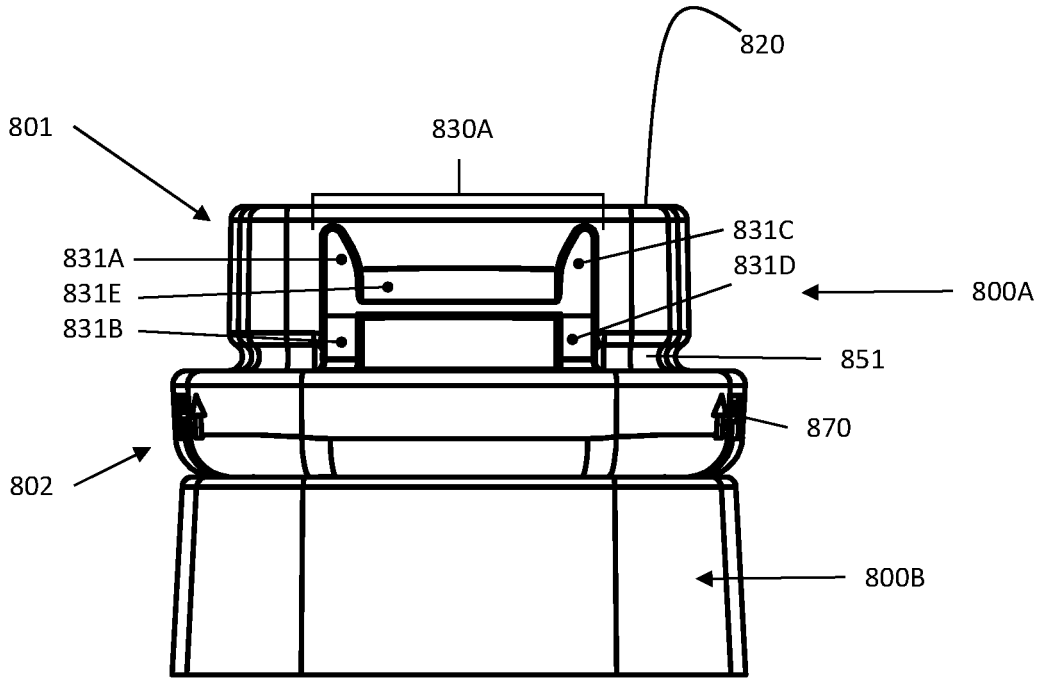
FIG. 8 illustrates a side view of an embodiment of a container base stacked on top of a container cap.

FIG. 8 is a side view of a container base 800A on top of container cap 800B. Container base has a neck 801 and a support/foot 802 portion. Cap engagement mechanism 830A has ramps 831A/831B and 831C/831D, and ridge 831E in an "H" configuration. Container base 800A also has an open top end 820, markings 870 and transfer neck 851.

Figure 9A:
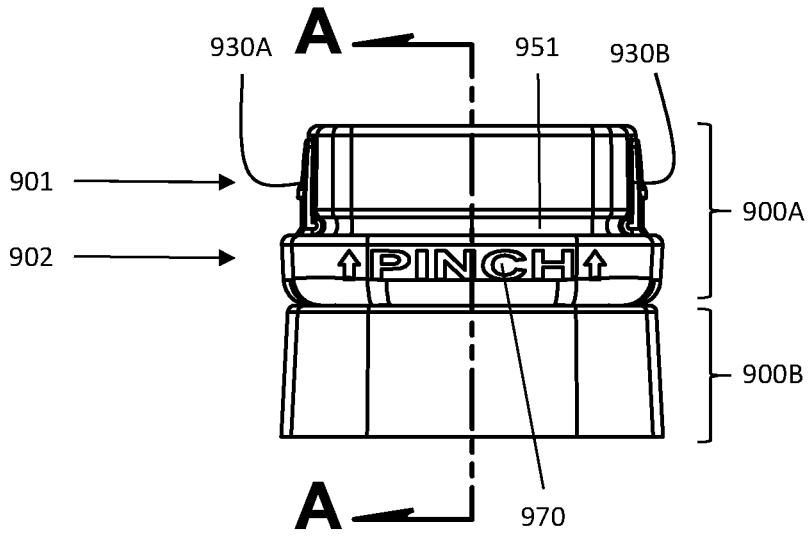
FIG. 9A illustrates a side view of an embodiment of a container base stacked on top of a container cap.
Figure 9B:
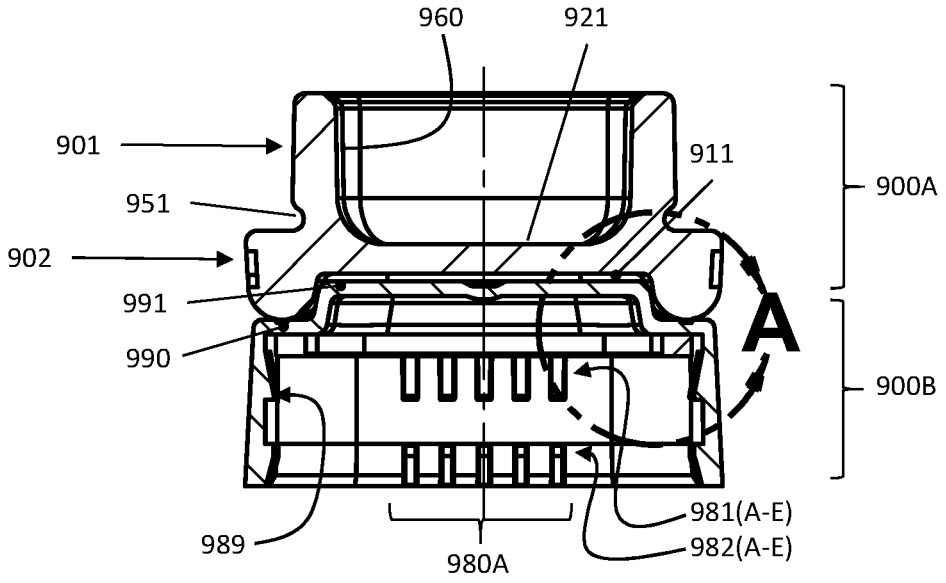
FIG. 9B illustrates a cross-sectional view (Section A-A) of the embodiment of the container base stacked on top of the container cap of FIG. 9A.

FIGS. 9A and 9B are another embodiment of a container base 900A and cap 900B stacked on each other. Container base 900A has neck 901 and support/foot 902. Cap engagement elements 930A and 930B are positioned on sides of the neck 901 opposite each other. Markings 970 on support/foot 902 portion is not on a side of the container base where is there is a cap engagement element. Transfer neck 951 partially or completely circumscribes neck 901, just above the support/foot 902.

Section A-A of FIG. 9A (illustrated as FIG. 9B) illustrates a top portion 991 of a top end 990 of cap 900B. Top potion 991 and top end 990 of cap 900B is sized to fit in a recessed portion 911 on a bottom end of the container base 900A. The interior side 989 of cap 900B has base engagement element 980A, having an upper row of teeth 981 and a lower row of teeth 982. Teeth 981A-E and 982A-E engage with and securely fit with a cap engagement element.

Inner walls 960 of container base 900A form a cavity 921 for storage.

Figure 9C:
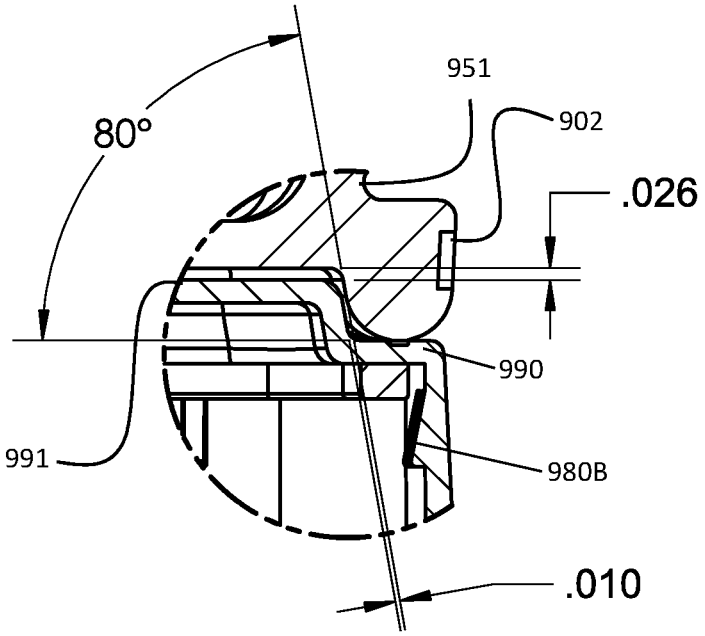
FIG. 9C illustrates a cross-sectional view (Detail A) of the embodiment of the container base stacked on top of the container cap of FIG. 9B.

FIG. 9C is Detail A of FIG. 9B, where container cap 900B sits in container base 900A. Foot/support 902 portion of container base 900A sits on top of the top end 990 and elevated portion 991 of the container cap 900B. Base engagement element 980B and transfer neck 951 are also shown in FIG. 9C.

Figure 10:
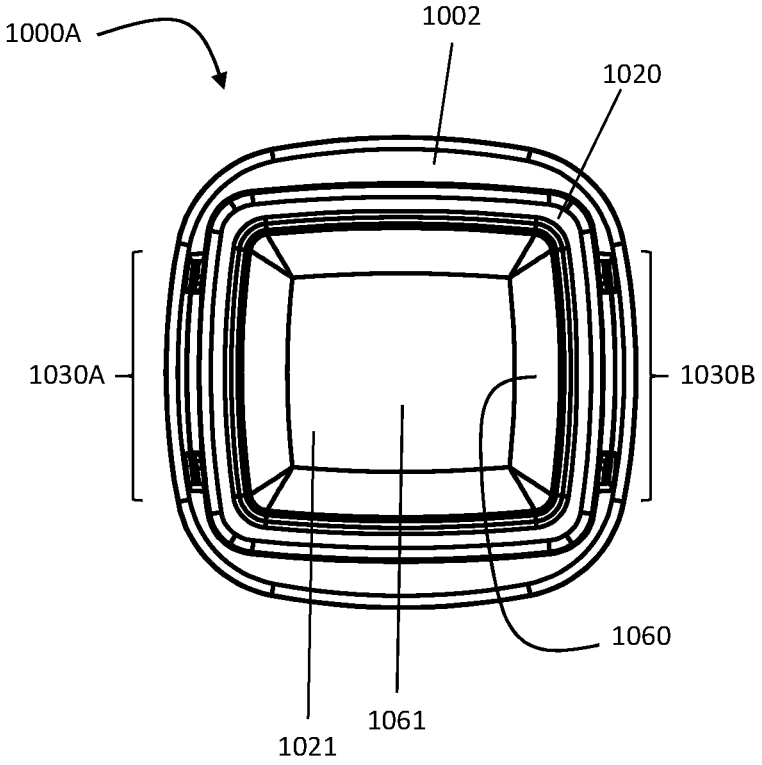
FIG. 10 illustrates a top view of an embodiment of a container base stacked on top of a container cap.

FIG. 10 is a top view of a container base 1000A having a foot/support portion 1002, stacked on top of a container cap. Container base 1000A also has two cap engagement elements 1030A and 1030B disposed on opposite sides of the base. The open top end 1020, inner wall 1060 and inner floor 1061 of container base all form and define a cavity 1021 for the storage of material.

Figure 11:
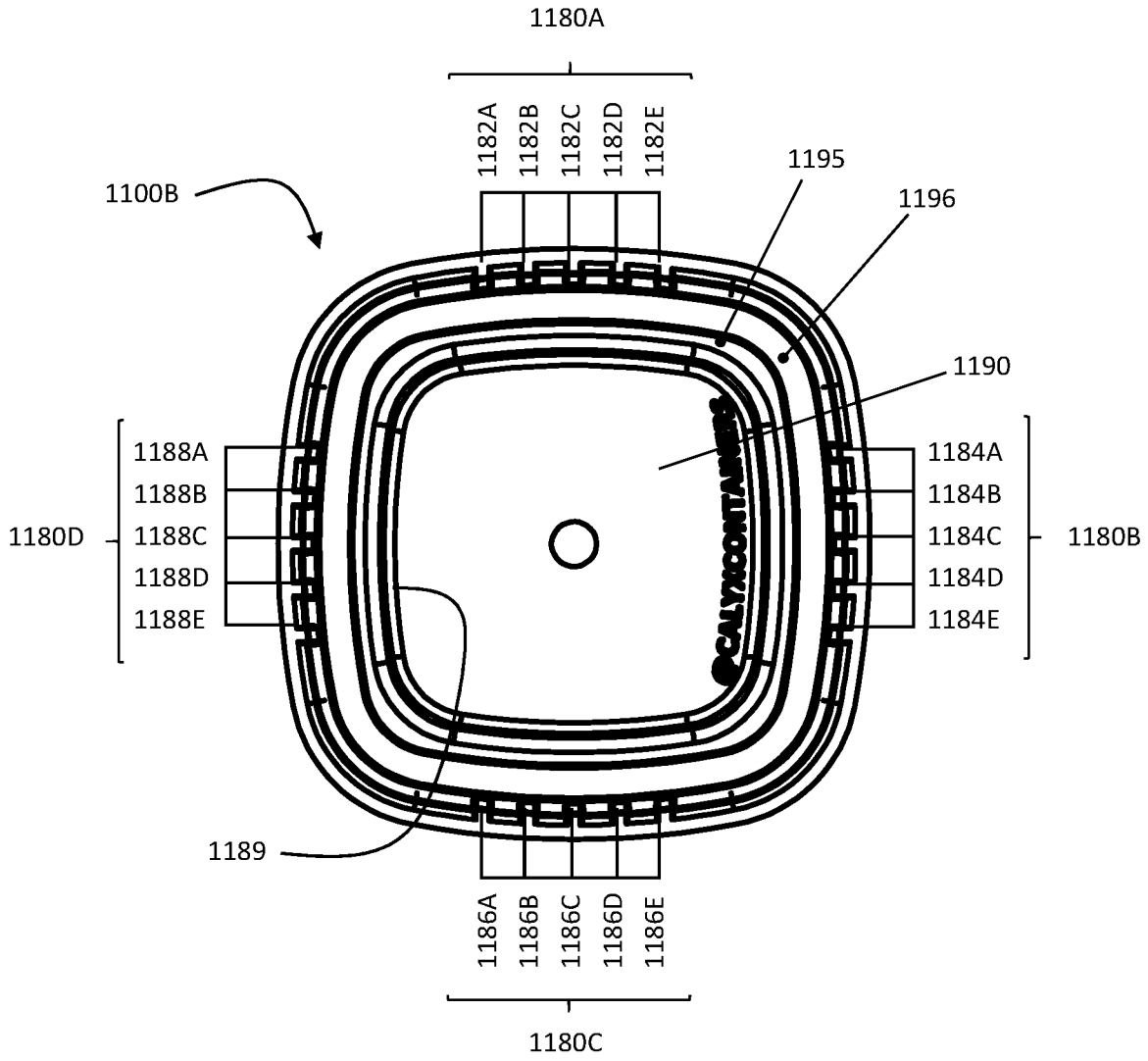
FIG. 11 illustrates a bottom view of an embodiment of a container base stacked on top of a container cap.

FIG. 11 is a bottom view of a container cap 1100B staked with a container base. Container cap 1100B has four (4) base engagement elements 1180A, 1180B, 1180C, and 1180D, each positioned on an inner side 1189 of the cap 1100B. Each of the base engagement elements 1180A, 1180B, 1180C, and 1180D has a lower row of teeth, 1182, 1184, 1186 and 1188, respectively. Also, each row of teeth is made up of five (5) teeth, e.g., 1182A, 1182B, 1182C, 1182D and 1182E.

Container cap 1100B also has annual sealing ring 1196 positioned on an inner surface 1195. Annular sealing ring (e.g., O-ring) 1196 is on the inner surface 1195 at or near the top end of the cap. Annular sealing ring comprises a thermoplastic elastomer (TPE), a thermoplastic vulcanizate (TPV), or a thermoplastic polyurethane (TPU).

The annular seal provided by the annual sealing ring can help provide a barrier between the container environment and the external environment. Materials being stored in the container may be sensitive to air, water, oxygen, light, UV, humidity, temperature, bacteria, or combinations thereof. Materials being stored in the container may also be prone to adhere to external environmental surfaces. Combinations of the container base, container cap, and annular sealing ring help the stored materials to remain in the container until the user is ready to remove for use.

Figure 12A:
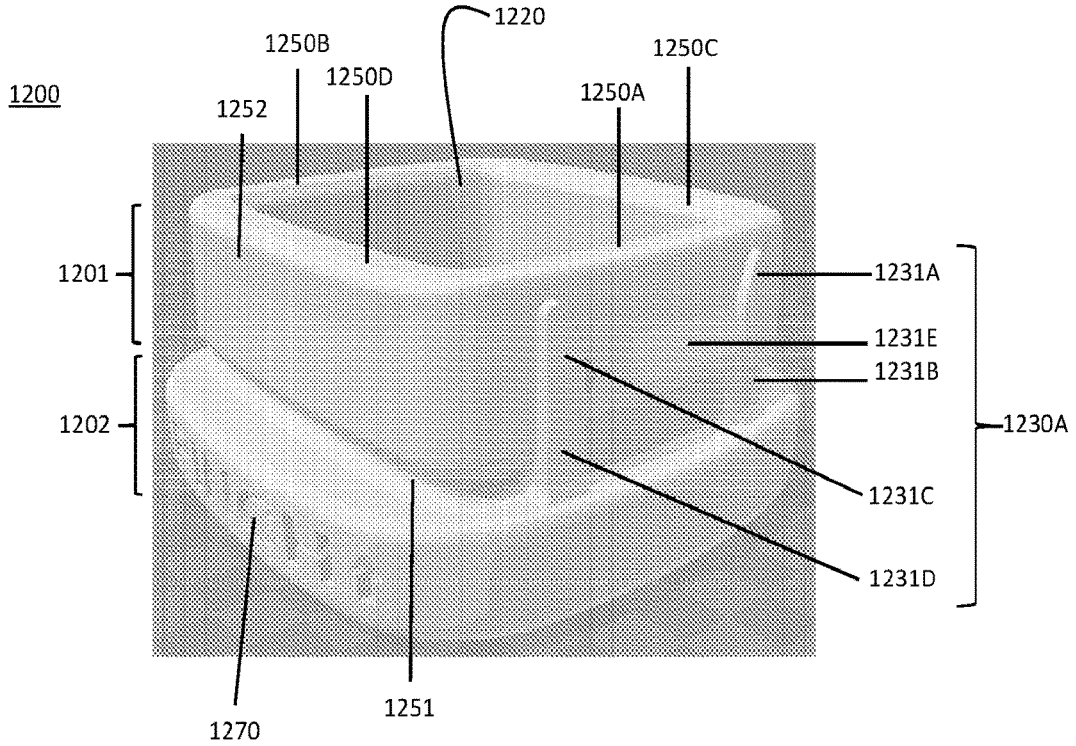
FIG. 12A illustrates a perspective view of an embodiment of a container base.
Figure 12B:
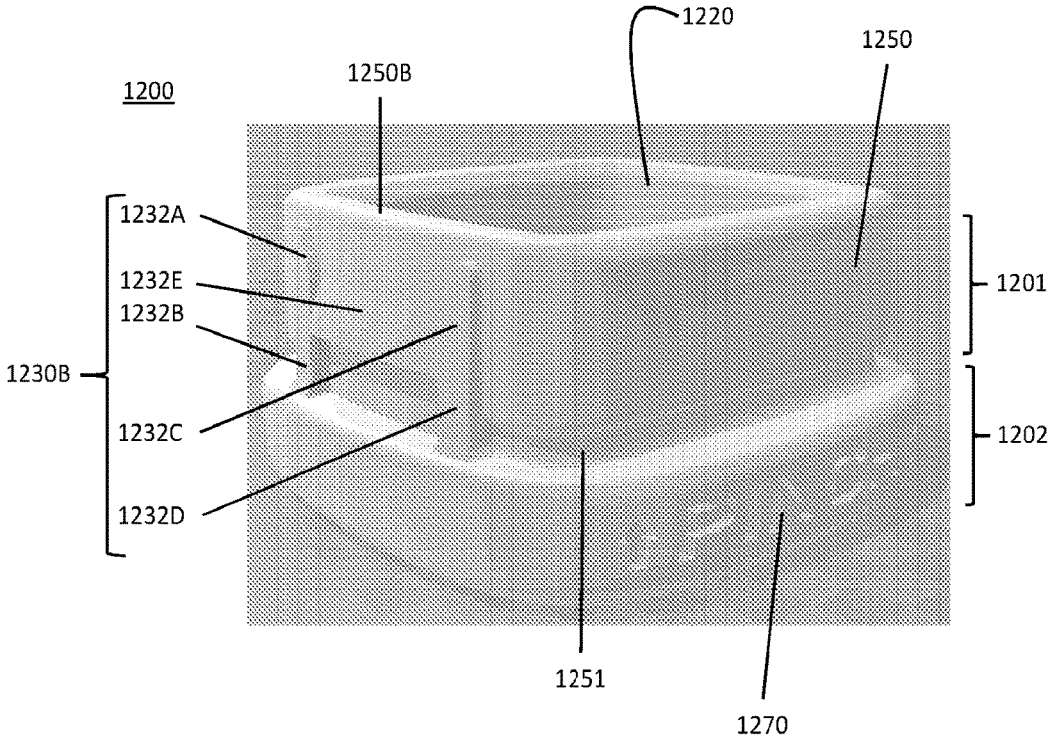
FIG. 12B illustrates a perspective view of the embodiment of a container base of FIG. 12A.
Figure 13A:
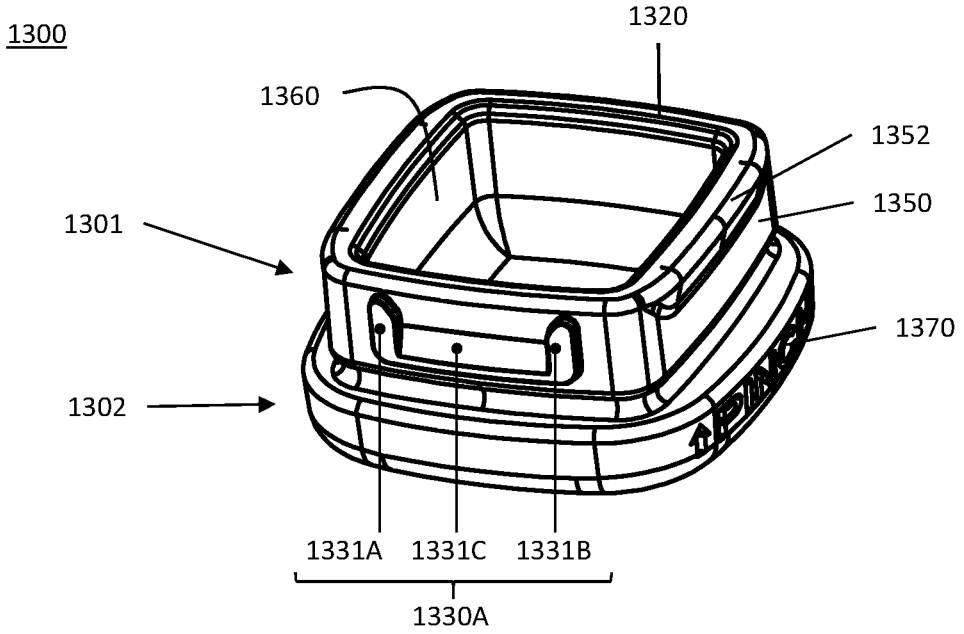
FIG. 13A illustrates a top perspective view of an embodiment of a container base.
Figure 13B:
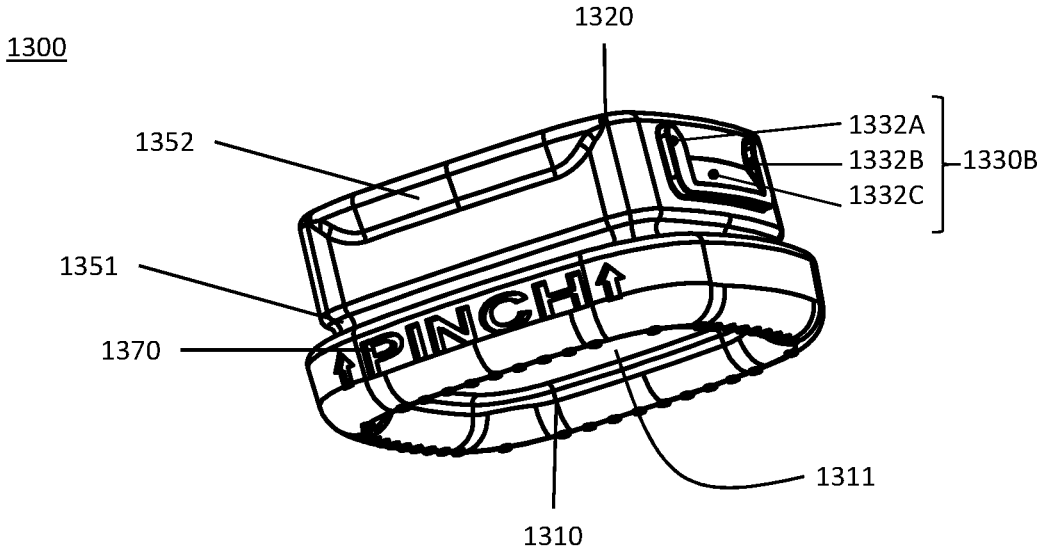
FIG. 13B illustrates a side perspective view of an embodiment of a container base.
Figure 13C:
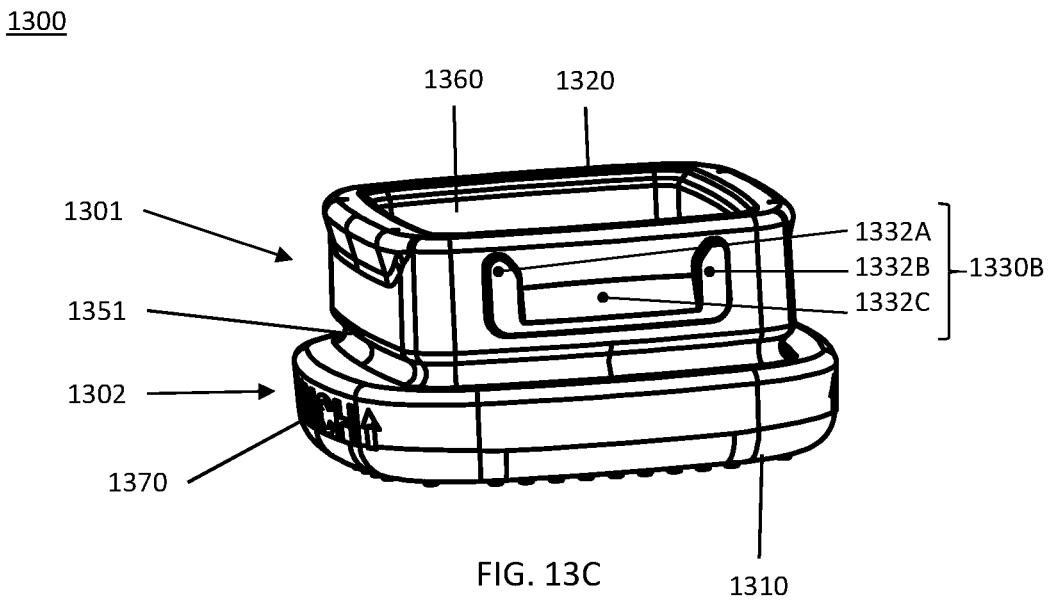
FIG. 13C illustrates another side perspective view of an embodiment of a container base.
Figure 13D:
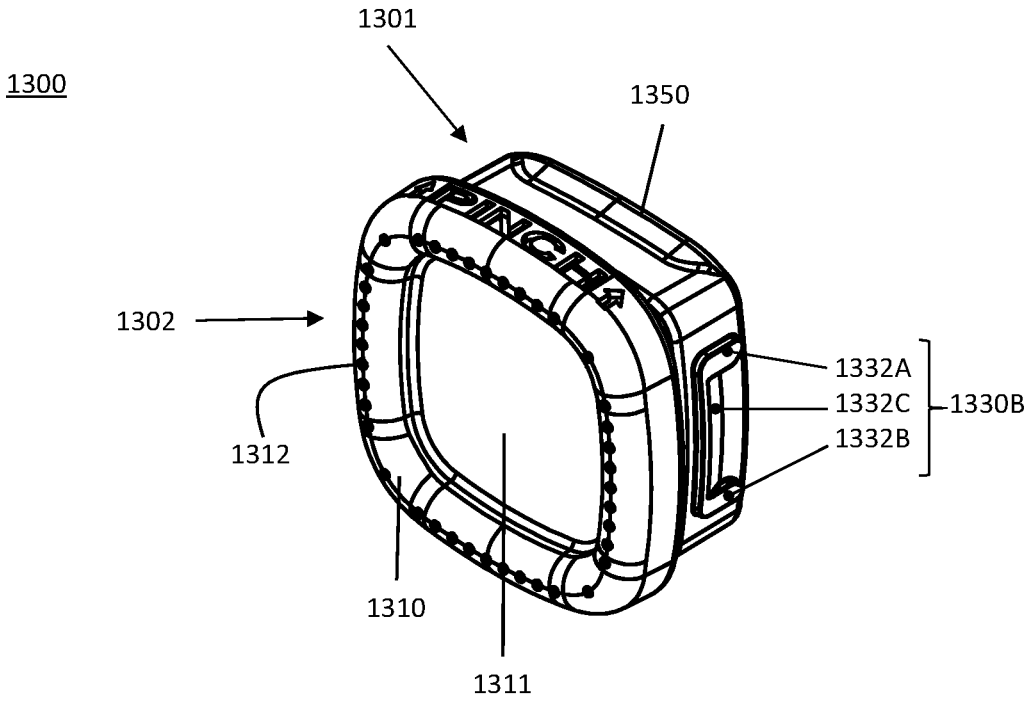
FIG. 13D illustrates a bottom perspective view of an embodiment of a container base.

FIGS. 12A and 12B illustrate another embodiment of a container base 1200. Container base 1200 has neck 1201 and foot/support 1202. Neck 1201 of container base 1200 has an open top end 1220. Sides 1250A, 1250B, 1250C and 1250D of neck 1201 define a cavity. Positioned on side 1250A is a cap engagement mechanism 1230A. Cap engagement mechanism 1230A has ramps 1231A/1231B and 1231C/1231D, and ridge 1231E in an "H" configuration. Positioned on side 1250B is cap engagement mechanism 1230B. Cap engagement mechanism 1230B has ramps 1232A/1232B and 1232C/1232D, and ridge 1232E. Transfer neck 1251 partially circumscribes neck 1201 of container base 1200. Markings 1270 are positioned on opposite sides. Markings 1270 are also positioned on sides 1250C, 1250D where there is not a cap engagement mechanism. Ledge 1252 on side 1250D sits at or near open top end 1220. Another ledge is found on side 1250C (not shown).

Referring to FIGS. 13A-13D, symmetrical container base 1300 has a neck 1301 and a foot/support 1302 portion. Container base 1300 has an open top end 1320 and a closed bottom end 1310. Closed bottom end 1310 has stipples 1312 and a recessed potion 1311, sized and configured to receive a container cap. Cap engagement mechanisms 1330A, 1330B are positioned on one or more sides 1350 of container base 1300.

Cap engagement mechanism 1330A on one side of the container base 1300 has ramps 1331A and 1331B. Ridge 1331C is disposed between ramps 1331A and 1331B. Cap engagement mechanism 1330B on one side of the container base 1300 has ramps 1332A and 1332B. Ridge 1332C is disposed between ramps 1332A and 1332B.

Ramps 1331A, 1331B and ridge 1331C generally form a "U" shaped cap engagement mechanism 1330A. Similarly, ramps 1332A, 1332B and ridge 1332C generally form a "U" shaped cap engagement mechanism 1330B. Ramps 1331A, 1331B and 1332A, 1332B extend near or from the open top end 1320 to or near the transfer neck 1351.

Container base 1300 also has inner wall 1360 of a cavity.

Ledge 1352 is positioned on side 1350 near open top end 1320. Ledge 1352 is adjacent to cap engagement mechanism 1330A, 1330B, and is found on the same side of container base 1300 as markings 1370.

Figure 14A:
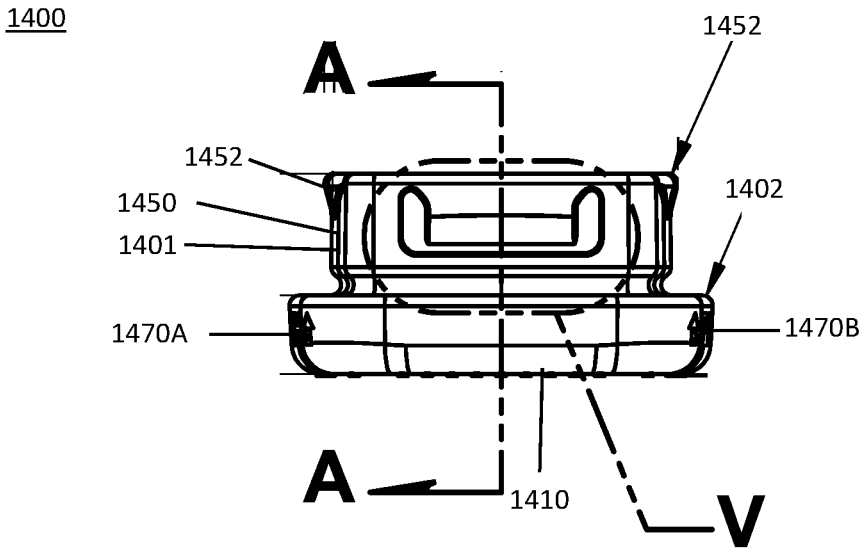
FIG. 14A illustrates a side view of an embodiment of a container base.
Figure 14B:
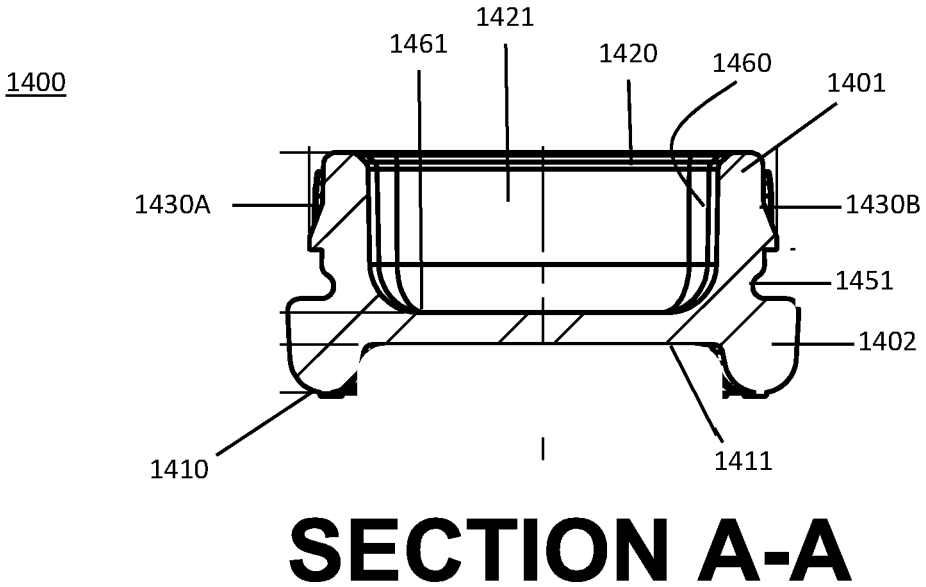
FIG. 14B illustrates a cross-sectional view (Section A-A) of the embodiment of the container base of FIG. 14A.
Figure 14C:
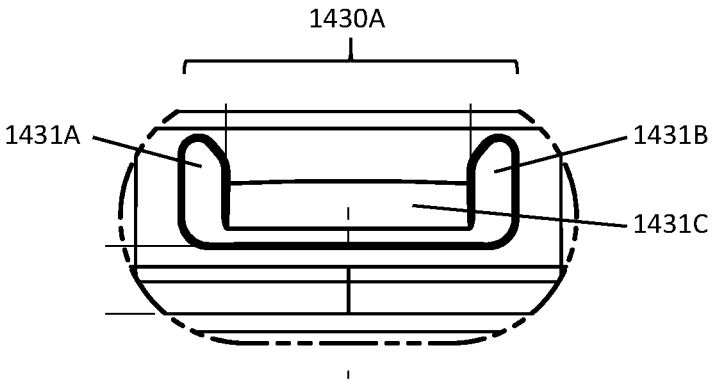
FIG. 14C illustrates an enlarged side view (Detail V) of the embodiment of a cap engagement mechanism of the container base of FIG. 14A.

Referring to FIGS. 14A-14C, container base 1400 has a neck 1401 and foot/support 1402. Markings 1470A and 1470B are disposed on opposite sides of the foot/support 1402. Ledges 1452 are on the same sides of the container as markings 1470A, 1470B, adjacent to cap engagement mechanisms 1430A, 1430B. Ledges 1452 extend from open top end 1420 partially down side 1450. Container base 1400 has an open top end 1420 and a closed bottom end 1410, having a recessed portion 1411. Recessed portion 1411 is sized and configured to receive an elevated portion of a top end of a container cap. Inner wall 1460, inner floor 1461 and cavity 1421 form part of the container base 1400. Transfer neck 1451 substantially circumscribes the neck 1401 of container base 1400.

Cap engagement mechanisms 1430A and 1430B are positioned on opposite sides of the container base 1400 (FIGS. 14A and 14B). Cap engagement element 1430A has ramps 1431A, 1431B. Ramps 1431A and 1431B are substantially parallel to each other and extend from or near the open top end 1420 to or near the transfer neck 1451. Ridge 1431C connects ramps 1431A and 1431B. Ramps 1431A, 1432B and ridge 1431C are in a "U" configuration. Cap engagement element 1430A can be a single element or a plurality of elements (e.g., 2, 3, or more).

Figure 15A:
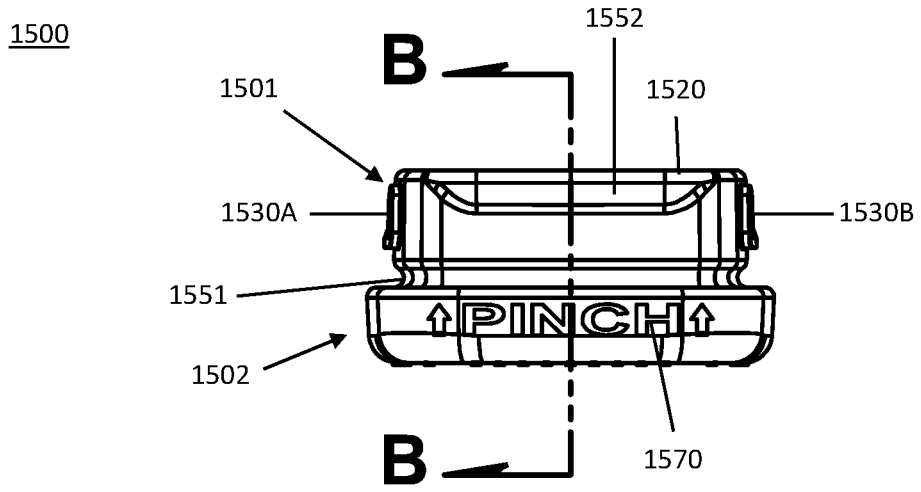
FIG. 15A illustrates a side view of an embodiment of a container base.
Figure 15B:
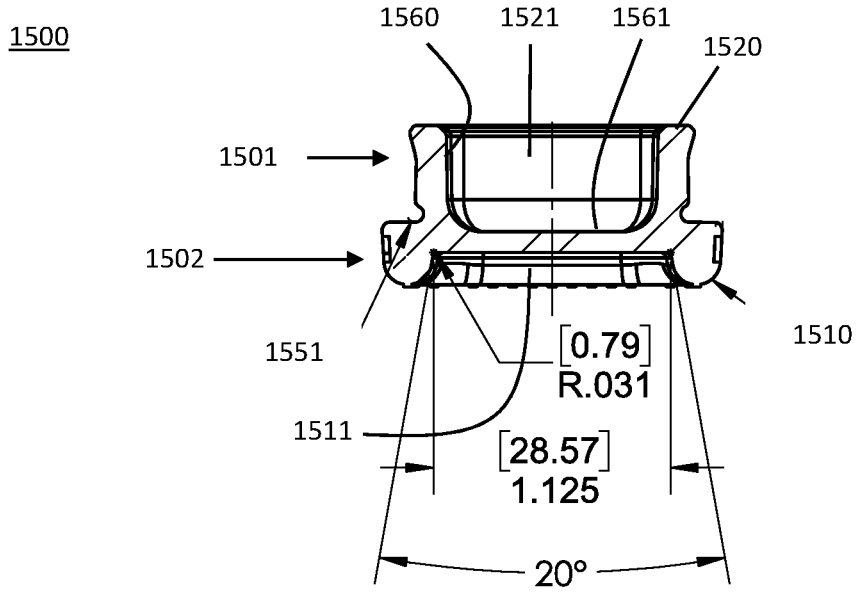
FIG. 15B illustrates a cross-sectional view (Section B-B) of the embodiment of the container base of FIG. 15A.

Referring to FIGS. 15A-15B, container base 1500 has a neck 1501 and a foot/support 1502 portion. Container base 1500 has an open top end 1520 and a closed bottom end 1510, the closed bottom end 1510 having a recessed portion 1511. Closed bottom end 1510 and recessed portion 1511 are sized and configured to stack upon a container cap. Transfer neck 1551 substantially or completely circumscribes the neck 1501 of container base 1500.

Cap engagement mechanisms 1530A and 1530B are positioned on opposite sides of container base. The cap engagement mechanisms 1530A and 1530 extend generally from or near the open top end 1520 to or near the transfer neck 1551.

Markings 1570 disposed on sides of container base instruct a user how to remove a container cap from the container base. Ledge 1552 extends from open top end 1520 to partially down a side of container neck 1501. Ledge 1552 is found on the same side as markings 1570. Container base 1500 also has an inner wall 1560, inner floor 1561 and a cavity 1521 for storage of materials.

Figure 16:
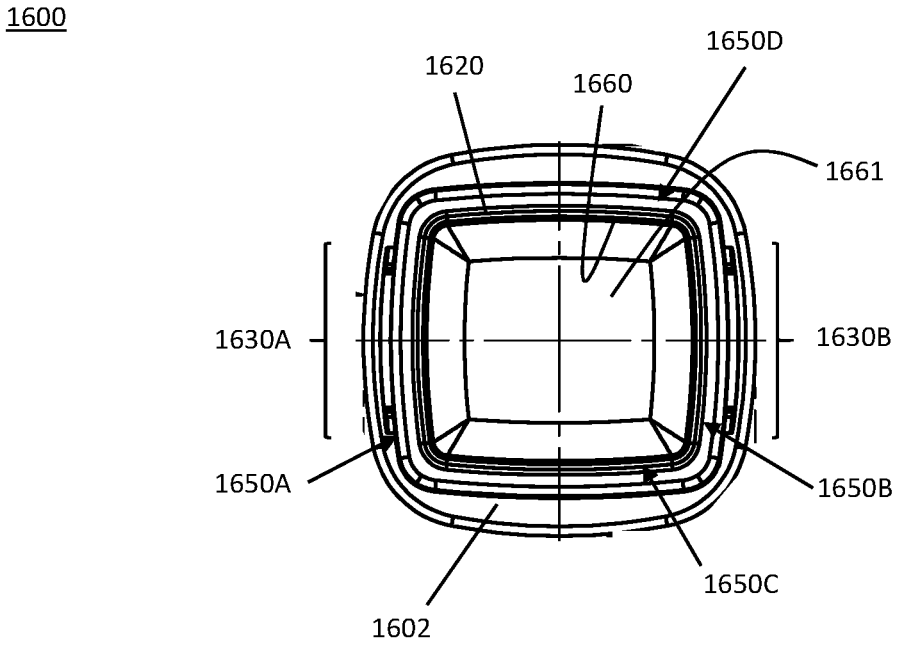
FIG. 16 illustrates a top view of an embodiment of a container base.

Referring to FIG. 16, generally symmetrical container base 1600 has sides 1650A, 1650B, 1650C and 1650D. Positioned on sides 1650A and 1650B are cap engagement elements 1630A and 1630B, respectively. Container base 1600 has an open top end 1620 and one or more inner walls 1660. Sides 1650A, 1650B, 1650C and 1650D and inner floor 1661 define a cavity. Portions of foot/support 1602 are shown because the diameter of the foot 1602 is greater than the diameter of the neck.

Figure 17:
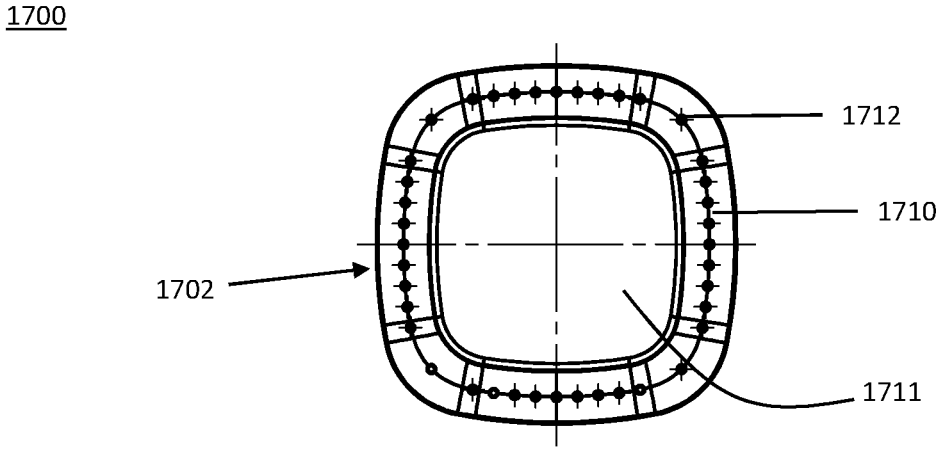
FIG. 17 illustrates a bottom view of an embodiment of a container base.

FIG. 17 is a bottom view of foot/support 1702 portion of container base 1700, having a closed bottom end 1710 with stipples 1712 and a recessed portion 1711, sized and configured to receive a container cap. The recessed portion 1711 on the closed bottom end 1710 allows for securing and mating with another container.

Figure 20A:
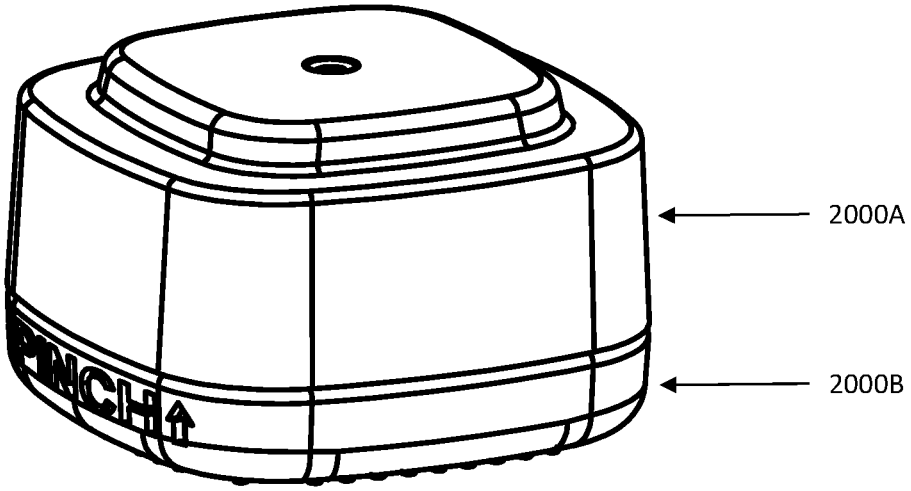
FIG. 20A illustrates a perspective view of an embodiment of a container having a base and a cap.
Figure 20B:
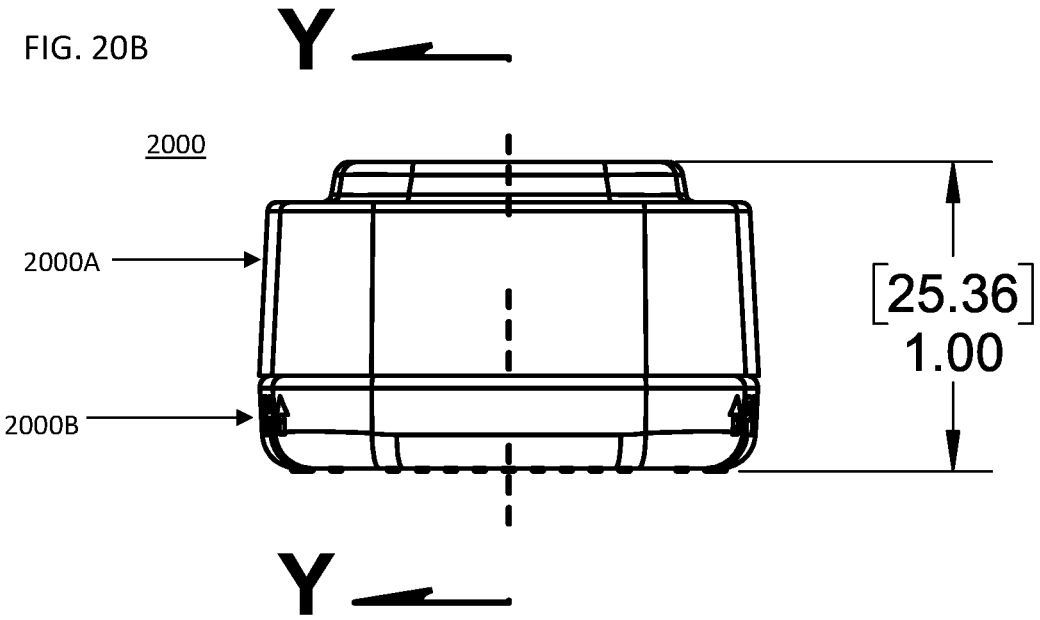
FIG. 20B illustrates a side view of the embodiment of the container of FIG. 20A.
Figure 20C:
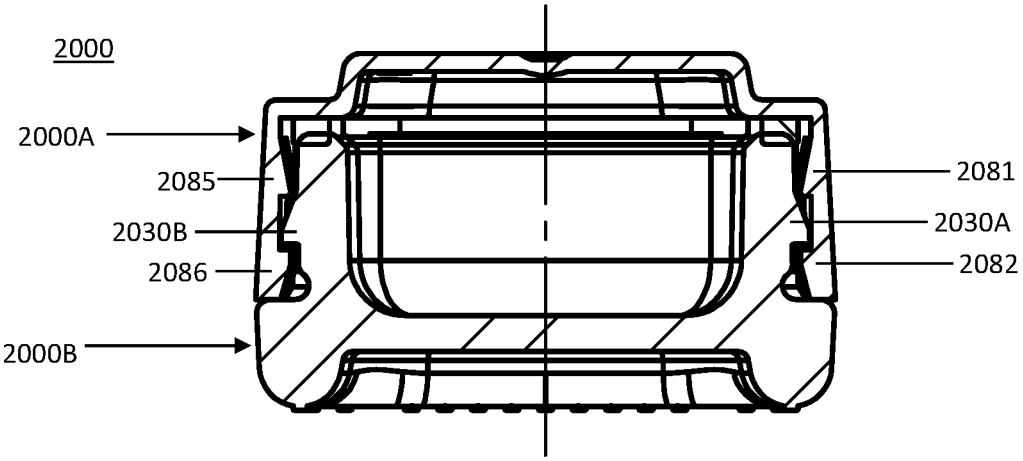
FIG. 20C illustrates a cross-sectional view (Section Y-Y) of the embodiment of the container of FIG. 20B.

FIGS. 20A-20C illustrate container 2000 having a cap 2000A on base 2000B. FIG. 20C illustrates a cross-section of container 2000 having cap 2000A on base 2000B. Teeth 2081, 2082 of a base engagement element securely mate to cap engagement mechanism 2030A. On an opposite side of container 2000, teeth 2085, 2086 of another base engagement element securely mate to cap engagement mechanism 2030B.

The child-resistant features of the container relate to the engagement of the container base with the container cap. One or more cap engagement mechanisms are part of the container base. The cap engagement mechanism is made up of a pair of ramps and a ridge. The ramps extend from at or near the open end of a cap to or near the transfer neck or foot/support portion of the container base. A ridge is between two ramps. The ramps and ridge provide guidance and alignment of the container cap in addition to providing a tight fit with the container base. The cap engagement mechanism prevents a container cap from easily being taken off the container base or removed improperly. Generally, a cap engagement mechanism is position on two, opposite sides of the container base. However, other configurations of the cap engagement mechanisms are contemplated, such as 1, 3 or 4 mechanisms on the container base.

Various embodiments of the cap engagement mechanism are illustrated in FIGS. 21-44. Child-resistance is achieved by mating or engaging a cap engagement mechanism on a base with a base engagement mechanism on a cap. Due to the engagement, a user must perform one or more steps to disengage the cap engagement mechanism from the base engagement mechanism. Typically, a user applies an external force along with a secondary movement in series or simultaneously. The containers described herein typically require a "pinch" or "squeeze" on opposite sides of a container base or cap while simultaneously lifting the cap off from the base. The "pinch" or "squeeze" causes the base engagement mechanism to disengage from the cap engagement mechanism.

Generally, various combinations of, shapes, and sizes of the ramps and/or ridge of the cap engagement mechanism are illustrated. The cap engagement mechanism sits on one or more sides of a substantially square-shaped neck of a container base. Various non-circular shaped necks are contemplated, such as oval, triangular, square, rectangular, polygonal, etc. Sides of the neck can be substantially straight or slightly curved. Two adjacent sides meet and form a corner, which can be rounded or at a certain angle (e.g., at 90°).

Figure 21A:
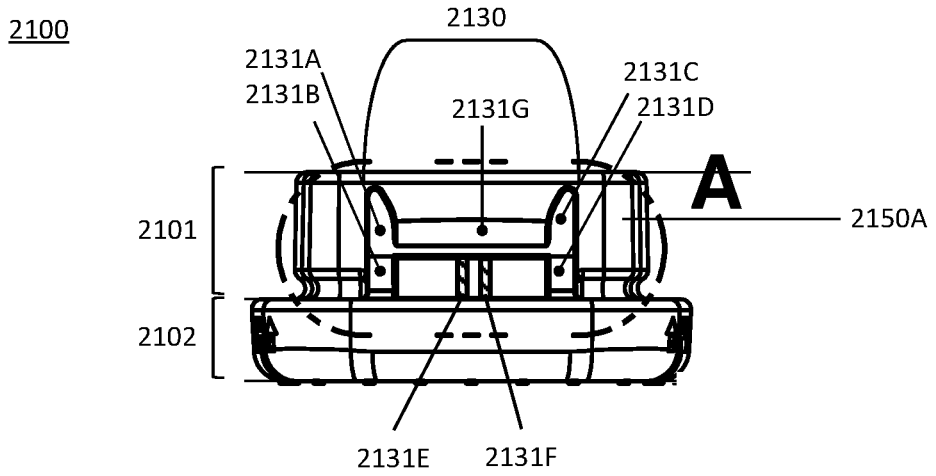
FIG. 21A illustrates a side view of an embodiment of a container base.
Figure 21B:
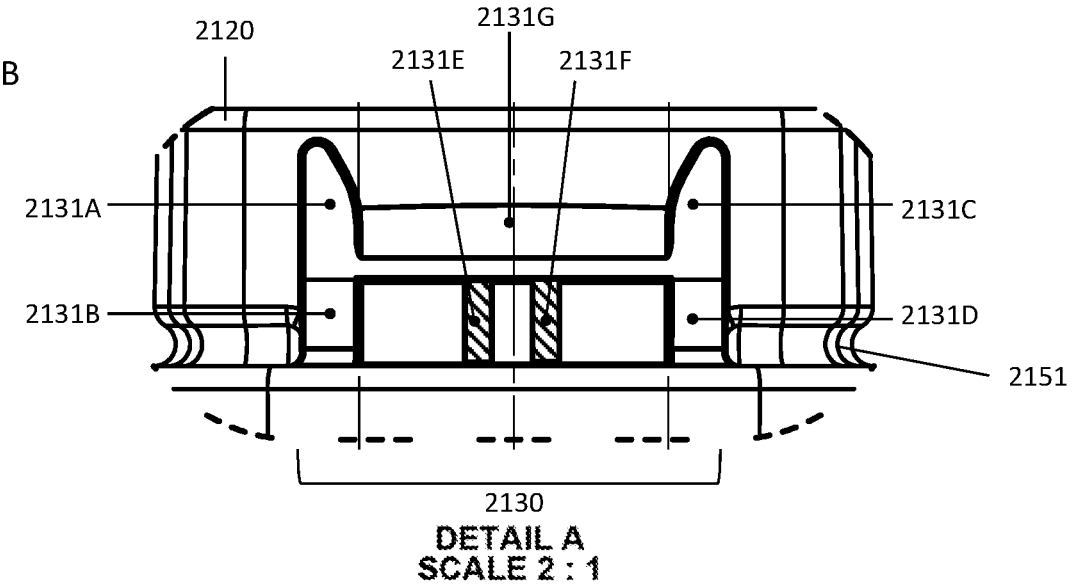
FIG. 21B illustrates a cross-sectional view (Detail A) of the embodiment of the container base of FIG. 21A.

FIGS. 21A-21B illustrate side views of container base 2100 having neck 2101 and foot 2102. Neck 2101 has cap engagement mechanism 2130 on side 2150A. Cap engagement mechanism 2130 has ramps 2131A/2131B and 2131C/2131D. Ridge 2131G extends from ramp 2131A to ramp 2131C. Ridge 2131G is substantially perpendicular to ramps 2131A, 2131C and parallel to transfer neck 2151 and foot 2102. Additional ramps 2131E, 2131F extend from and are perpendicular to ridge 2131G to foot 2102 or just above foot 2102. Ramps 2131E and 2131F are substantially parallel to each other and are parallel to ramps 2131A/2131B and 2131C/2131D. The spacing between ramps 2131A and 2131C is sized so that an upper row of teeth from a base engagement mechanism securely fits within this space. The space between ramp 2131B and 2131D is sized so that a lower row of teeth from a base engagement mechanism securely fits within this space. Also, two teeth fit between ramps 2131B and 2131E and two teeth fit between ramps 2131F and 2131D. A single tooth from a row of teeth fits between ramps 2131E and 2131F. In such a configuration, both the lower and the upper row of teeth each have five teeth. Ridge 2131G is sized so that it sits within the space formed by the two rows of teeth of the base engagement mechanism.

Figure 22A:
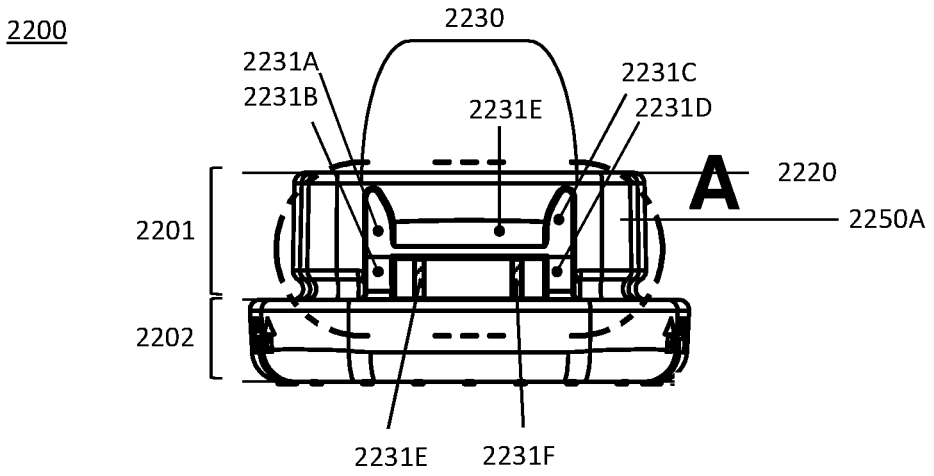
FIG. 22A illustrates a side view of an embodiment of a container base.
Figure 22B:
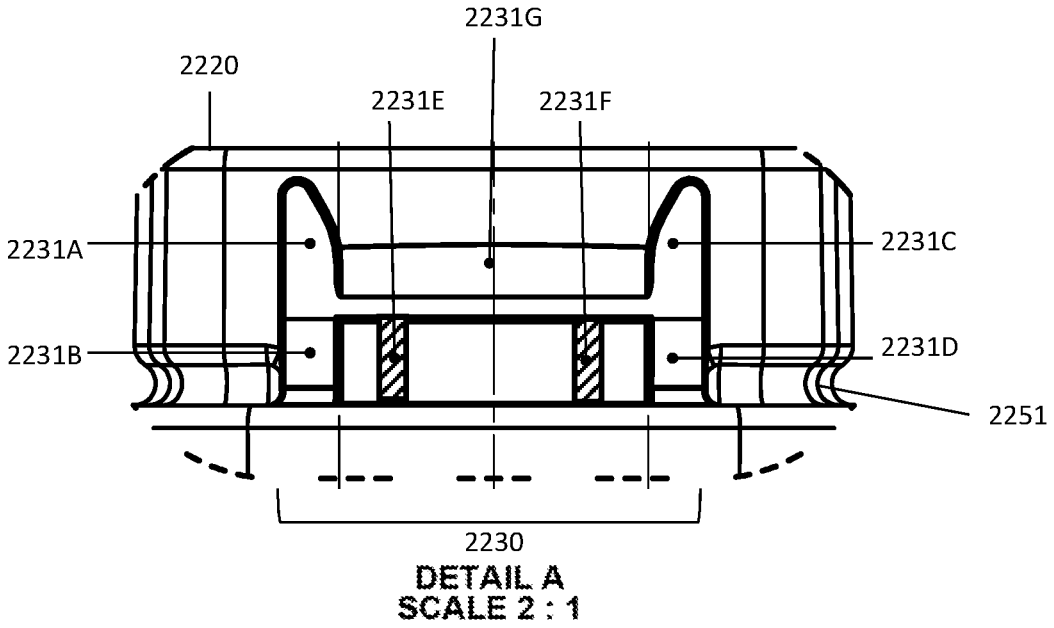
FIG. 22B illustrates a cross-sectional view (Detail A) of the embodiment of the container base of FIG. 22A.

Similarly, FIGS. 22A-22B illustrate side views of container base 2200 having neck 2201 and foot 2202. Neck 2201 has cap engagement mechanism 2230 on side 2250A. Cap engagement mechanism 2230 has ramps 2231A/2231B and 2231C/2231D. Ridge 2231G extends from ramp 2231A to ramp 2231C. Ridge 2231G is substantially perpendicular to ramps 2231A, 2231C and parallel to transfer neck 2251 and foot 2202. Additional ramps 2231E, 2231F are perpendicular to ridge 2231G and extend from ridge 2231G to foot 2202 or just above foot 2202. Ramps 2231E and 2231F are substantially parallel to each other and are parallel to ramps 2231A/2231B and 2231C/2231D. The spacing between ramps 2231A and 2231C is sized so that an upper row of teeth from a base engagement mechanism securely fits within this space. The space between ramp 2231B and 2231D is sized so that a lower row of teeth from a base engagement mechanism securely fits within this space. Also, one tooth fits between ramps 2231B and 2231E and one tooth fits between ramps 2231F and 2231D. Three teeth from a row of teeth fit between ramps 2231E and 2231F. In such a configuration, both the lower and the upper row of teeth each have five teeth. Ridge 2231G is sized so that it sits within the space formed by the two rows of teeth of the base engagement mechanism.

Figure 23A:
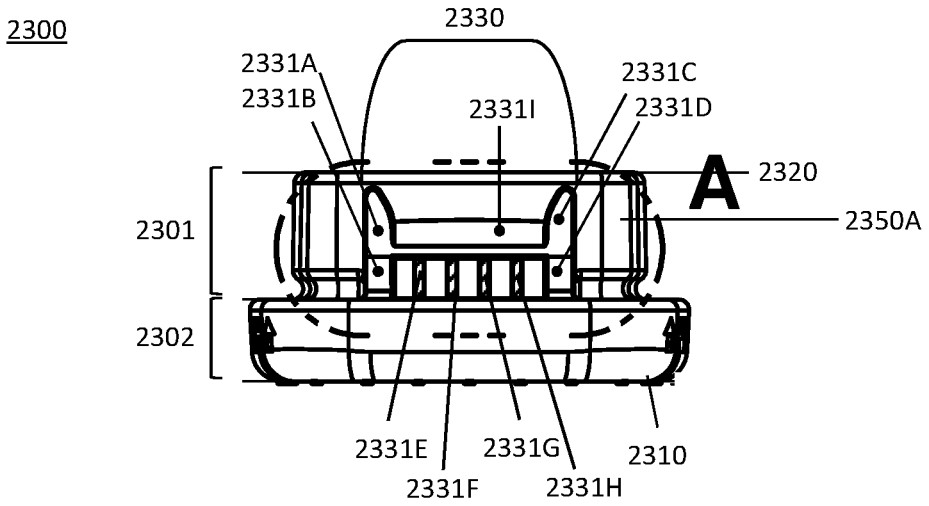
FIG. 23A illustrates a side view of an embodiment of a container base.
Figure 23B:
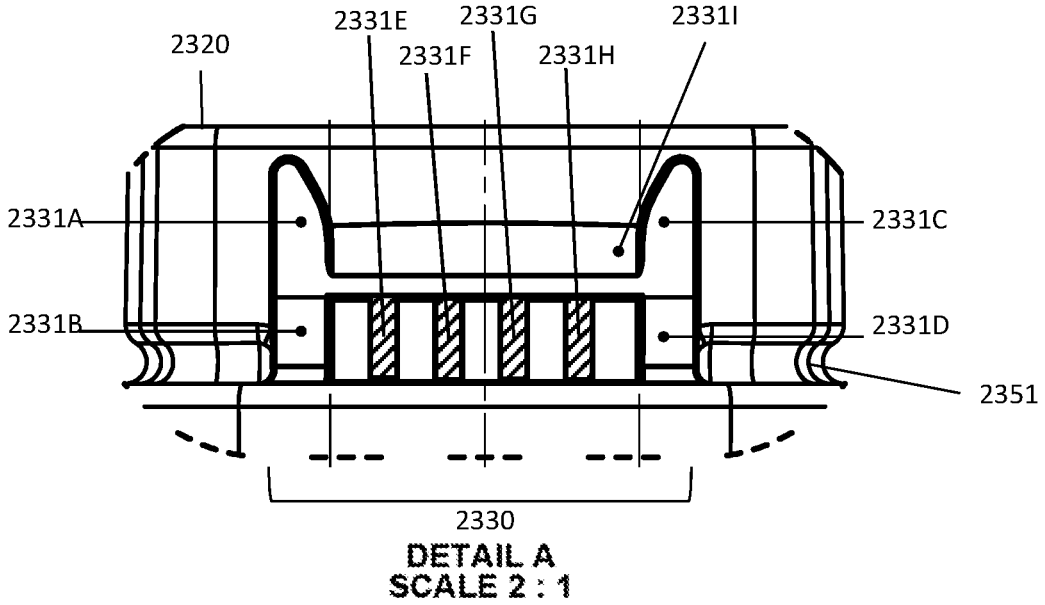
FIG. 23B illustrates a cross-sectional view (Detail A) of the embodiment of the container base of FIG. 23A.

FIGS. 23A-23B illustrate side views of container base 2300 having neck 2301 and foot 2302. Neck 2301 has cap engagement mechanism 2330 on side 2350A. Cap engagement mechanism 2330 has ramps 2331A/2331B and 2331C/2331D. Ridge 2331G extends from ramp 2331A to ramp 2331C. Ridge 2331G is substantially perpendicular to ramps 2331A, 2331C and parallel to transfer neck 2351 and foot 2302. Additional ramps 2331E, 2331F, 2331G, 2331H are perpendicular to ridge 2331I extend from ridge 2331I to foot 2302 or just above foot 2302. Ramps 2331E, 2331F, 2331G and 2331H are substantially parallel to each other and are parallel to ramps 2331B and 2331D. The spacing between ramps 2331A and 2331C is sized so that an upper row of teeth from a base engagement mechanism securely fits within this space. The space between ramp 2331B and 2331D is sized so that a lower row of teeth from a base engagement mechanism securely fits within this space. Also, one tooth fits between ramps 2331B and 2331E, ramps 2331E and 2331F, ramps 2331F and 2331G, ramps 2331G and 2331H, and ramps 2331H and 2331D. In such a configuration, both the lower and the upper row of teeth each have five teeth. Ridge 2331I is sized so that it sits within the space formed by the two rows of teeth of the base engagement mechanism.

FIGS. 24A-24D illustrate side views of a container base having various configurations of a cap engagement mechanism. Combinations of different sized and shaped ramps and a ridge are illustrated that provide and establish a child-resistant mechanism on the disclosed container bases.

Figure 24A:
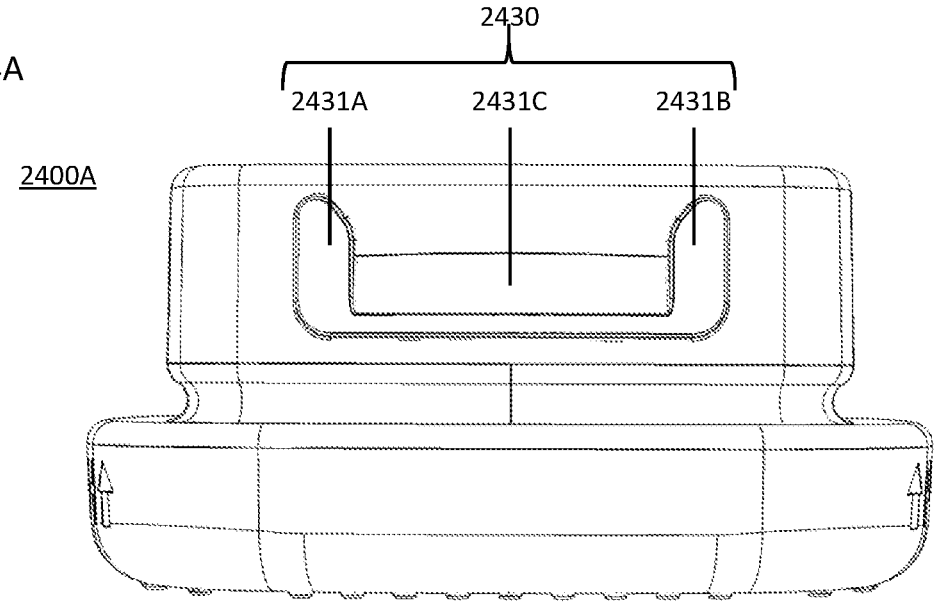
FIG. 24A illustrates a side view of an embodiment of a container base.

Base 2400A of FIG. 24A has cap engagement mechanism 2430 on a side of the neck of the base. Cap engagement mechanism 2430 has ramps 2431A and 2431B, connected by ridge 2431C. Ramps 2431A and 2431B and ridge 2431C are in a "U" shape. Ramps 2431A and 2431B are substantially parallel to each other. Ramps 2431A and 2431B are substantially perpendicular to the base foot/support. Ramps 2431A and 2431B can have rounded corners, as illustrated in FIG. 24A.

The space between ramps 2431A and 2431B is sized and configured to allow for a row of teeth from a base engagement mechanism of a cap to fit. Ramps 2431A and 2431B also act as anti-rotation elements and can prevent rotation of the cap while on the base. Teeth from a base engagement mechanism cannot laterally move or slide over ramps 2431A and 2431B. Also, the non-circular shape of the container base and cap contributes to the prevention of rotation of the cap around the neck of the base.

Ridge 2431C acts as a ledge or ramp and is configured to allow for a second row of teeth from a base engagement element to slide over. When engaged, the second row of teeth from a cap sits beneath or inferior to ridge 2431C. A lip on a bottom end of ridge 2431C can prevent the row of teeth and also the cap from upward movement.

Figure 24B:
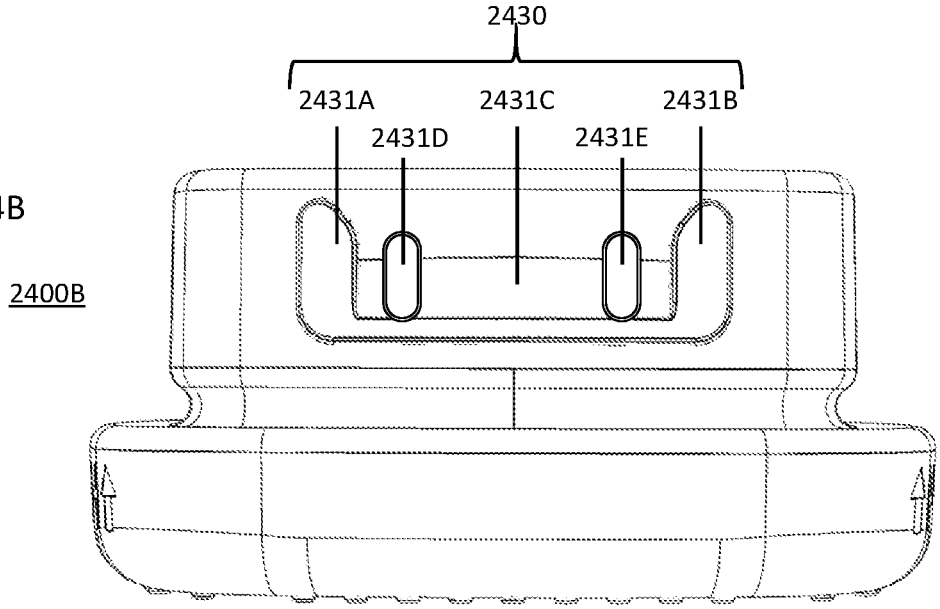
FIG. 24B illustrates a side view of an embodiment of a container base.

Base 2400B of FIG. 24B has cap engagement mechanism 2430. Similar to base 2400A of FIG. 24A, cap engagement mechanism 2430 has ramps 2431A and 2431B and ridge 2431C connecting the ramps in a "U" shaped formation. Additional ramps 2431D and 2431E are disposed between ramps 2431A and 2431B. Ramps 2431D and 2431E are sized and configured to allow one or more teeth from a base engagement mechanism from a cap to fit. The space between 2431D and 2431E is sized and configured to allow for three teeth from a base engagement mechanism to fit. The space between 2431A and 2431D is sized and configured to allow for one tooth from a base engagement mechanism to fit. Similarly, the space between 2431B and 2431E is sized and configured to allow for one tooth from a base engagement mechanism to fit.

Figure 24C:
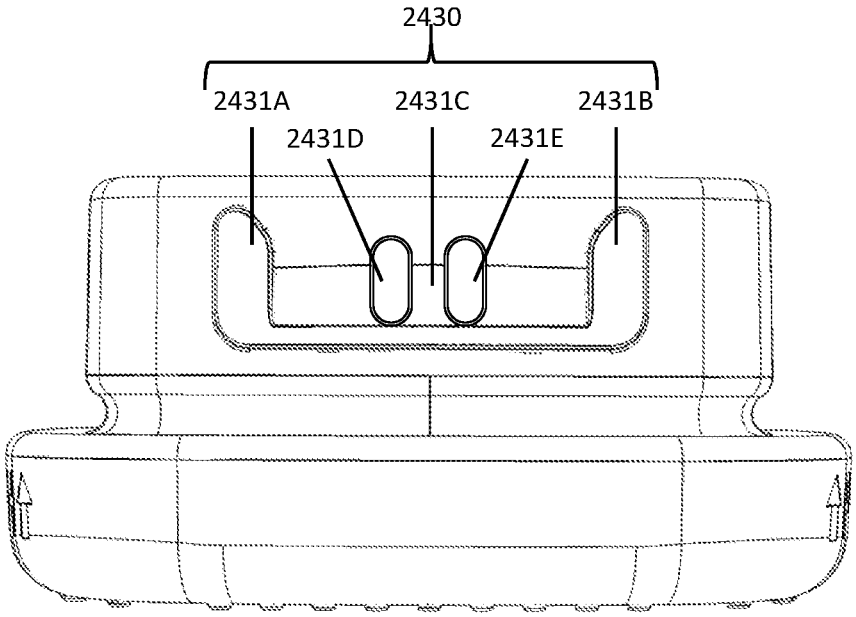
FIG. 24C illustrates a side view of an embodiment of a container base.

Base 2400C of FIG. 24C has cap engagement mechanism 2430, with ramps 2431D and 2431E sized and configured to allow one or more teeth from a base engagement mechanism from a cap to fit next to. The space between 2431D and 2431E is sized and configured to allow for one tooth from a base engagement mechanism to fit. The space between 2431A and 2431D is sized and configured to allow for two teeth from a base engagement mechanism to fit. Similarly, the space between 2431B and 2431E is sized and configured to allow for two teeth from a base engagement mechanism to fit.

Figure 24D:
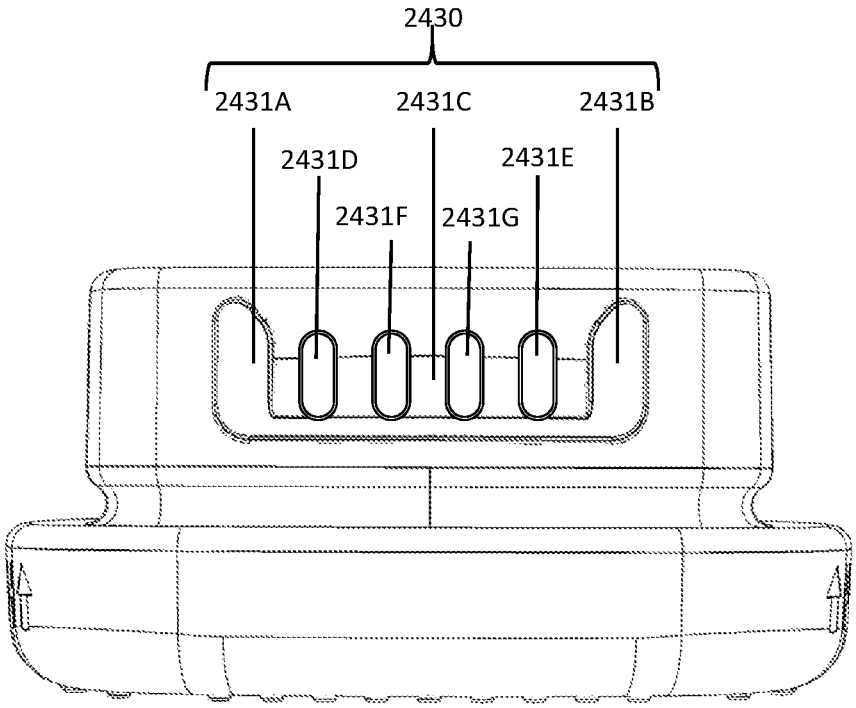
FIG. 24D illustrates a side view of an embodiment of a container base.

In FIG. 24D, base 2400D has six ramps, 2431A, 2431B, 2431D, 2431E, 2431F and 2431G. The space between each of the ramps (e.g., between 2431A and 2431D) is sized and configured to allow for one tooth from a base engagement mechanism to fit.

The number of ramps, the size of the ramps, the spacing between the ramps, the size of the ridge, and other variables can all be adjusted according to the base engagement mechanism, such as the size of the teeth, the number of teeth, the spacing between the teeth.

For example, FIGS. 25A-25B and 26A-26D illustrate side views of other embodiments of a cap engagement mechanism according to the present disclosure. Generally, the cap engagement mechanism is sized smaller than cap engagement mechanism 2430 illustrated in FIGS. 24A-24D. Specifically, the ridge of cap engagement mechanism of FIGS. 25A-26D is shorter than ridge 2431C.

Figure 25A:
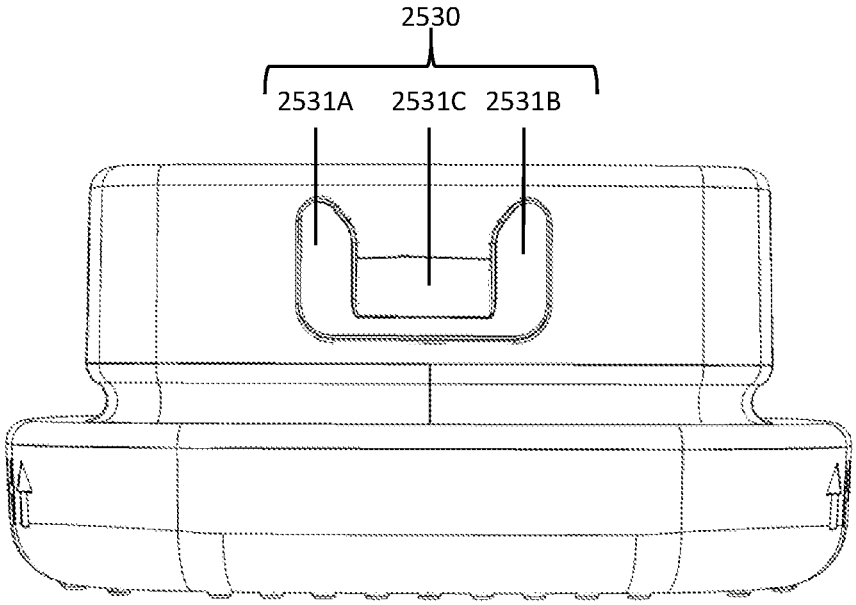
FIG. 25A illustrates a side view of an embodiment of a container base.

Base 2500A of FIG. 25A has cap engagement mechanism 2530. Cap engagement mechanism 2530 has ramps 2531A and 2531B and ridge 2531C. Ramps 2531A and 2531B and ridge 2531C form a "U" shape. Ramps 2531A and 2531B are substantially parallel to each other. Ramps 2531A and 2531B are substantially perpendicular to the base foot/support. Ramps 2531A and 2531B can have rounded corners, as illustrated in FIG. 25A.

The space between ramps 2531A and 2531B is sized and configured to allow for three teeth from a base engagement mechanism of a cap to fit. Ramps 2531A and 2531B also act as anti-rotation elements and can prevent rotation of the cap while on the base. Teeth from a base engagement mechanism cannot laterally move or slide over ramps 2531A and 2531B. Also, the non-circular shape of the container base and cap contributes to the prevention of rotation of the cap around the neck of the base.

Ridge 2531C acts as a ledge or ramp and is configured to allow for a second row of teeth from a base engagement element to slide over. When engaged, one or more teeth from a second row of teeth from a cap sits beneath or inferior to ridge 2531C. A lip on a bottom end of ridge 2531C can prevent the row of teeth and also the cap from upward movement.

Figure 25B:
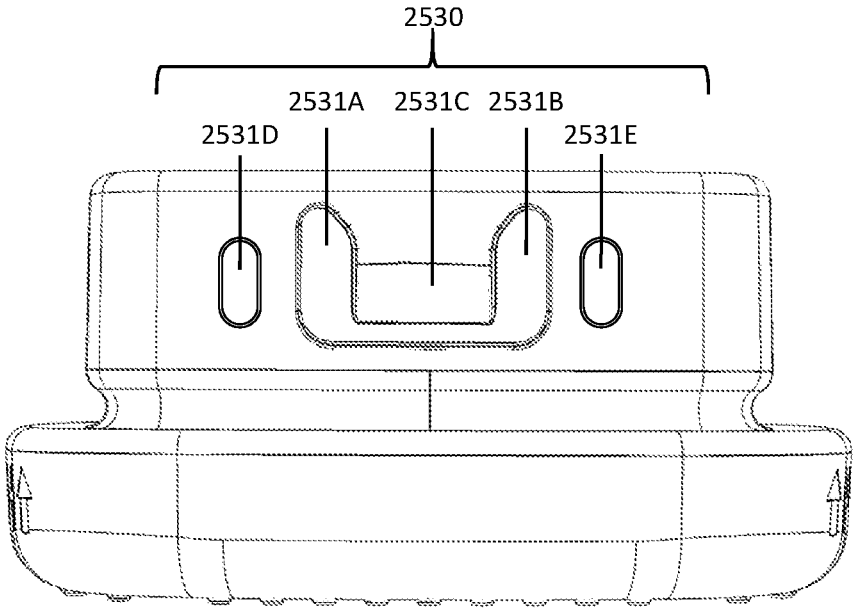
FIG. 25B illustrates a side view of an embodiment of a container base.

Base 2500B of FIG. 25B has cap engagement mechanism 2530. Similar to base 2500A of FIG. 25A, cap engagement mechanism 2530 has ramps 2531A and 2531B and ridge 2531C connecting the ramps in a "U" shape. Additional ramps 2531D and 2531E are disposed laterally from ramps 2531A and 2531B, respectively. Ramps 2531D and 2531E are sized and configured to allow one or more teeth from a base engagement mechanism from a cap to fit next to. The space between 2531A and 2531B is sized and configured to allow for three teeth from a base engagement mechanism to fit. The space between 2531A and 2531D is sized and configured to allow for one tooth from a base engagement mechanism to fit. Similarly, the space between 2531B and 2531E is sized and configured to allow for one tooth from a base engagement mechanism to fit.

Figure 26A:
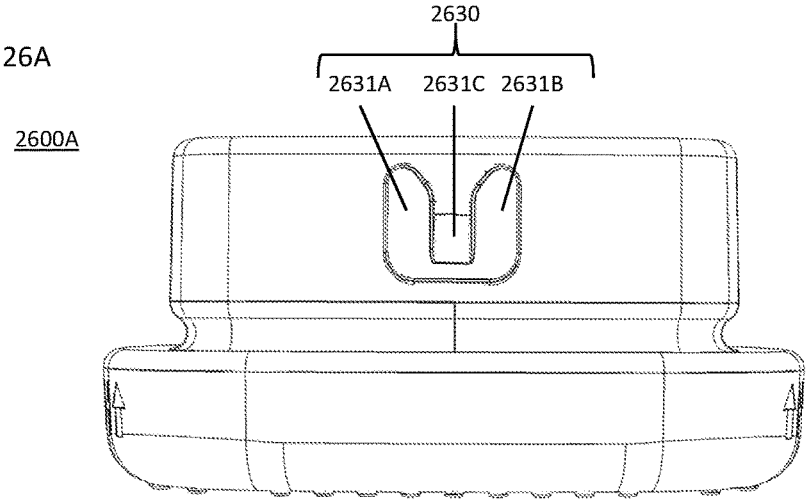
FIG. 26A illustrates a side view of an embodiment of a container base.

Base 2600A of FIG. 26A has cap engagement element 2630, having ramps 2631A and 2631B, which are connected by ridge 2631C. Ramps 2631A and 2631B and ridge 2631C form a "U" shape. Ramps 2631A and 2631B are substantially parallel to each other. Ramps 2631A and 2631B are substantially perpendicular to the base foot/support. Ramps 2631A and 2631B can have rounded corners, as illustrated in FIG. 26A.

The space between ramps 2631A and 2631B is sized and configured to allow for one tooth from a base engagement mechanism of a cap to fit. Ramps 2631A and 2631B also act as anti-rotation elements and can prevent rotation of the cap while on the base. A tooth from a base engagement mechanism cannot laterally move or slide over ramps 2631A and 2631B. Also, the non-circular shape of the container base and cap contributes to the prevention of rotation of the cap around the neck of the base.

Ridge 2631C acts as a ledge or ramp and is configured to allow for a second row of teeth from a base engagement element to slide over. When engaged, one or more teeth from a second row of teeth from a cap sits beneath or inferior to ridge 2631C. A lip on a bottom end of ridge 2631C can prevent the row of teeth and also the cap from upward movement.

Figure 26B:
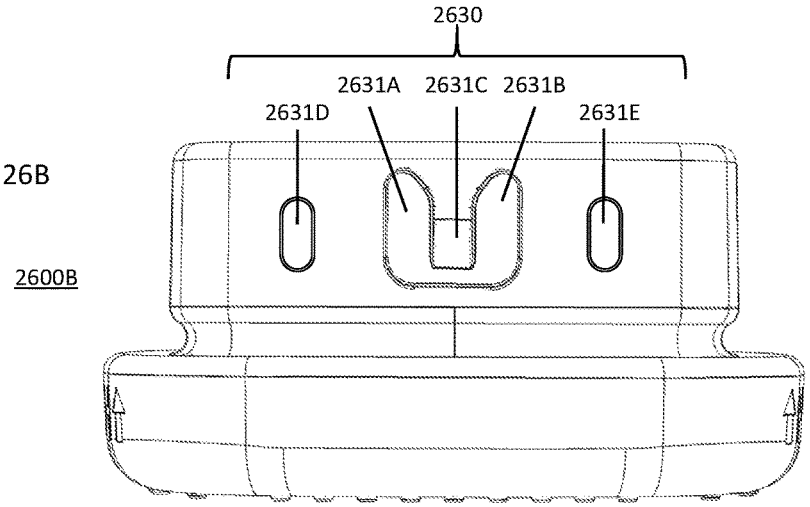
FIG. 26B illustrates a side view of an embodiment of a container base.
Figure 26C:
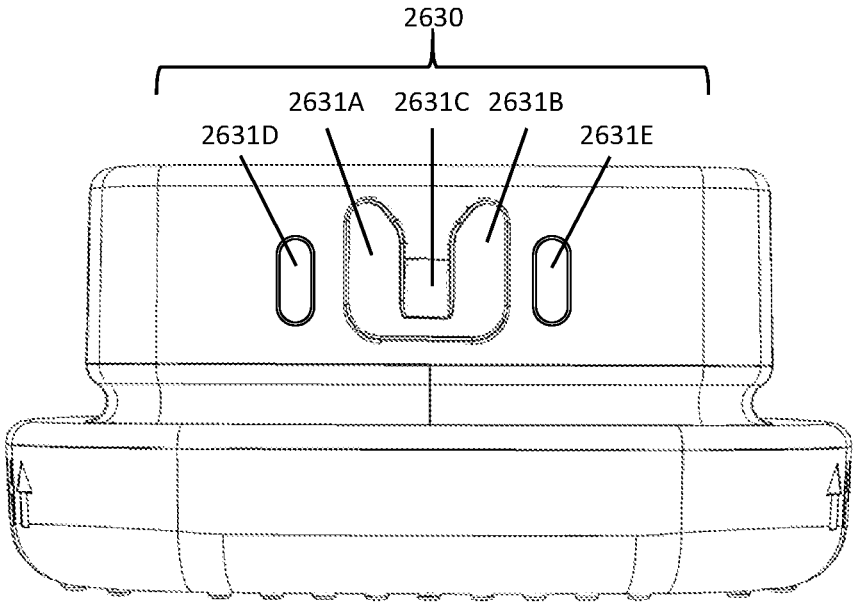
FIG. 26C illustrates a side view of an embodiment of a container base.
Figure 26D:
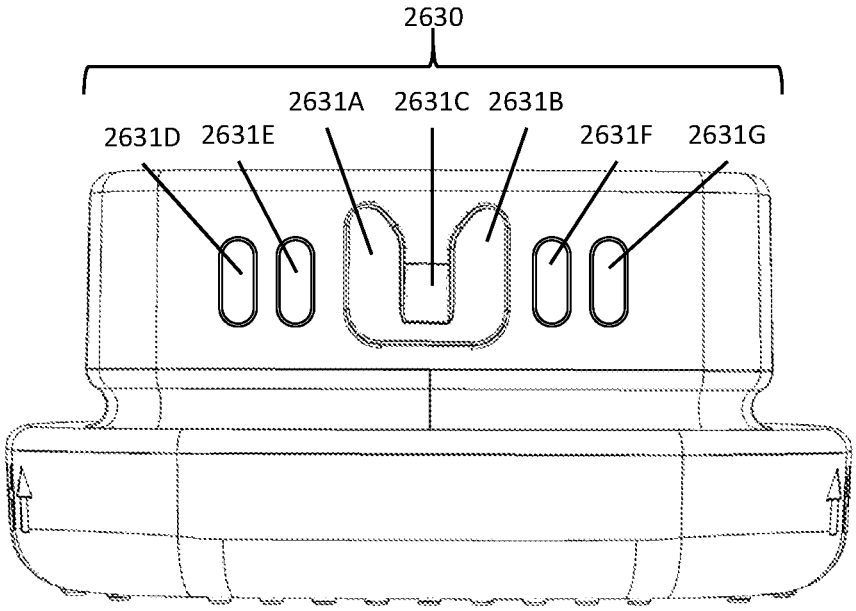
FIG. 26D illustrates a side view of an embodiment of a container base.
Figure 27A:
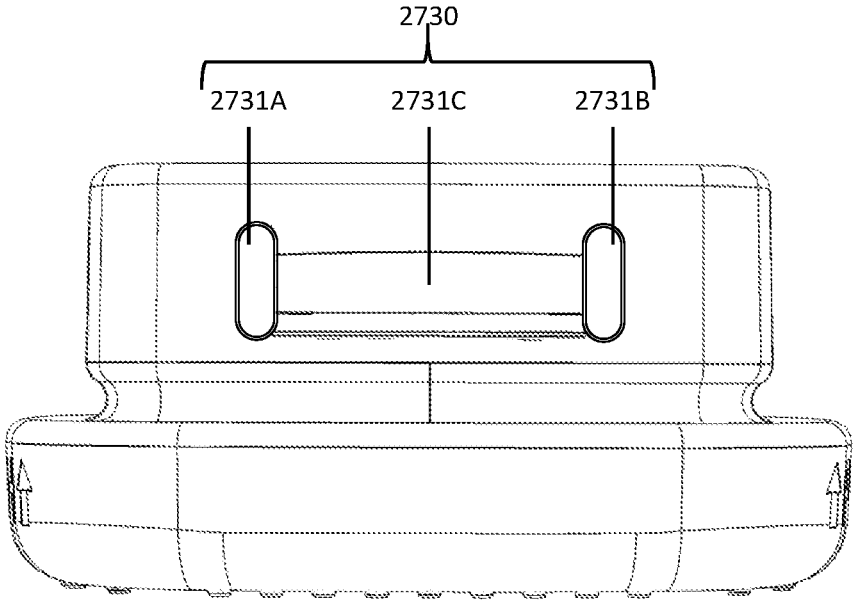
FIG. 27A illustrates a side view of an embodiment of a container base.
Figure 27B:
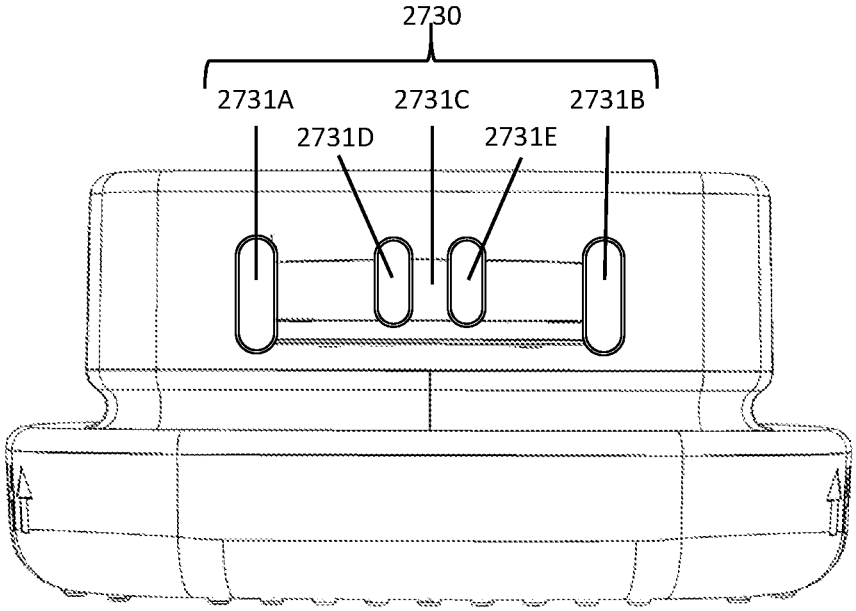
FIG. 27B illustrates a side view of an embodiment of a container base.
Figure 27C:
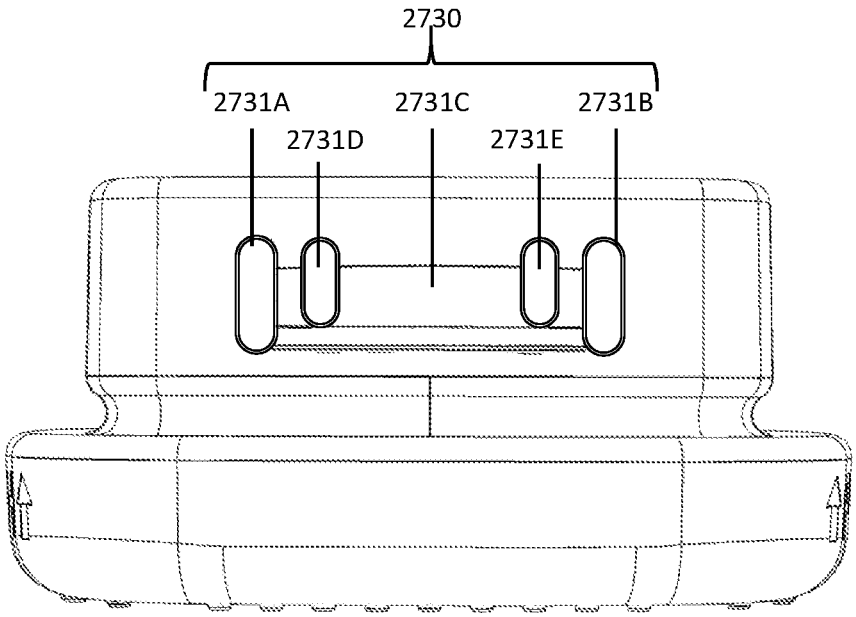
FIG. 27C illustrates a side view of an embodiment of a container base.
Figure 27D:
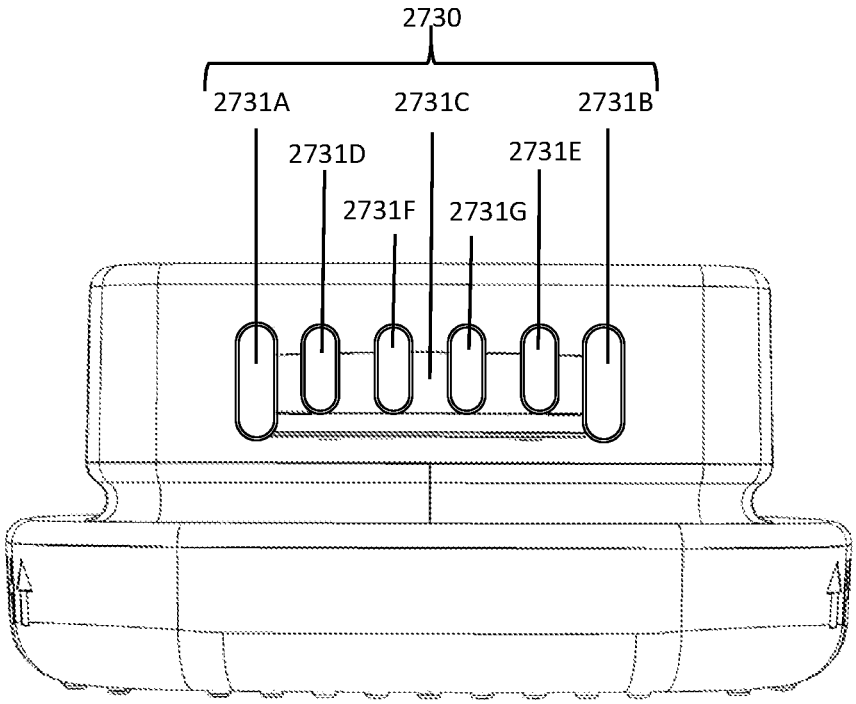
FIG. 27D illustrates a side view of an embodiment of a container base.
Figure 28A:
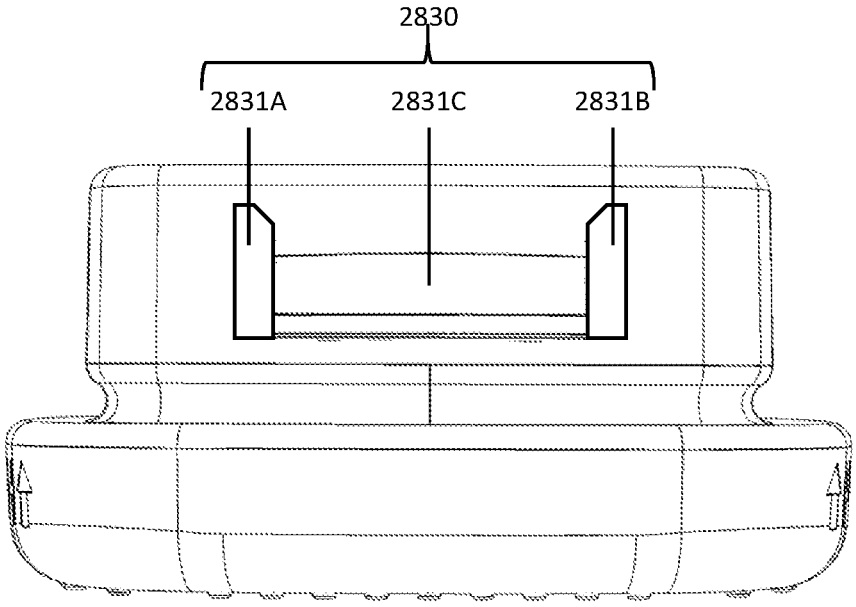
FIG. 28A illustrates a side view of an embodiment of a container base.
Figure 28B:
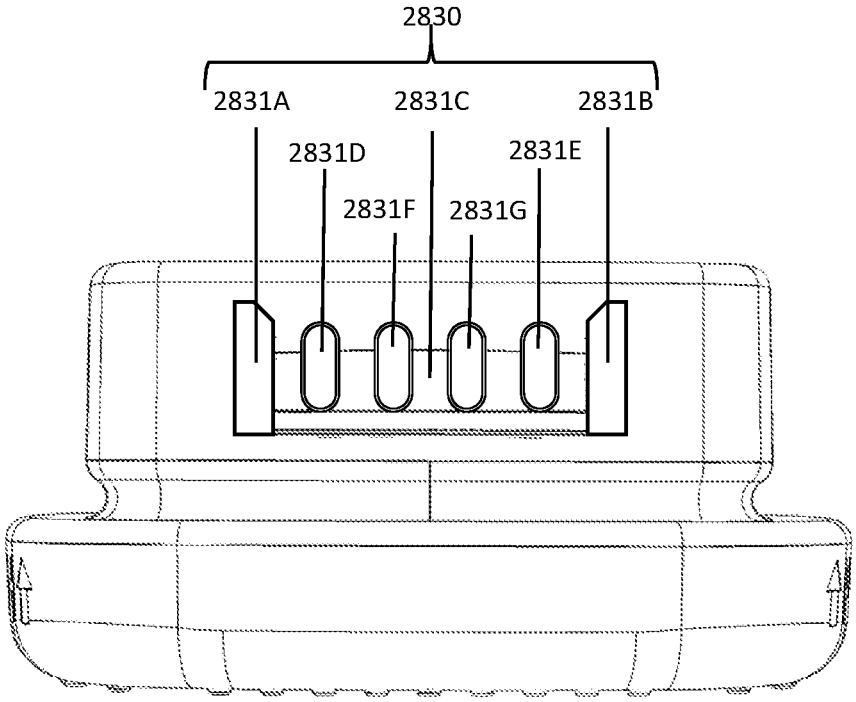
FIG. 28B illustrates a side view of an embodiment of a container base.
Figure 29A:
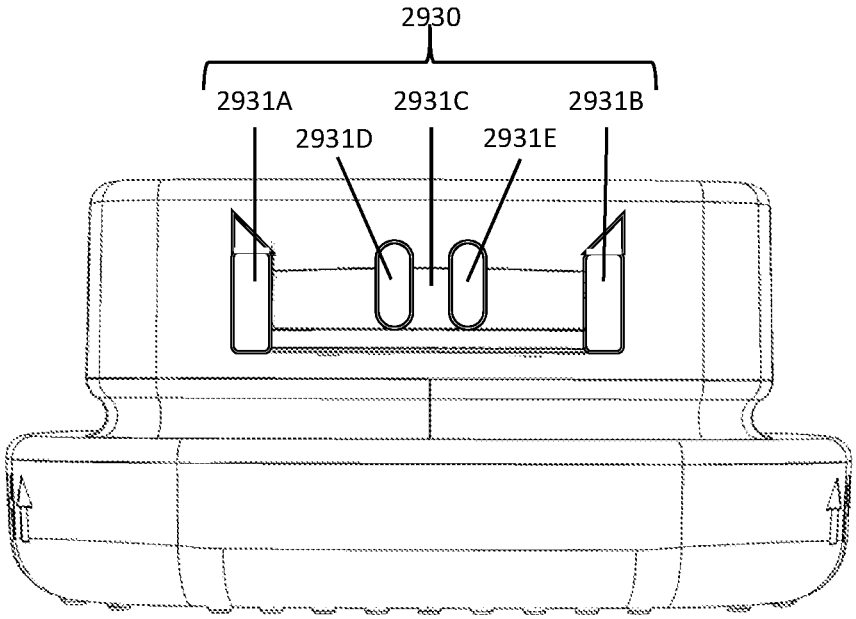
FIG. 29A illustrates a side view of an embodiment of a container base.
Figure 29B:
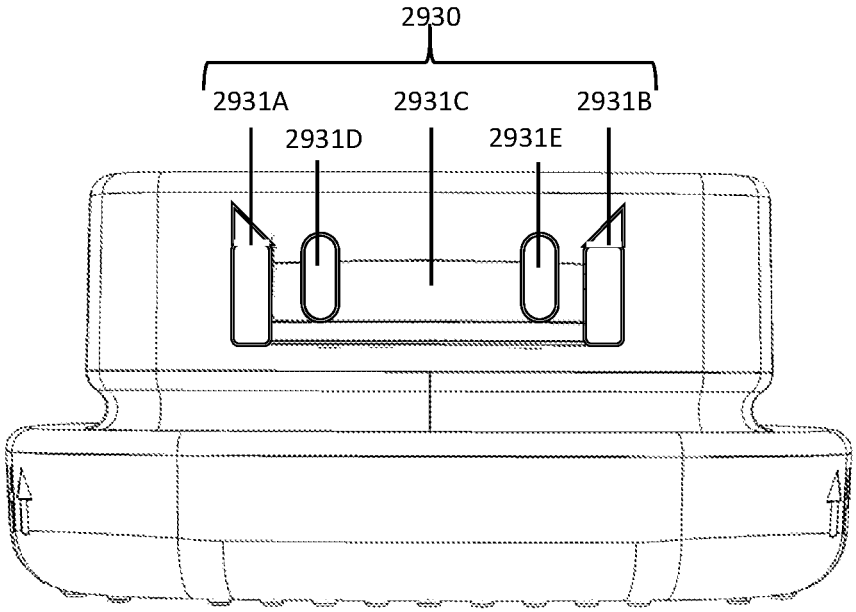
FIG. 29B illustrates a side view of an embodiment of a container base.
Figure 30A:
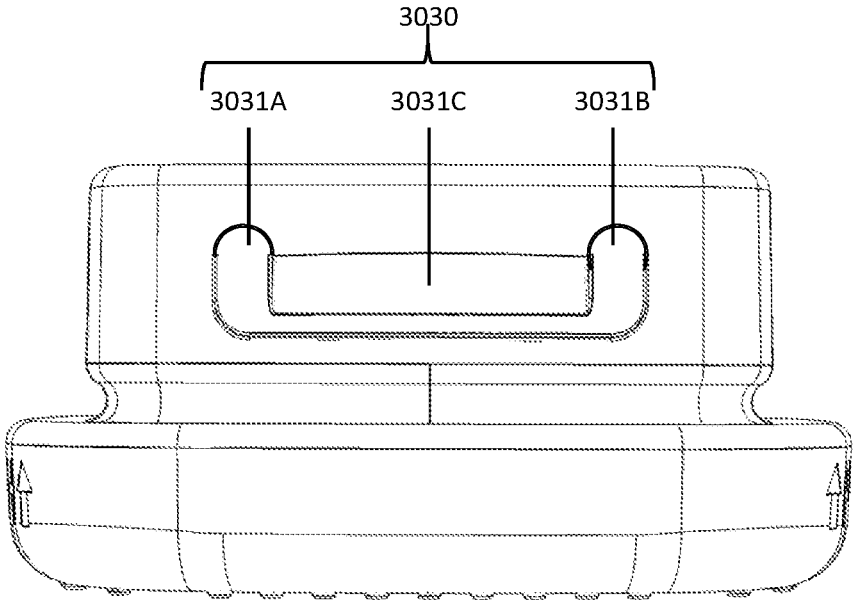
FIG. 30A illustrates a side view of an embodiment of a container base.
Figure 30B:
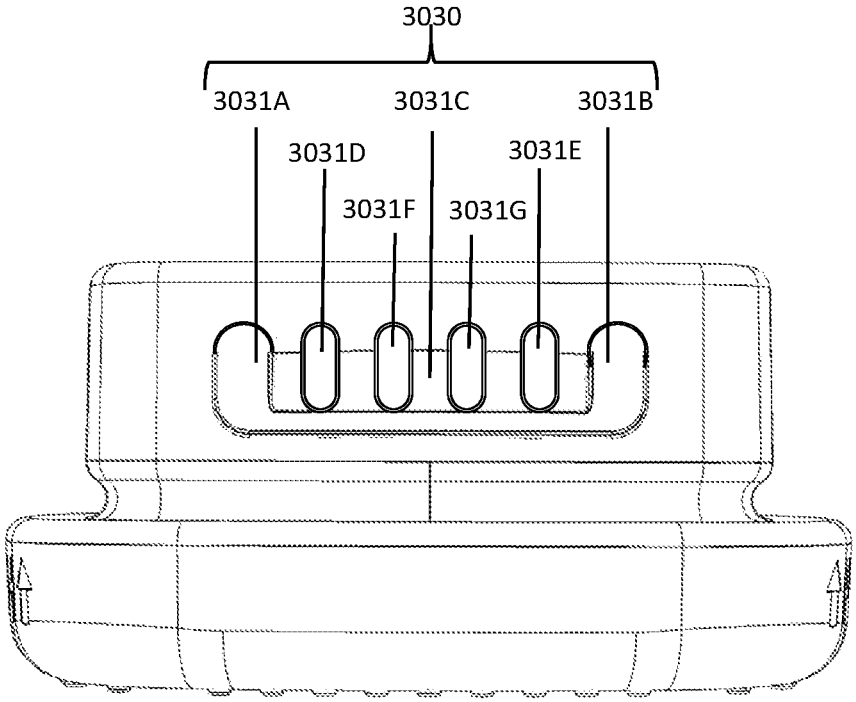
FIG. 30B illustrates a side view of an embodiment of a container base.
Figure 31A:
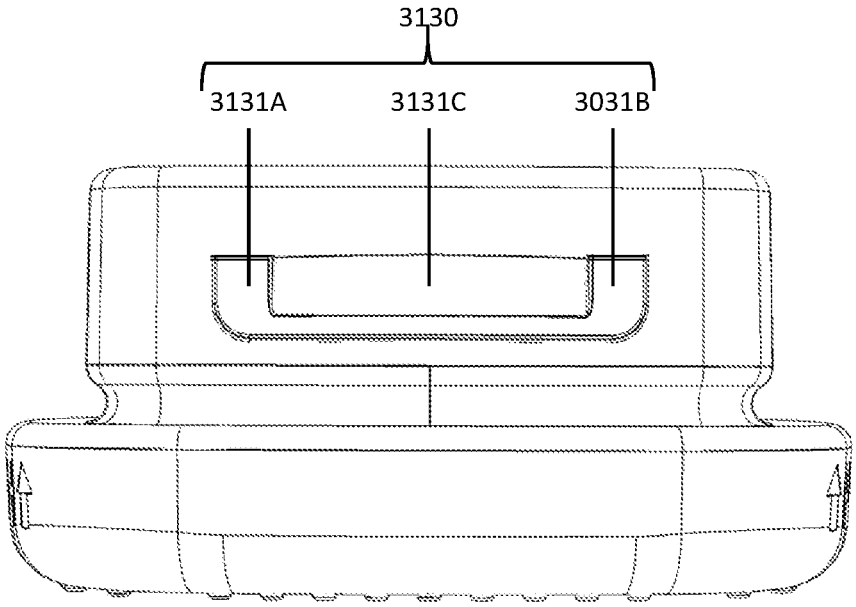
FIG. 31A illustrates a side view of an embodiment of a container base.
Figure 31B:
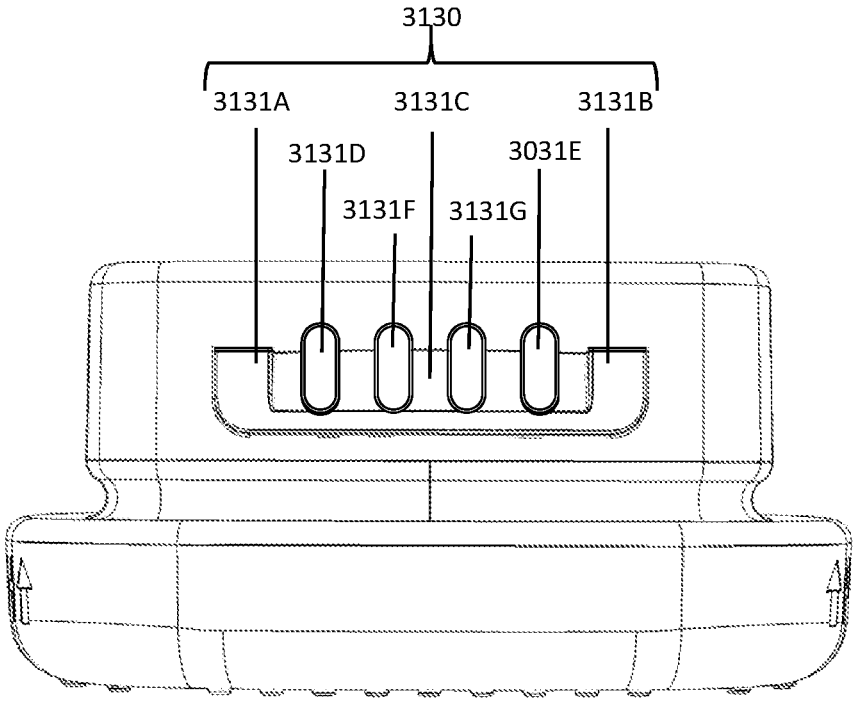
FIG. 31B illustrates a side view of an embodiment of a container base.

FIGS. 26B-26D illustrate additional ramps and their positions relative to ramps 2631A, 2631B and ridge 2631C. Two (2631D, 2631E) or four (2631D, 2631E, 2631F, 2631G) ramps are positioned next to the ramp/ridge (2631A, 2631B, 2631C) structure.

Base 2600B of FIG. 26B has two ramps 2631D, 2631E. The space between ramps 2631D and 2631A is sized and configured to allow for two teeth from a base engagement element to fit. Similarly, two teeth can fit in the space between ramps 2631B and 2631E.

The positioning of ramps 2631E and 2631E can be moved towards a center line or towards a center point of ledge 2631C. The space between ramps 2631D and 2631A and ramps 2631B and 2631E is sized and configured to fit a single tooth from a base engagement element. In such a configuration, there can be one or more teeth from a base engagement element that sits outside cap engagement mechanism 2630 of FIG. 26C. For base 2600C, one tooth sits to the left of ramp 2631D and one tooth sits to the right of ramp 2631E.

Additional ramps 2631F and 2531G are added to base 2600D in FIG. 26D. Here, all ramps 2631A, 2631B, 2631D, 2631E, 2631F and 2641G are sized and configured so that a single tooth fits in the space created by each adjacent pair of ramps (e.g., 2631D/2631E, 2631E/2631A, 2631A/2631B, 2631B/2631F, and 2631F/2631G).

FIGS. 26A-26D illustrate symmetrical configurations of cap engagement element 2630. Cap engagement element 2630 can be a mirror image along a vertical center line. It is also contemplated for asymmetrical configurations of the cap engagement element (e.g., FIG. 32F).

Referring to FIGS. 27A-31D, the size and shape of ramps can vary. For example, ramps 2731A and 2731B (FIGS. 27A-27D) can be substantially "pill" shaped, oval, or be a rounded rectangle. Ramps 2831A and 2831B (FIGS. 28A-28B) can be substantially rectangular with a notch on the top end of each ramp. The notch is angled towards a center portion of ledge 2831C. Ramps 2931A and 2931B (FIGS. 29A-29B) can be substantially rectangular with a triangular top end of each ramp. The triangular portion is angled towards a center portion of ledge 2931C. Ramps 3031A and 3031B are shorter and can have a rounded top (e.g., semicircle). Ramps 3131A and 3131B have a substantially flat top. Each of the bases illustrated in FIGS. 27A-31D can have one or more (e.g., 1, 2, 3, 4 or more) additional ramps (e.g., ramps 2731D, 2731E) positioned between ramps, for example, 2731A and 2731B.

FIGS. 32A-32F illustrate side views of a container base having various configurations of a cap engagement mechanism. Combinations of different sized and shaped ramps and a ridge are illustrated that provide and establish a child-resistant mechanism on the disclosed container bases.

Figure 32A:
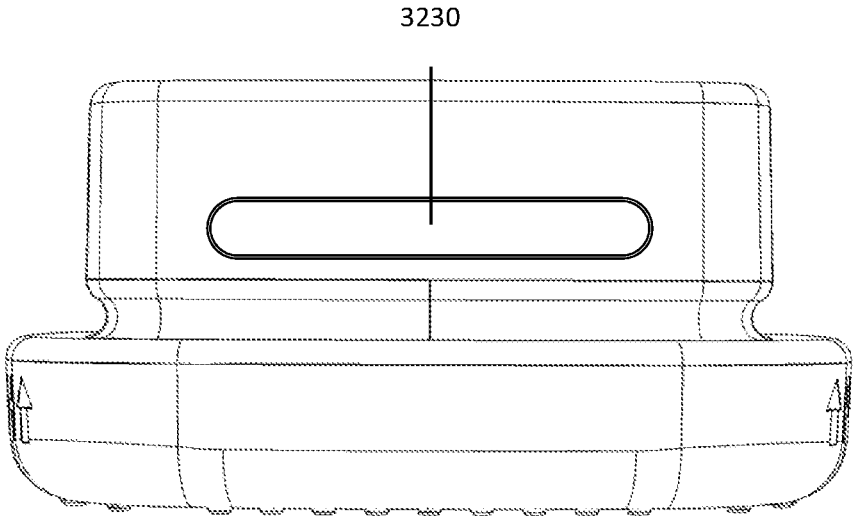
FIG. 32A illustrates a side view of an embodiment of a container base.

Base 3200A of FIG. 32A has cap engagement element 3230. Cap engagement element 3230 is horizontally positioned on a side of base 3200A. Cap engagement element 3230 acts as a ridge/ledge or ramp. Cap engagement element is sized and configured to allow for a row of teeth from a base engagement element to slide over. When engaged, the row of teeth from a cap sits beneath or inferior to ridge 3230. A lip on a bottom end of cap engagement element 3230 can prevent the row of teeth and the cap from upward movement off of the neck of base 3200A.

Figure 32B:
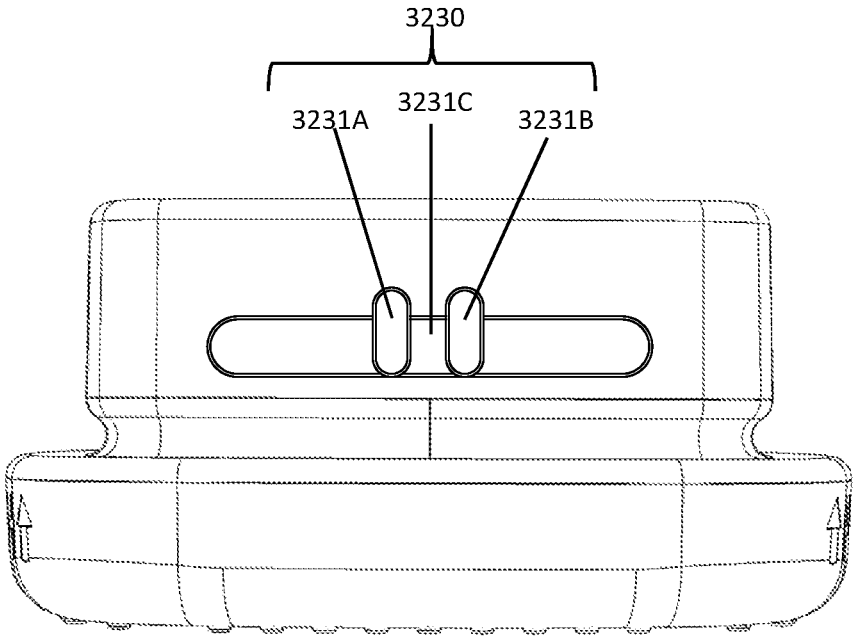
FIG. 32B illustrates a side view of an embodiment of a container base.
Figure 32C:
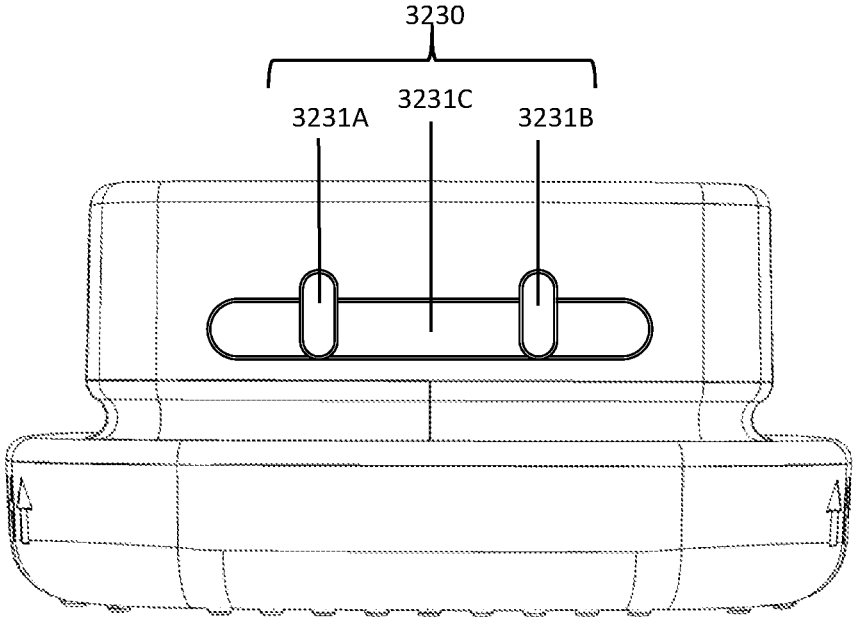
FIG. 32C illustrates a side view of an embodiment of a container base.
Figure 32D:
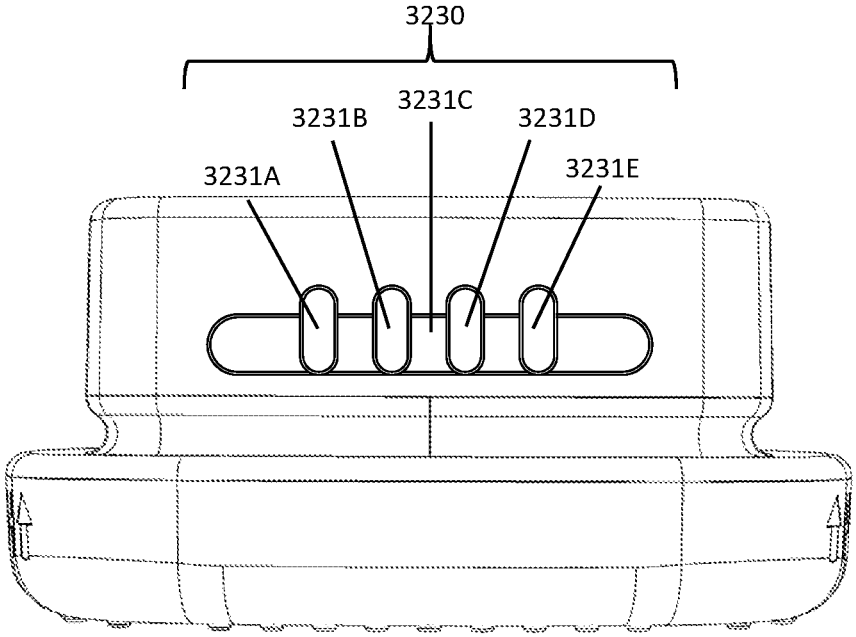
FIG. 32D illustrates a side view of an embodiment of a container base.
Figure 32E:
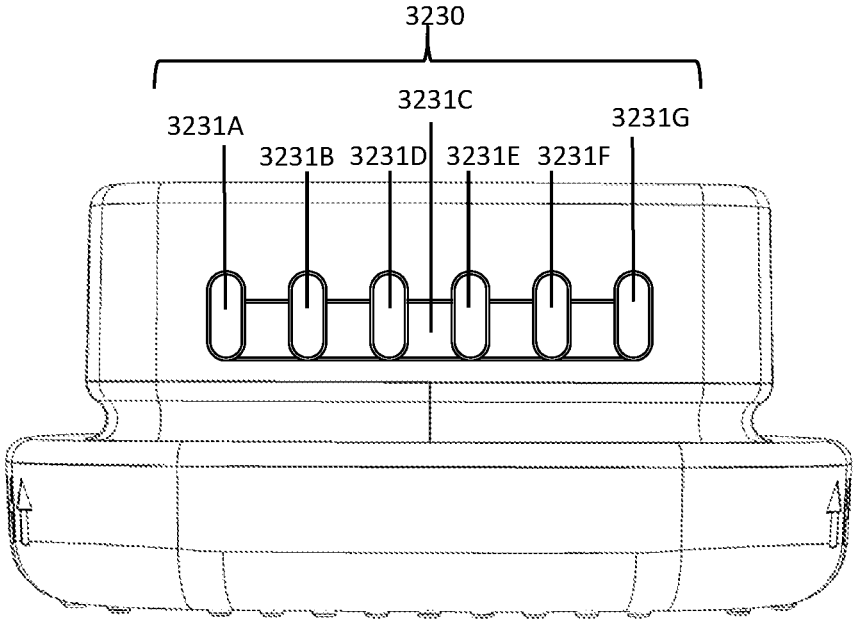
FIG. 32E illustrates a side view of an embodiment of a container base.
Figure 32F:
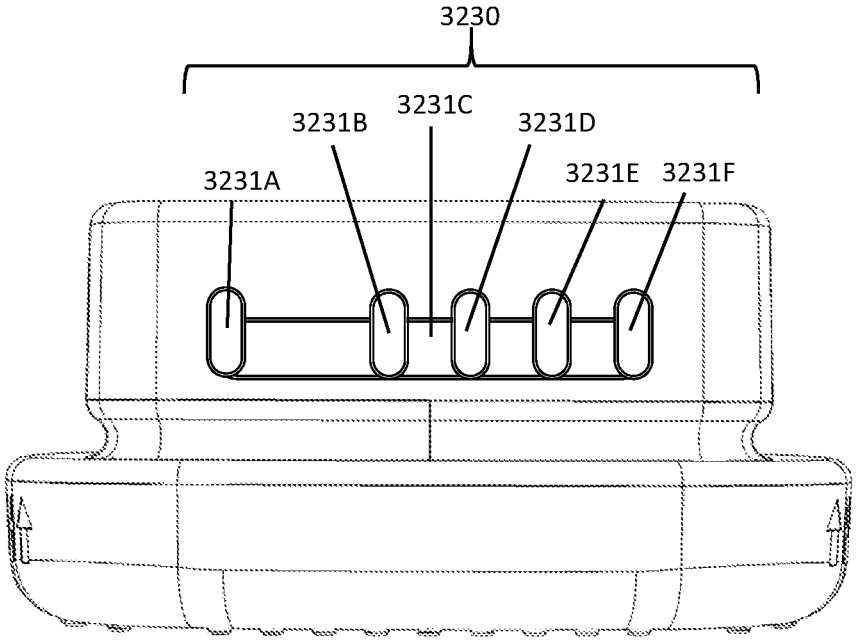
FIG. 32F illustrates a side view of an embodiment of a container base.

One or more ramps can be positioned along ridge 3231C, as illustrated in FIGS. 32B-32F. For example, ramps 3231A and 3231B can be positioned along ridge 3231C in multiple configurations, such as illustrated in FIGS. 32B and 32C. Additional ramps can be added and configured in other arrangements, such as those shown in FIGS. 32D-32F. FIGS. 32B-32E illustrate a symmetrical arrangement of ramps. That is, one, two or three ramps are found on both sides of center. However, asymmetrical arrangements are disclosed, for example, in FIG. 32F, where base 3200F has 2 ramps on the left side and 3 ramps on the right.

Figure 33A:
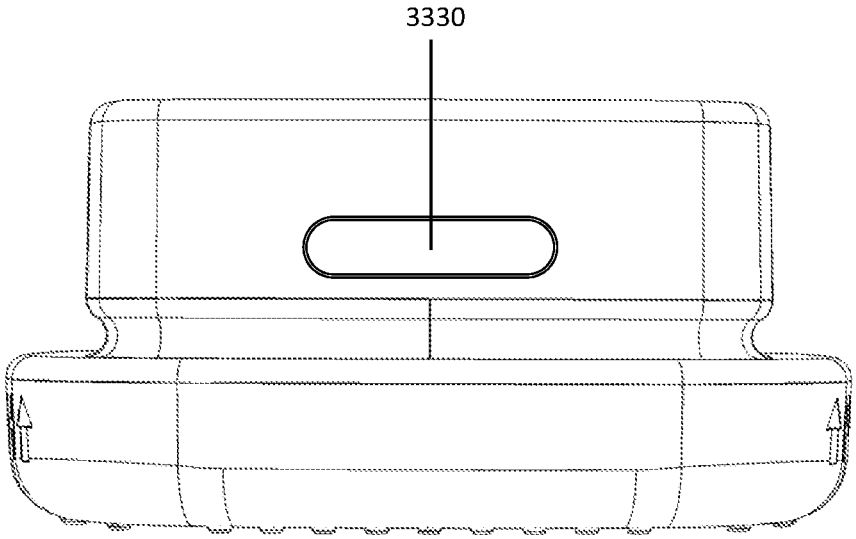
FIG. 33A illustrates a side view of an embodiment of a container base.

Base 3300A of FIG. 33A has cap engagement element 3330. Cap engagement element 3330 is horizontally positioned on a side of base 3300A. Cap engagement element 3330 acts as a ridge/ledge or ramp. Cap engagement element is sized and configured to allow for part or a complete row of teeth from a base engagement element to slide over. When engaged, the row of teeth from a cap sits beneath or inferior to ridge 3330. A lip on a bottom end of cap engagement element 3330 can prevent the row of teeth and the cap from upward movement off of the neck of base 3300A.

Figure 33B:
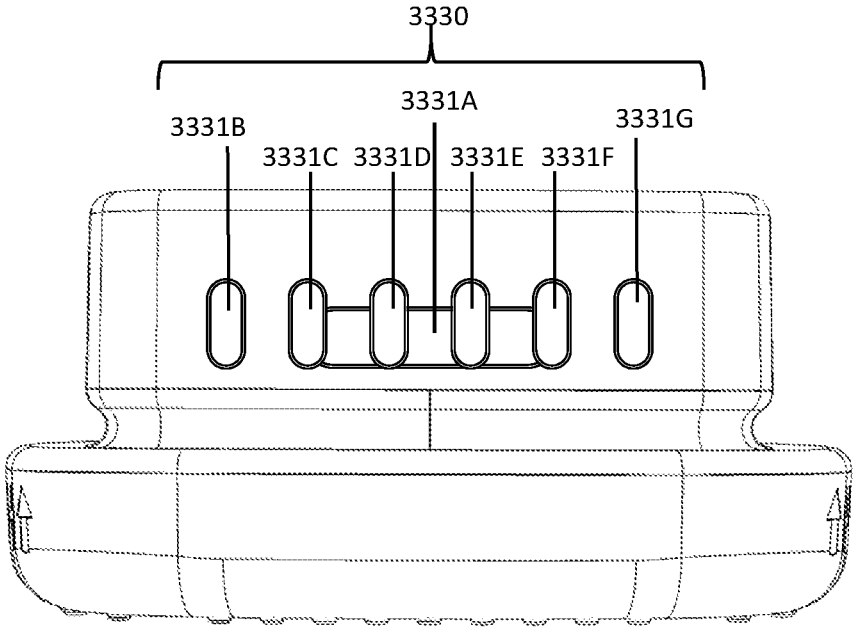
FIG. 33B illustrates a side view of an embodiment of a container base.

One or more ramps can be positioned along ridge 3331A, as illustrated in FIG. 33B. For example, ramps 3331B and 3331G can be positioned off of or lateral to ridge 3331A. Additional ramps 3331C, 3331D, 3331E, and 3331F can be added on top of or along ridge 3331A. Other arrangements of ramps are possible. The space created between any adjacent ridges is sized and configured so that a tooth from a row of teeth can fit.

Figure 34A:
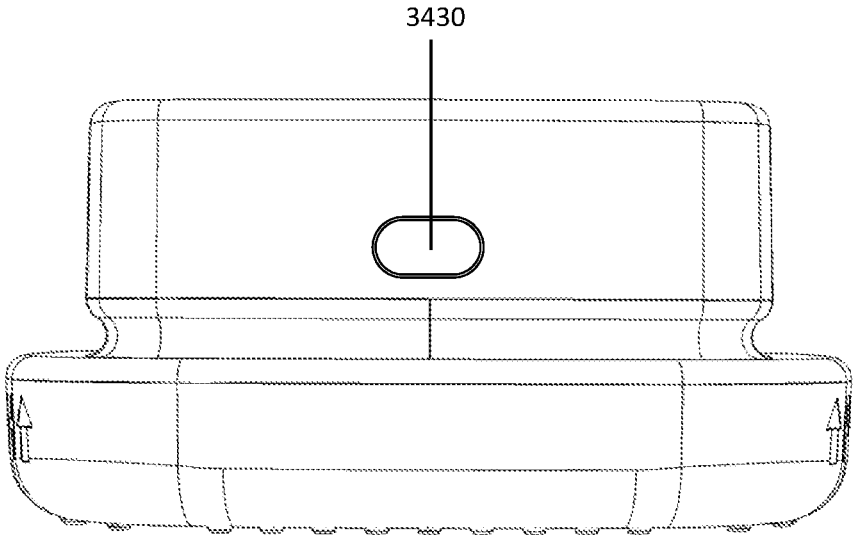
FIG. 34A illustrates a side view of an embodiment of a container base.

Base 3400A of FIG. 34A has cap engagement element 3430. Cap engagement element 3430 is horizontally positioned on a side of base 3400A. Cap engagement element 3430 acts as a ridge/ledge or ramp. Cap engagement element is sized and configured to allow for part or a complete row of teeth from a base engagement element to slide over. When engaged, the row of teeth from a cap sits beneath or inferior to ridge 3430. A lip on a bottom end of cap engagement element 3430 can prevent the row of teeth and the cap from upward movement off of the neck of base 3400A.

Figure 34B:
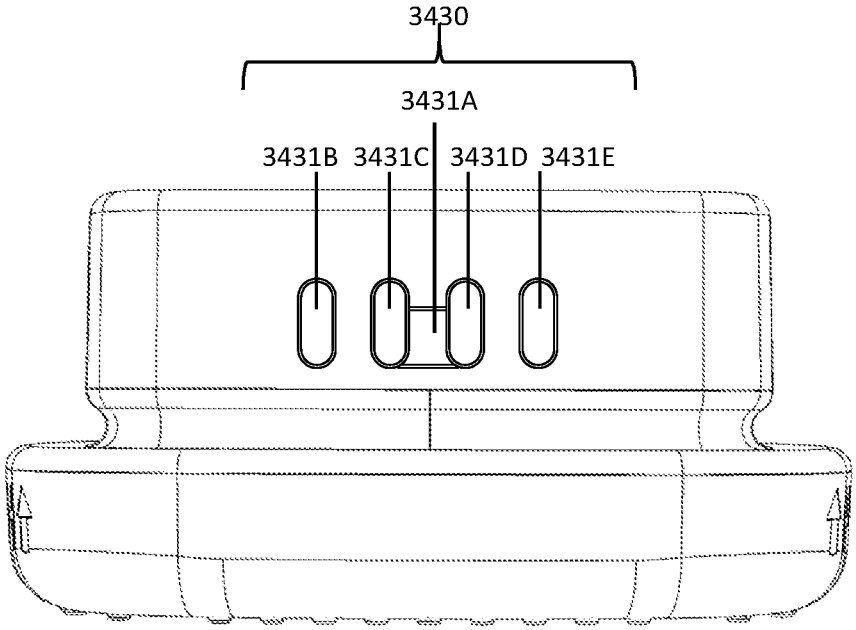
FIG. 34B illustrates a side view of an embodiment of a container base.

One or more ramps can be positioned along ridge 3431A, as illustrated in FIG. 34B. For example, ramps 3431B and 3231E can be positioned off of or lateral to ridge 3431A. Additional ramps 3431C and 3431D can be added on top of or along ridge 3431A. Other arrangements of ramps are possible. The space created between any adjacent ridges is sized and configured so that a tooth from a row of teeth can fit.

Other mechanisms can provide child-resistance on the containers described herein. FIGS. 35-39 illustrate other mechanisms that can be employed on these containers. For example, a single cap engagement mechanism is positioned on a side of a base. The cap engagement mechanism can be a male-type or female-type connector, with the counterpart female or male connector on the cap. Various shapes, sizes, and number of mechanisms can be used, as illustrated in FIGS. 35-39. For example, a single circular mechanism 3530 is position on a side of base 3500A in FIG. 35A. More than one circular mechanism can be used, such as mechanisms 3530A, 3530B, and 3530C.

Figure 35A:
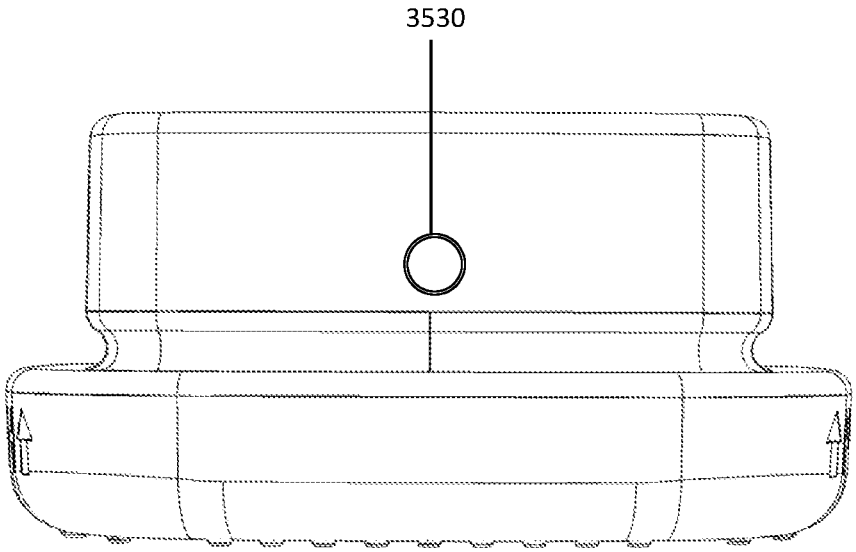
FIG. 35A illustrates a side view of an embodiment of a container base.
Figure 35B:
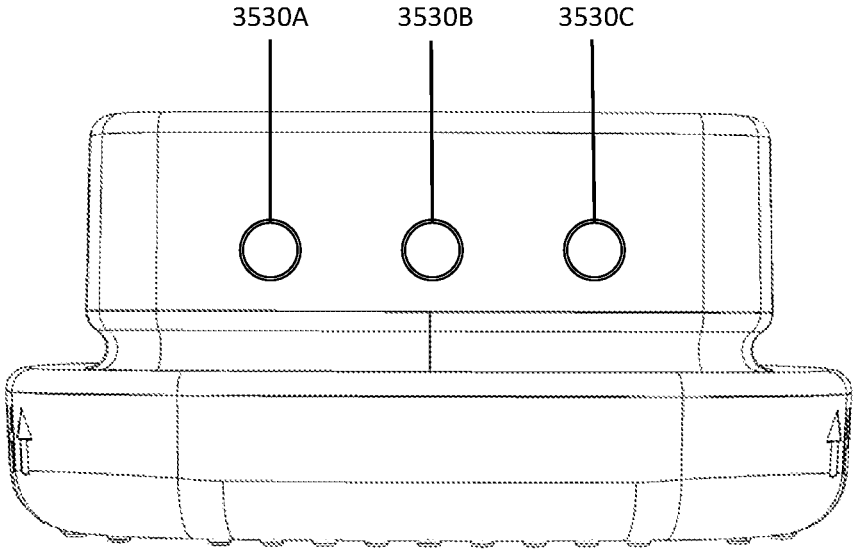
FIG. 35B illustrates a side view of an embodiment of a container base.
Figure 35C:
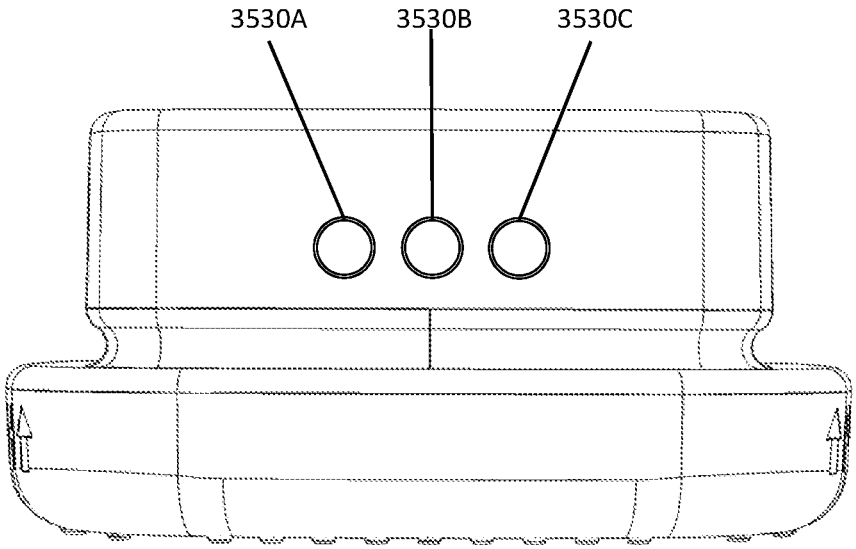
FIG. 35C illustrates a side view of an embodiment of a container base.
Figure 35D:
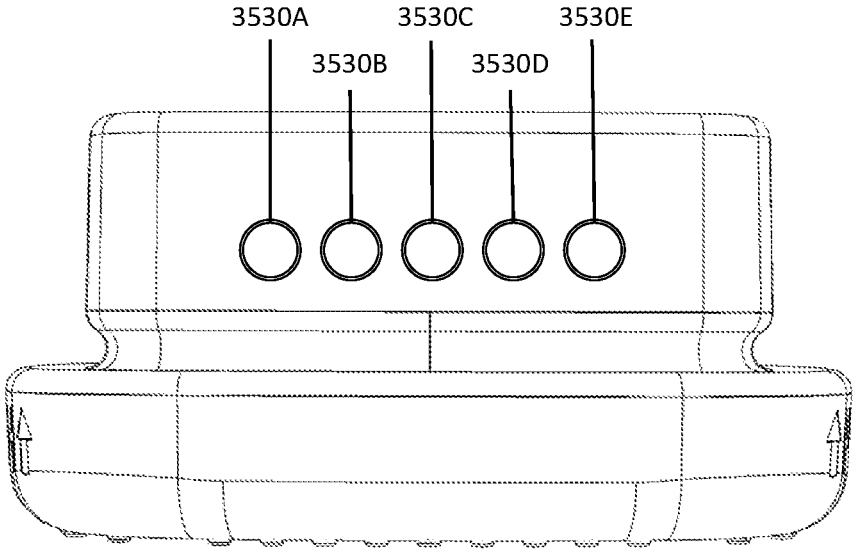
FIG. 35D illustrates a side view of an embodiment of a container base.
Figure 35E:
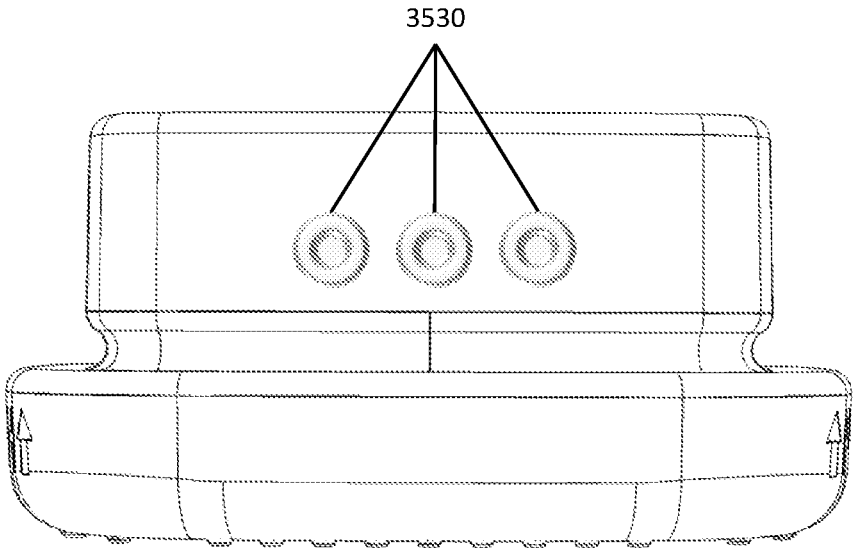
FIG. 35E illustrates a side view of an embodiment of a container base.
Figure 35F:
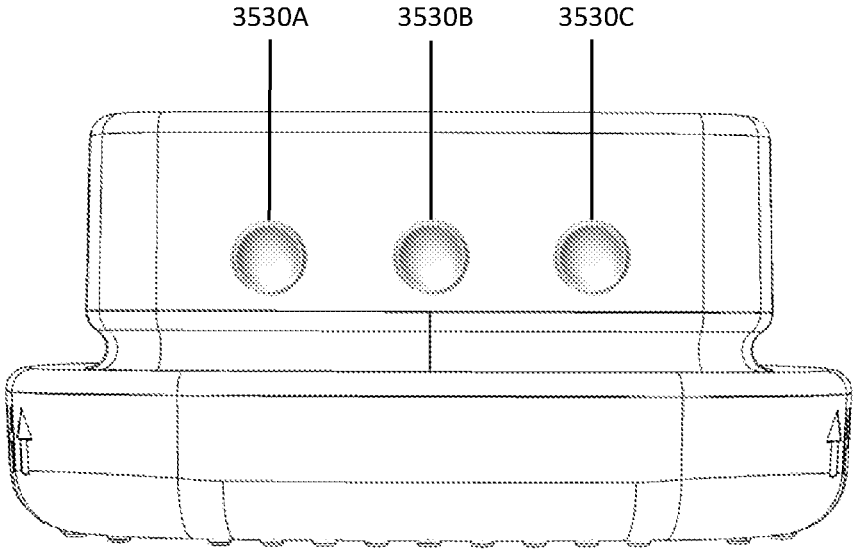
FIG. 35F illustrates a side view of an embodiment of a container base.
Figure 35G:
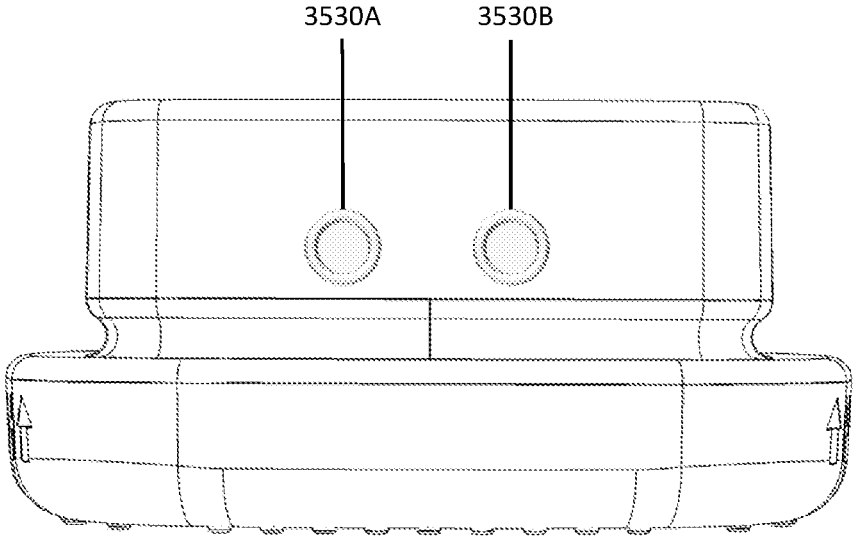
FIG. 35G illustrates a side view of an embodiment of a container base.
Figure 35H:
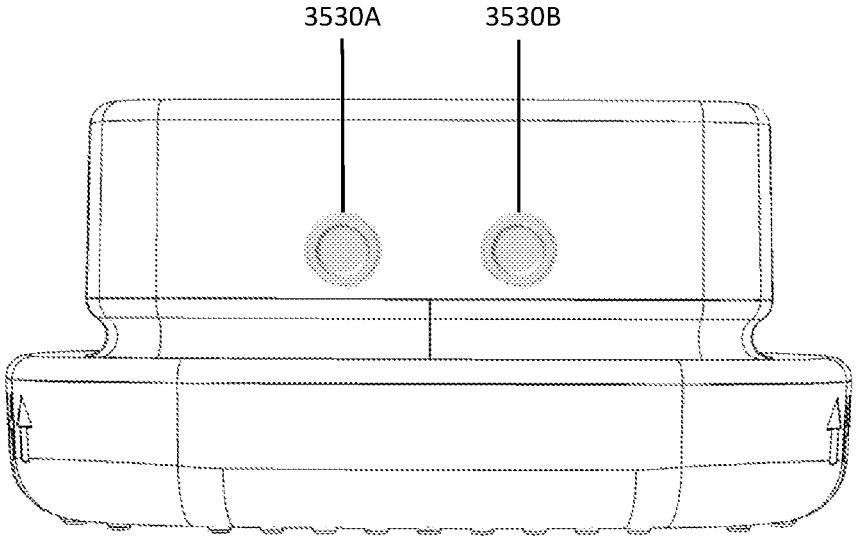
FIG. 35H illustrates a side view of an embodiment of a container base.
Figure 36A:
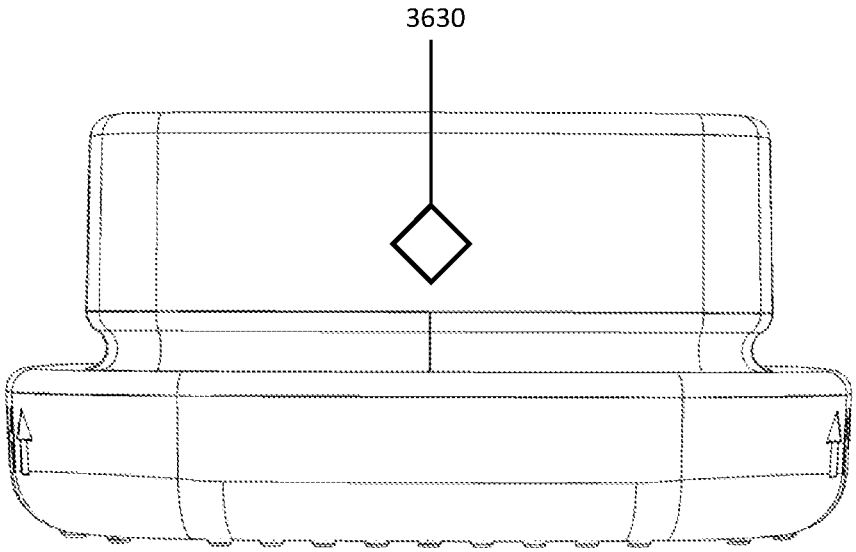
FIG. 36A illustrates a side view of an embodiment of a container base.
Figure 36B:
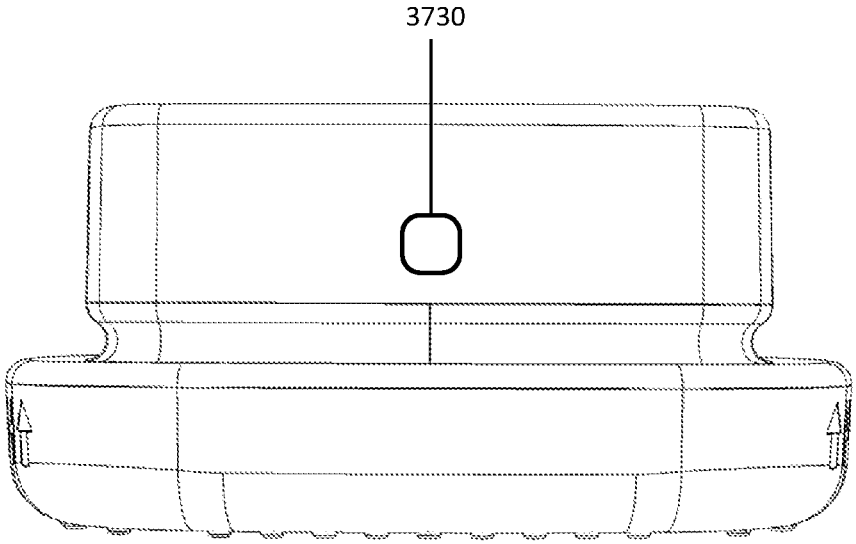
FIG. 36B illustrates a side view of an embodiment of a container base.
Figure 37A:
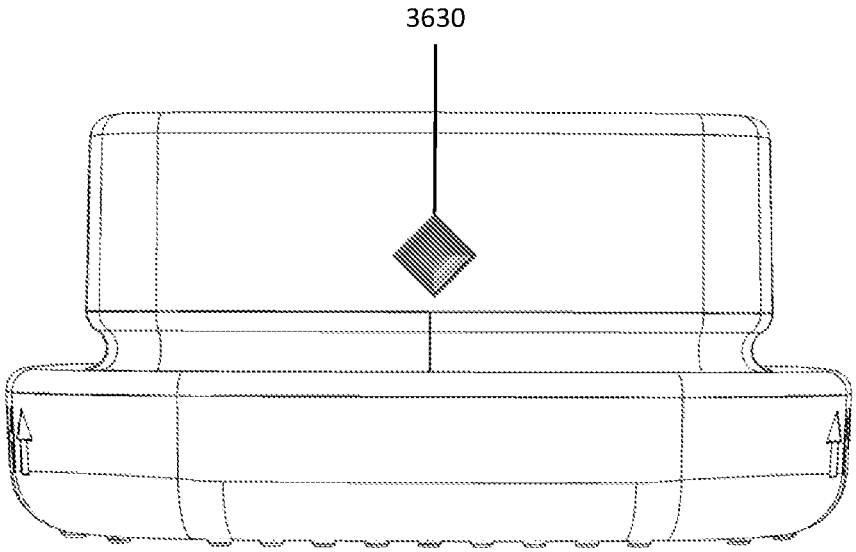
FIG. 37A illustrates a side view of an embodiment of a container base.
Figure 37B:
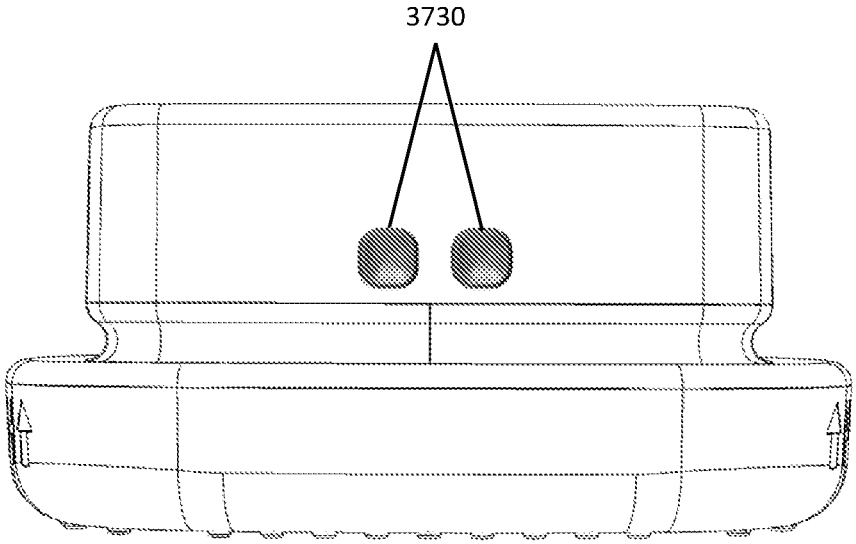
FIG. 37B illustrates a side view of an embodiment of a container base.
Figure 38:
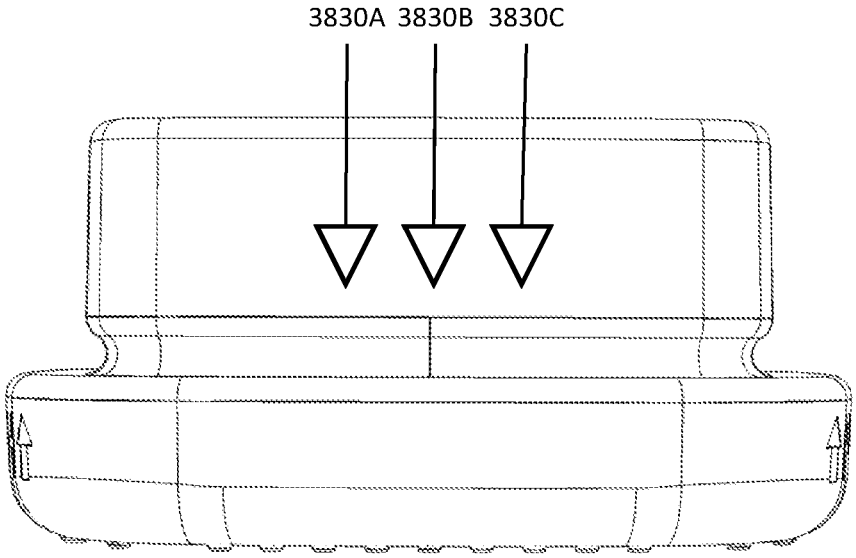
FIG. 38 illustrates a side view of an embodiment of a container base.

Circular mechanism 3530 can be outwardly shaped (i.e. a male connector) or inwardly shaped (i.e., a female connector). Combinations of male and female-type connectors can be used on a container base. For example, connector 3530A and 3530C can be a male-type connector and connector 3530B can be a female connector. FIGS. 35C and 35D illustrate various numbers and patterns of connectors 3530. For a male-type and female-type arrangement, compression of opposite sides of the container cap can unlock these mechanisms on one or more other sides of the base.

Ridge 3530 can also be sized and configured to function so that teeth from a row of teeth slides around element 3530. For a cap to be disengaged from ridge 3530 on base 3500A, a user pushes the cap forward (e.g., either to the left or to the right) to slide one or more teeth away from ridge 3530. Similarly, more than one ridge can be positioned on the container base, as illustrated in FIGS. 35B, 35C, and 35D. Each of ridges 3530A, 3530B and 3530C are sized and configured so that teeth from a row of teeth slide around the ridges. For a cap to be disengaged from base 3500B, a user pushes the cap in a direction away from ridges (e.g., either to the left or to the right) to move one or more teeth away from the ridges. Similarly, the number and spacing of ridges 3530 (e.g., in FIGS. 35C and 35D) can vary and be configured to a specified base engagement element on a container cap.

Figure 39:
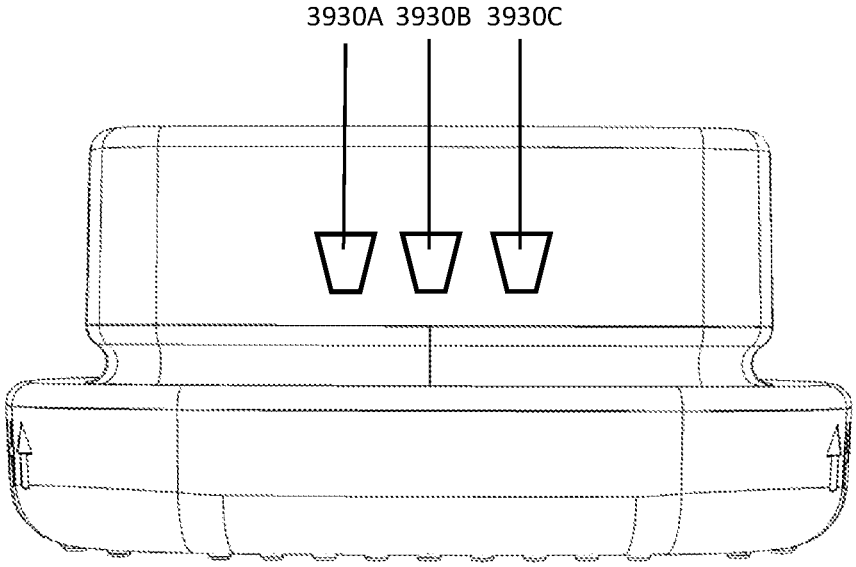
FIG. 39 illustrates a side view of an embodiment of a container base.

Additionally, the shape of ridge can vary, such as having a circular shape (ridge 3530 illustrated in FIGS. 35A-H), a diamond shape (ridge 3630 illustrated in FIGS. 36A and 37A), a square shape with rounded corners (ridge 3730 illustrated in FIGS. 36B and 37B), a triangular shape (ridge 3830A illustrated in FIG. 38), or a polygonal or trapezoidal shape (ridge 3930A illustrated in FIG. 39). A user must push a side of the cap in a direction away from the one or more ridges in order to lift the cap off the base. Besides pushing in a direction away from the ridges (e.g., substantially to the left or substantially to the right), a cap can be pushed at an angle down and away from the one or more ridges to decouple the cap from the base. These illustrate some of the ways a container cap can mate with a base, providing child-resistance by requiring one or steps to remove the cap from the base.

Referring to FIGS. 40A-40D, cap engagement element 4030 is substantially the same as the cap engagement elements 2430 illustrated in FIGS. 24A-24D, but are rotated 180 degrees (i.e., flipped on a horizontal axis).

Figure 40A:
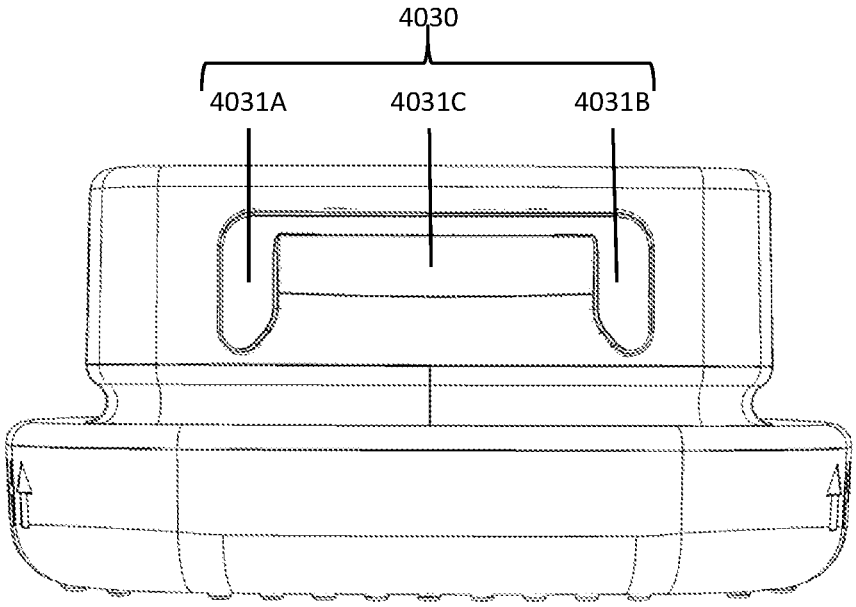
FIG. 40A illustrates a side view of an embodiment of a container base.

Base 4000A of FIG. 40A has cap engagement mechanism 4030 on a side of the neck of the base. Cap engagement mechanism 4030 has ramps 4031A and 4031B, connected by ridge 4031C. Ramps 4031A and 4031B and ridge 4031C are in an upside down "U" shape. Ramps 4031A and 4031B are substantially parallel to each other. Ramps 4031A and 4031B are substantially perpendicular to the base foot/support. Ramps 4031A and 4031B can have rounded corners, as illustrated in FIG. 40A.

The space between ramps 4031A and 4031B is sized and configured to allow for a row of teeth from a base engagement mechanism of a cap to fit. Ramps 4031A and 4031B also act as anti-rotation elements and can prevent rotation of the cap while on the base. Teeth from a base engagement mechanism cannot laterally move or slide over ramps 4031A and 4031B. Also, the non-circular shape of the container base and cap contributes to the prevention of rotation of the cap around the neck of the base.

Ridge 4031C acts as a ledge or ramp and is configured to allow for a second row of teeth from a base engagement element to slide over. When engaged, the second row of teeth from a cap sits beneath or inferior to ridge 4031C. A lip on a bottom end of ridge 4031C can prevent the row of teeth and also the cap from upward movement.

Figure 40B:
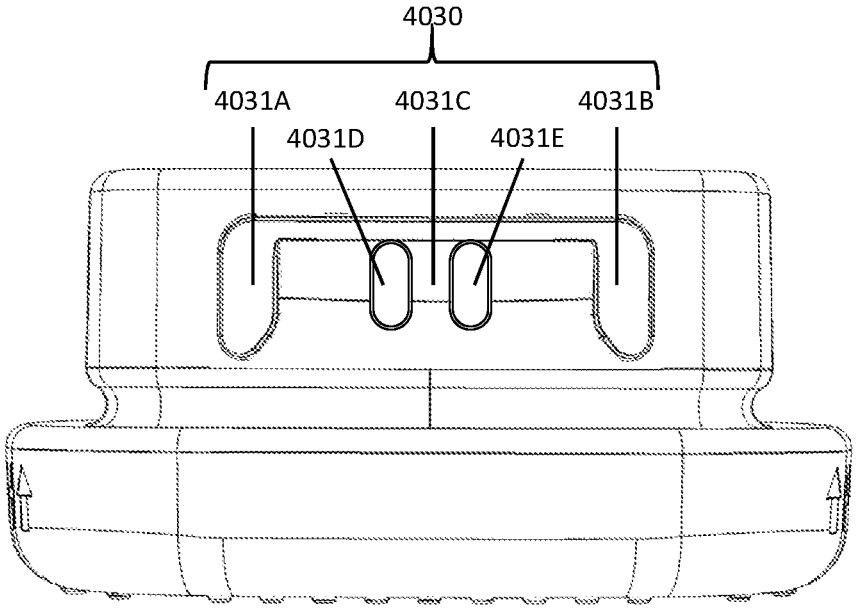
FIG. 40B illustrates a side view of an embodiment of a container base.
Figure 40C:
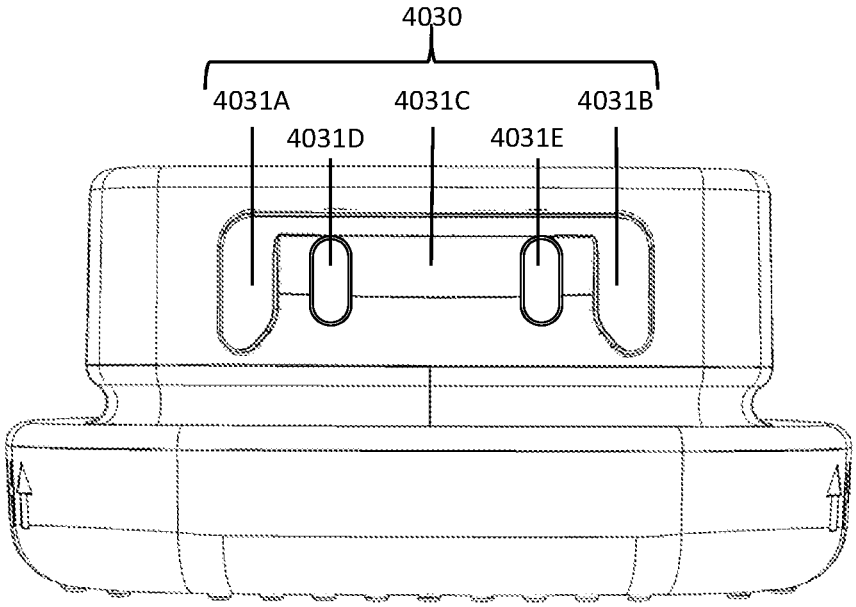
FIG. 40C illustrates a side view of an embodiment of a container base.

Base 4000B of FIG. 40B has cap engagement mechanism 4030. Similar to base 4000A of FIG. 40A, cap engagement mechanism 4030 has ramps 4031A and 4031B and ridge 4031C connecting the ramps in a "U" shaped formation. Additional ramps 4031D and 4031E are disposed between ramps 4031A and 4031B. Ramps 4031D and 4031E are sized and configured to allow one or more teeth from a base engagement mechanism from a cap to fit. The space between 4031D and 4031E is sized and configured to allow for one tooth from a base engagement mechanism to fit. The space between 4031A and 4031D is sized and configured to allow for two teeth from a base engagement mechanism to fit. Similarly, the space between 4031B and 4031E is sized and configured to allow for two teeth from a base engagement mechanism to fit.

Base 4000C of FIG. 40B has cap engagement mechanism 4030, with ramps 4031D and 4031E sized and configured to allow one or more teeth from a base engagement mechanism from a cap to fit next to. The space between 4031D and 4031E is sized and configured to allow for three teeth from a base engagement mechanism to fit. The space between 4031A and 4031D is sized and configured to allow for one tooth from a base engagement mechanism to fit. Similarly, the space between 4031B and 4031E is sized and configured to allow for one tooth from a base engagement mechanism to fit.

Figure 40D:
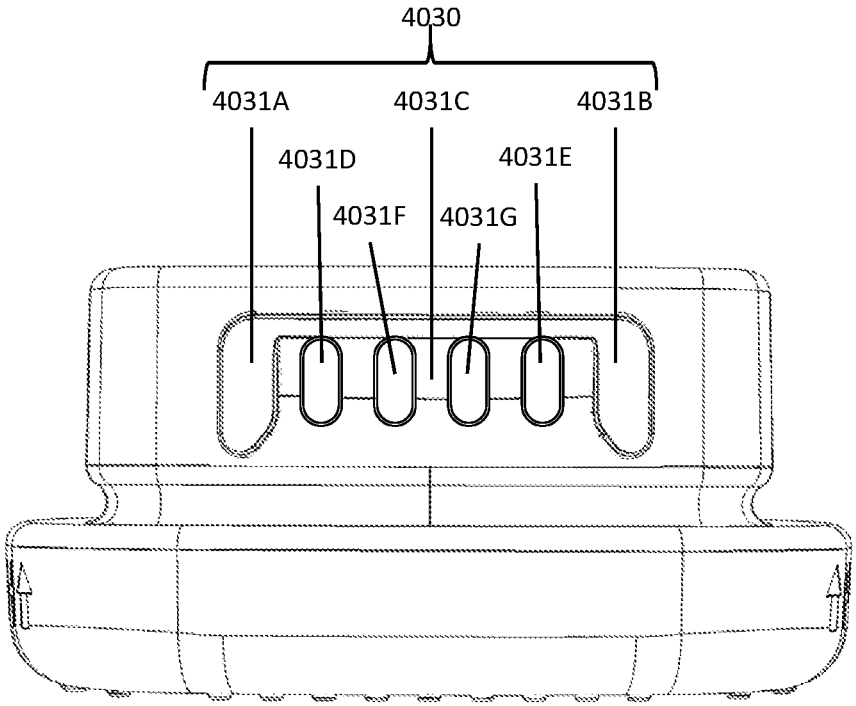
FIG. 40D illustrates a side view of an embodiment of a container base.

In FIG. 40D, base 4000D has six ramps, 4031A, 4031B, 4031D, 4031E, 4031F and 4031G. The space between each of the ramps (e.g., between 4031A and 4031D) is sized and configured to allow for one tooth from a base engagement mechanism to fit.

The number of ramps, the size of the ramps, the spacing between the ramps, the size of the ridge, and other variables can all be adjusted according to the base engagement mechanism, such as the size of the teeth, the number of teeth, the spacing between the teeth.

Figure 41:
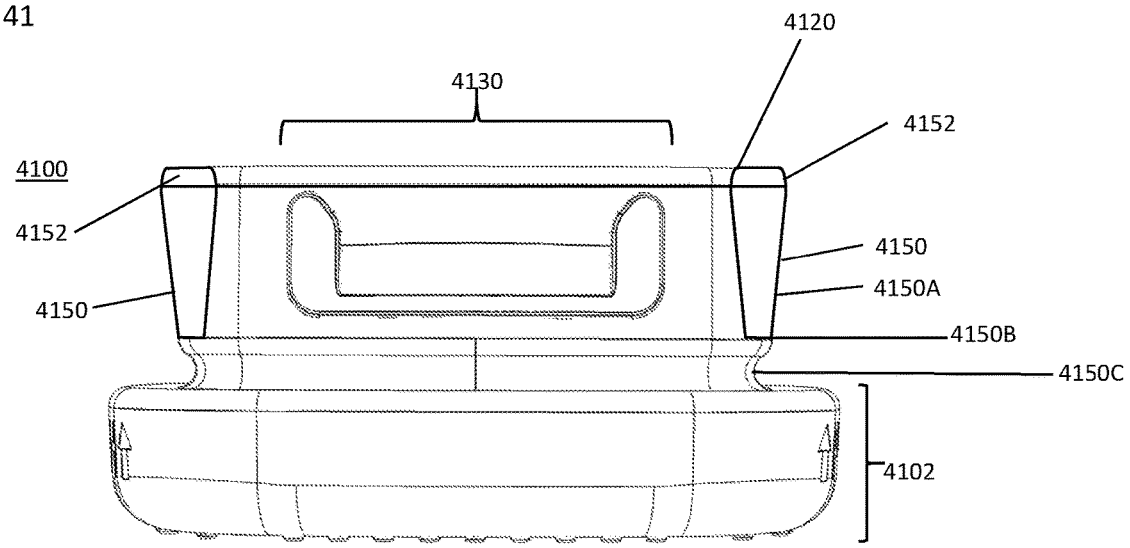
FIG. 41 illustrates a side view of an embodiment of a container base.
Figure 42:
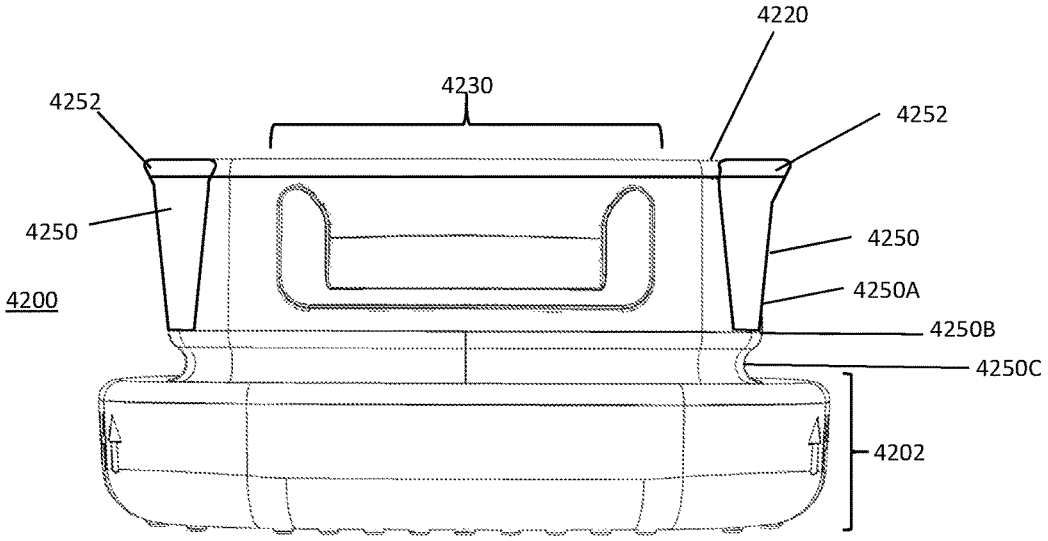
FIG. 42 illustrates a side view of an embodiment of a container base.
Figure 43A:
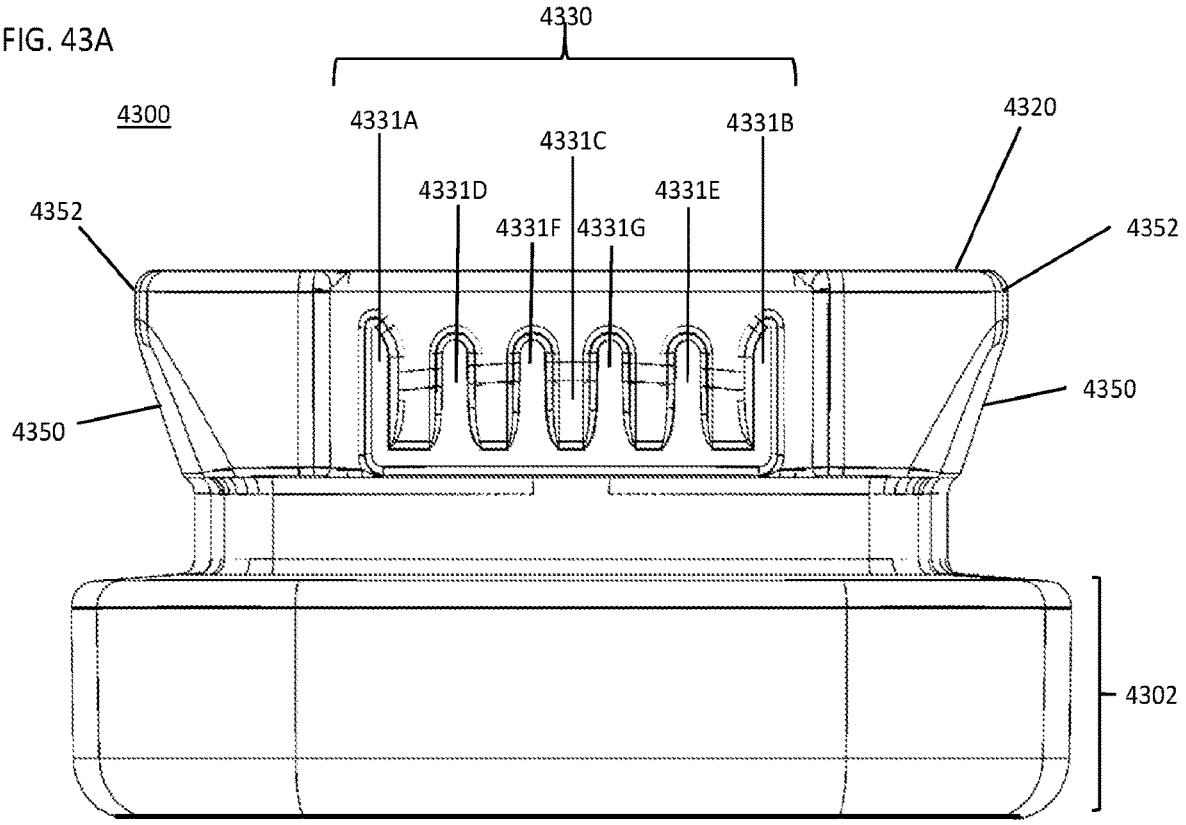
FIG. 43A illustrates a side view of an embodiment of a container base.
Figure 43B:
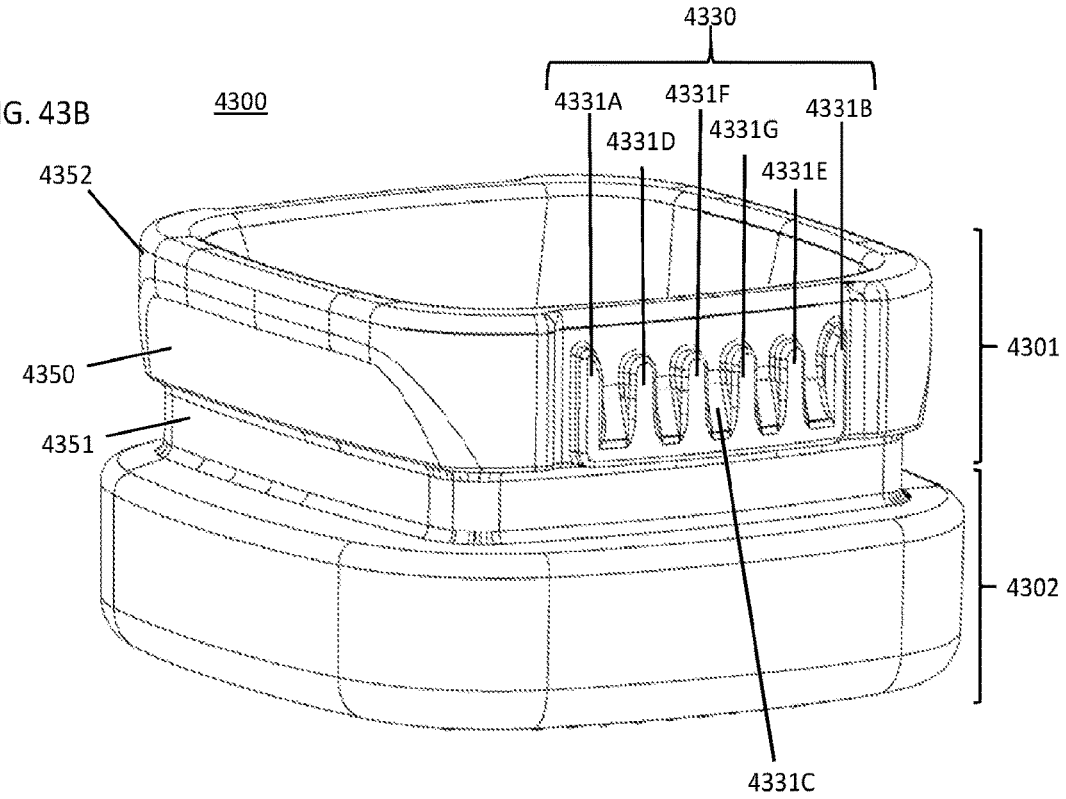
FIG. 43B illustrates a perspective view of an embodiment of the container base of FIG. 43A.
Figure 43C:
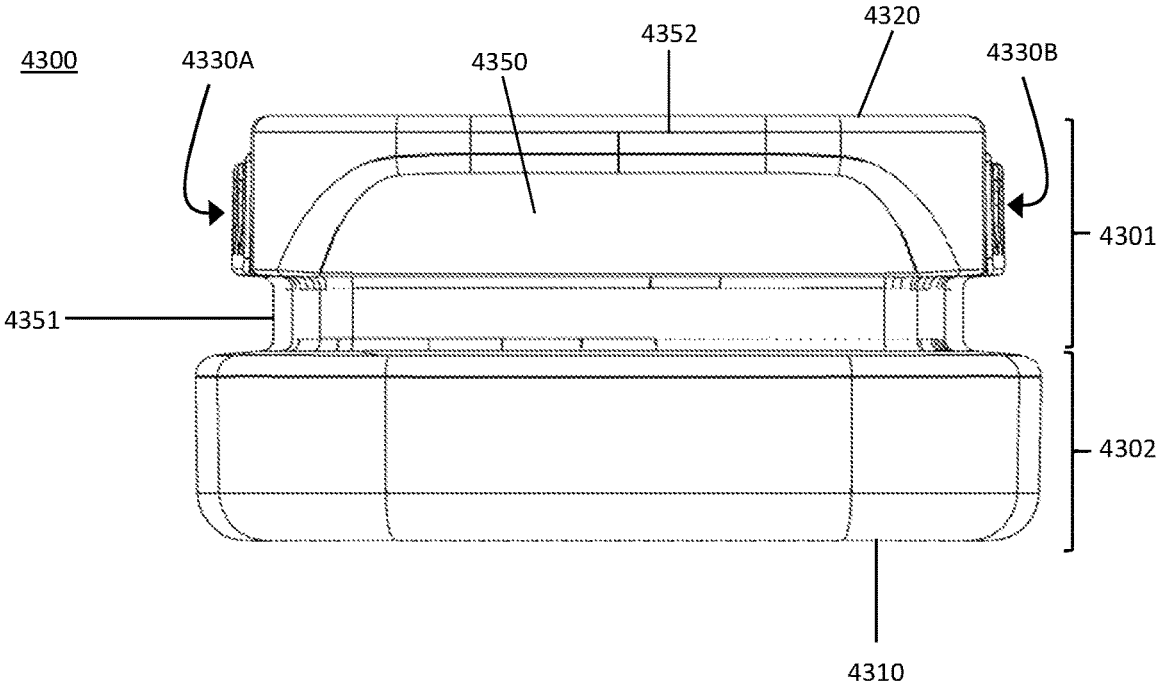
FIG. 43C illustrates a side view of an embodiment of the container base of FIG. 43A.
Figure 43D:
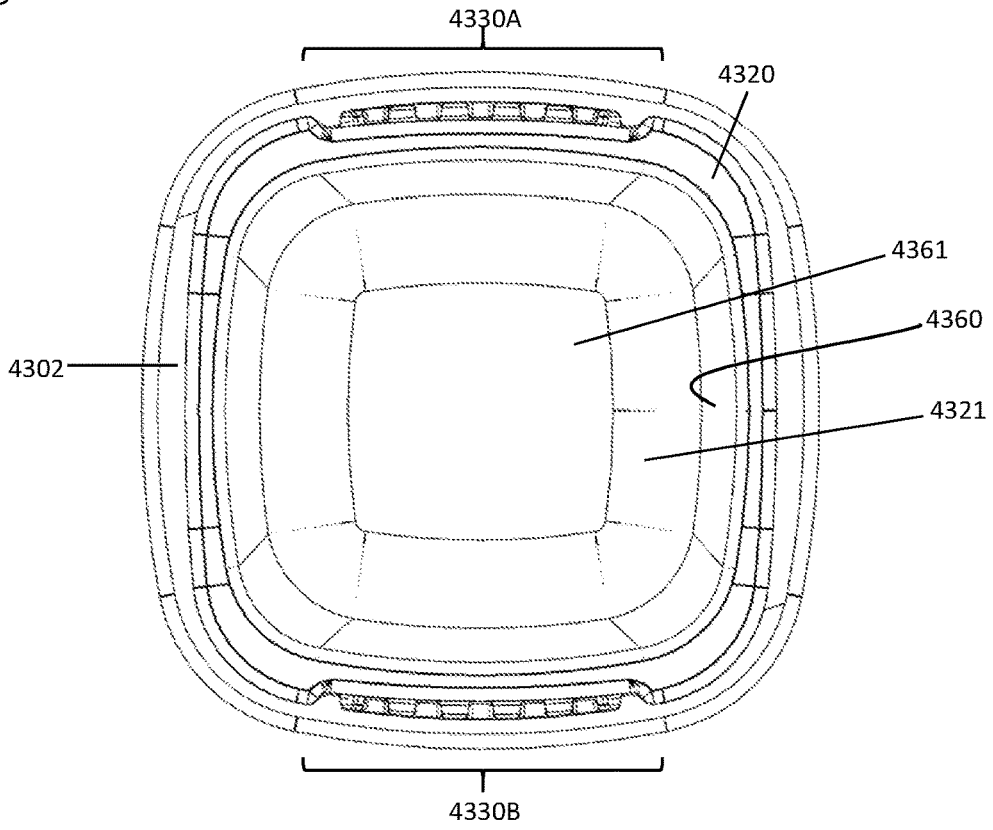
FIG. 43D illustrates a top view of an embodiment of the container base of FIG. 43A.

The sides adjacent to the cap engagement mechanism on the base can affect the placement of a cap on a base and also removal of the cap off the base. FIGS. 41-43 illustrate various sides of the container base. Compared to FIG. 1, where base 100 has a substantially flat side 150C that is substantially perpendicular the base foot, and FIG. 2, where base 200 has a substantially flat side 250C that is substantially perpendicular to base foot 202, base 4100 and base 4200 have sides 4150 and 4250 that are angled relative to foot 4102 and 4202, respectively.

Referring to FIGS. 41 and 42, the angle of side 4150 and/or 4250 is generally greater than 0 degrees, i.e. the exterior upper sidewalls (neck sidewalls) are tapered, preferably outwardly flaring as shown in FIGS. 41 and 42. S In some aspects, the angle is greater than 1 degree, greater than 2 degrees, greater than 3 degrees, greater than 4 degrees, greater than 5 degrees, greater than 6 degrees, greater than 7 degrees, greater than 8 degrees, greater than 9 degrees, greater than 10 degrees, greater than 11 degrees, greater than 12 degrees, greater than 13 degrees, greater than 14 degrees, greater than 15 degrees, greater than 16 degrees, greater than 17 degrees, greater than 18 degrees, greater than 19 degrees, or greater than 20 degrees. In some aspects, the angle of side 4150 is between 0 and 20 degrees, between 1 and 15 degrees, or between 5 and 10 degrees.

Also preferred is where the sidewalls 4150 and 4250 include separate or distinct tapered portions, for instance upper and lower taper portions 4150A, 4150C respectively preferably with protruding, interposed lip 4150B as depicted in FIG. 41 and upper and lower taper portions 4250A, 4250C respectively preferably with protruding, interposed lip 4250B as depicted in FIG. 42. The upper and lower taper portions (e.g. 4150A and 4150C shown in FIG. 41) may taper at the same or different angle, for example the tapering angles of the upper and lower portions may differ by 1, 2, 3, 4, 5 degrees or more. Such a configuration with upper and lower tapering portions as well as interposed lip can facilitate engagement with a cap unit, for instance such configuration can facilitate a cap to flex and release itself from the container base including when the cap unit is pinched.

Base 4100 of FIG. 41 has side wall 4150 that extends to or substantially to open top end 4120. A side top end 4152 can be continuous with side wall 4150 or can change the angle of side wall 4150. Side top end 4152 can have zero angle (i.e., 0 degrees and is substantially perpendicular to foot 4102), a positive angle (e.g., the same or different angle of side wall 4150), or a negative angle (e.g., slope of top end 4152 is opposite of side 4150).

Base 4200 of FIG. 42 also has a ledge 4252 extending from top end 4220 of base 4200. Both ledge 4252 and side 4250 each, independently, have different angles or slopes, but the ledge 4252 can be angled greater than side 4250.

Referring to FIGS. 43A-43D, child-resistant container base 4300 has foot/support 4302 having closed bottom end 4310 and neck 4301 having open top end 4320. Neck 4301 has inner wall 4360 and inner floor 4361 that define cavity 4321. Inner floor 4361 is substantially flat or slightly rounded and can have rounded corners and/or edges. In certain preferred aspects, inner floor 4361 and the base internal geometry may be substantially rounded.

Cap engagement mechanisms 4330A and 4330B are positioned on opposites sides of neck 4301. Cap engagement mechanism 4330 include teeth elements 4331A, 4331B, 4331D, 4331E, 4331F and 4331G. Teeth elements 4331A, 4331B, 4331D, 4331E, 4331F and 4331G are connected, e.g., by a ridge, on a lower end, that sits flush with transfer neck 4351. Between each of teeth elements 4331A/D, 4331D/F, 4331F/G, 4331F/E, and 4331E/B are grooves 4331C. Grooves are slightly angled (e.g., ramped) and sized for engagement with a cap or lid. Teeth 4331A, 4331B, 4331D, 4331E, 4331F and 4331G extend from near open top end 4320 to transfer neck 4351. Cap engagement element 4330 is a retention feature that provides child-resistance such that a container cap snaps or locks into place with the container base 4300.

Container base 4300 also has a transfer neck 4351 around the circumference of the container base. Transfer neck 4351 allows machinery to move container base 4300 during manufacturing. Transfer neck 4351 is held during transfers of base 4300 during the glass manufacturing process. Transfer neck 4351 separates neck 4301 from support 4302 of container base 4300.

Base 4300 of FIGS. 43A-43D has side wall 4350 that extends to or substantially to open top end 4320. A side top end 4352 can be continuous with side wall 4350 and/or can change the angle of side wall 4350. Side top end 4352 can have zero angle (i.e., 0 degrees and is substantially perpendicular to foot 4302), a positive angle (e.g., the same or different angle of side wall 4350), or a negative angle (e.g., slope of top end 4352 is opposite of side 4350).

The angle of sides 4350 is generally greater than 0 degrees. In some aspects, the angle is greater than 1 degree, greater than 2 degrees, greater than 3 degrees, greater than 4 degrees, greater than 5 degrees, greater than 6 degrees, greater than 7 degrees, greater than 8 degrees, greater than 9 degrees, greater than 10 degrees, greater than 11 degrees, greater than 12 degrees, greater than 13 degrees, greater than 14 degrees, greater than 15 degrees, greater than 16 degrees, greater than 17 degrees, greater than 18 degrees, greater than 19 degrees, or greater than 20 degrees. In some aspects, the angle of side 4350 is between 0 and 45 degrees, between 1 and 30 degrees, or between 5 and 20 degrees.

Figure 44A:
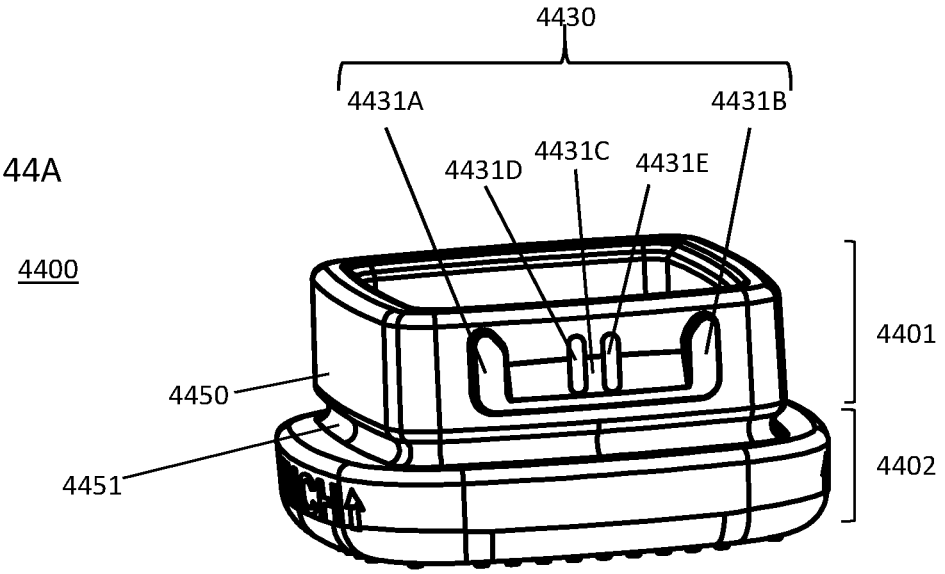
FIG. 44A illustrates a side perspective view of an embodiment of a container base.
Figure 44B:
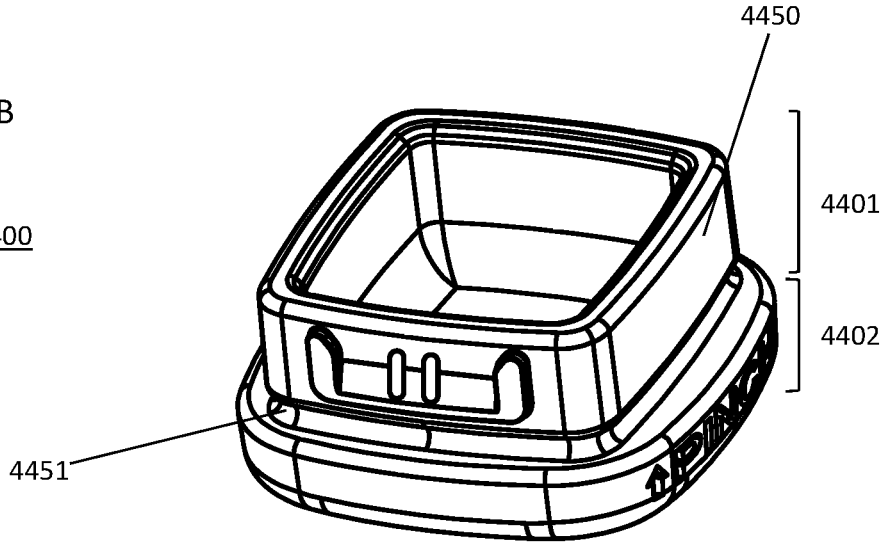
FIG. 44B illustrates a top perspective view of the embodiment of the container base of FIG. 44A.

FIGS. 44A and 44B illustrate base 4400 having a substantially perpendicular side wall 4450 relative to foot 4402. Cap engagement element 4430 is positioned on neck 4401 having ramps 4431A, 4431B, 4431D and 4431D. Ridge 4431C connects ramps 4431A and 4431B.

Figure 45A:
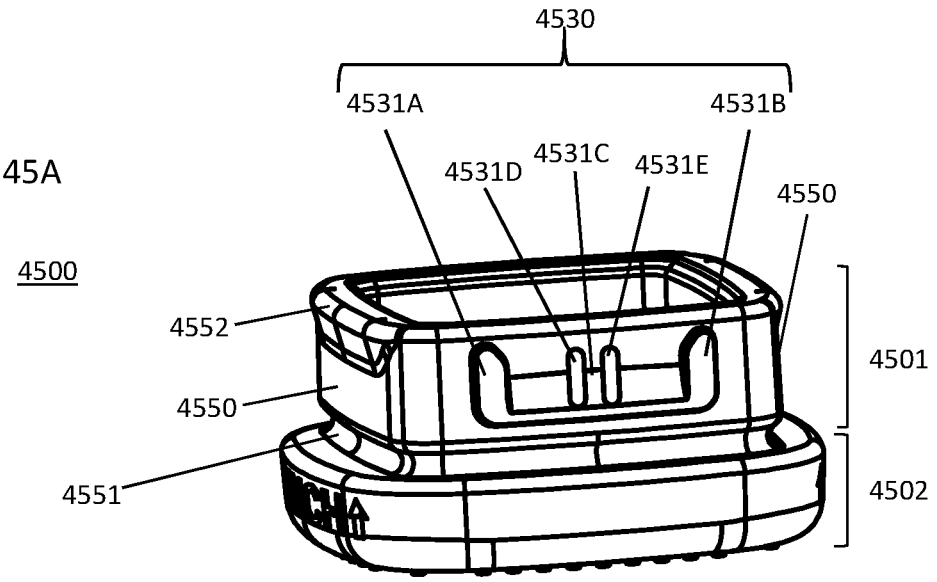
FIG. 45A illustrates a side perspective view of an embodiment of a container base.
Figure 45B:
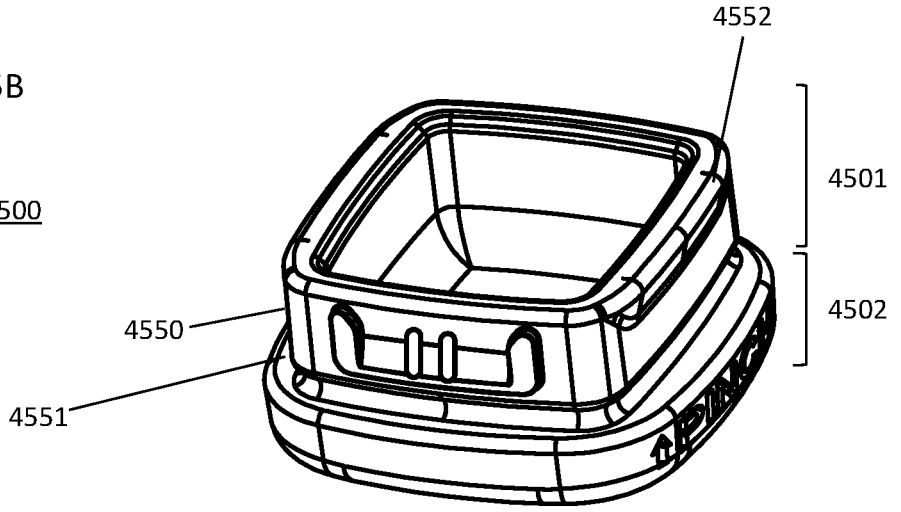
FIG. 45B illustrates a top perspective view of the embodiment of the container base of FIG. 45A.

FIGS. 45A and 45B illustrate base 4500 having a substantially perpendicular side wall 4550 relative to foot 4502. Ledge 4552 extends from side walls 4550. Cap engagement element 4530 is positioned on neck 4501 having ramps 4531A, 4531B, 4531D and 4531D. Ridge 4531C connects ramps 4531A and 4531B.

Container Caps

FIGS. 7-11 and 20A-20C illustrate various embodiments of the child-resistant containers and container caps described herein. Child-resistant container caps are generally symmetrical in shape. For example, the container cap can have a length to width ratio of about 1:1. In some embodiments, the cap is generally polygonal in shape. In some embodiments, the container cap is generally square, rectangular, diamond, quadrilateral, or rhomboid in shape. In one some embodiment, the container cap is substantially square, square, and/or square with rounded edges. The caps in combination with the bases form containers that are stackable (e.g. FIGS. 7A-11) and have features to make them child-resistant. Other features will be readily apparent in light of the foregoing.

Figure 18A:
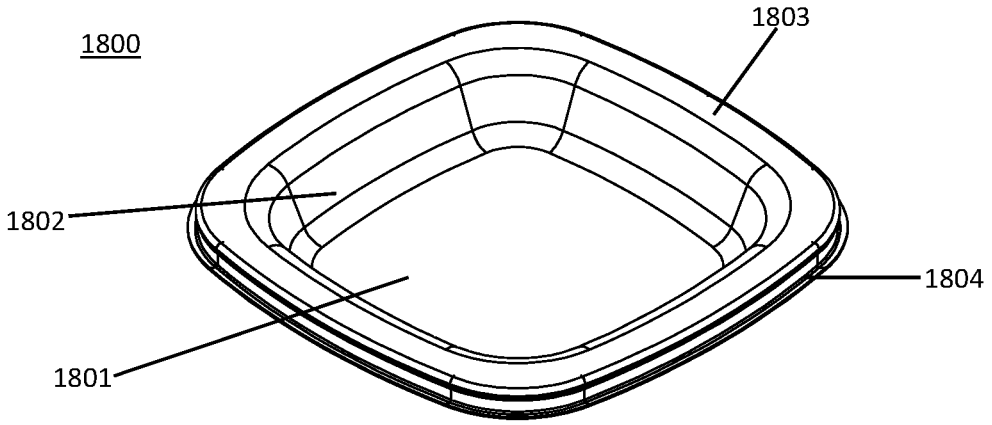
FIG. 18A illustrates a perspective view of an embodiment of a container liner.
Figure 18B:
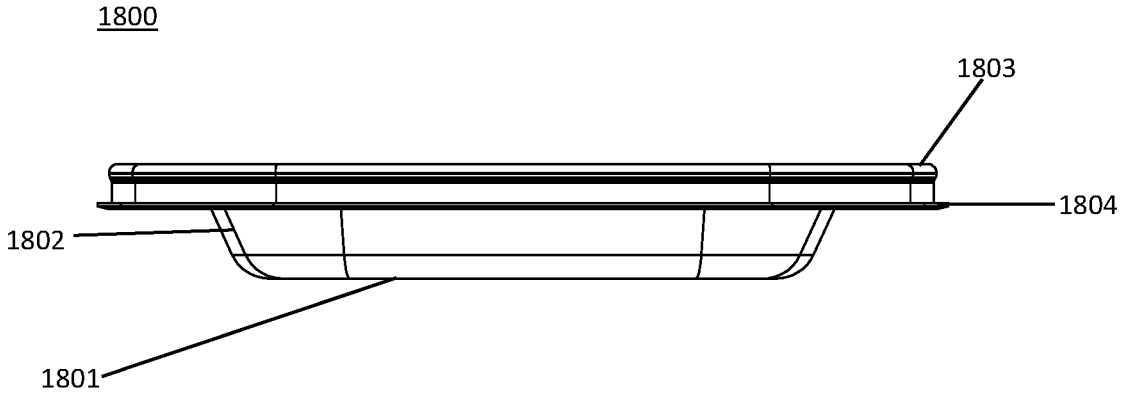
FIG. 18B illustrates a side view of the embodiment of the liner of FIG. 18A.

As shown in FIGS. 18A and 18B, a liner can be placed within cap 800B so that it securely fits at the top of the cap. The liner is sized and configured to sit directly on roof 790 and ramped edges 791. The liner is configured to also sit on top of annular ring 792 and fit into the space between annular ring 792 and interior side 789. The liner preferably provides anti-stick properties to the interior of the container cap. For example, the liner is a fluoropolymer, such as FEP, PTFE, or PFA.

Figure 18C:
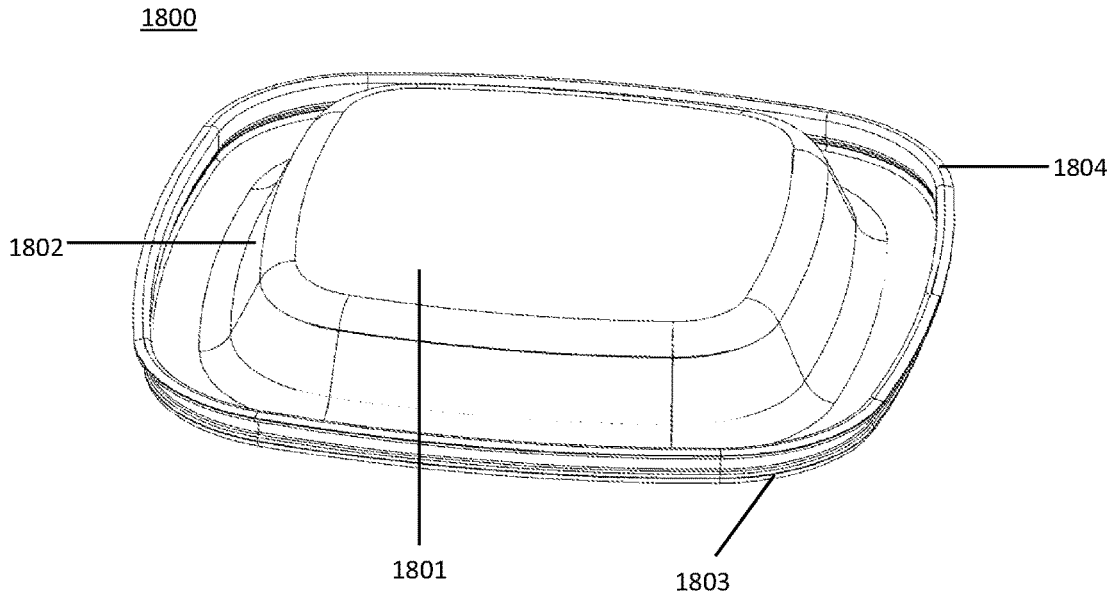
FIG. 18C illustrates a top view of the embodiment of the liner of FIG. 18A.

A fluorinated ethylene propylene (FEP) thermoformed liner can be added to the container base and/or container cap. Referring to FIGS. 18A-18C, liner 1800 is sized and configured to be applied to the container cap. Another liner can be sized and configured to be applied to the container base. Liner 1800 is thermoformed, die-cut or injection molded to be sized and configured to fit inside the container cap. Liner 1800 comprises a polymer, such as a fluoropolymer. Examples of fluoropolymers include FEP (fluorinated ethylene propylene), PTFE (polytetrafluoroethylene) and PFA (perfluoroalkoxy alkanes). Liner 1800 can sit flush within the roof of the container cap (e.g., roof 790 in FIG. 7B). Any appropriate polymer, such as FEP, PTFE and PFA, can be used as a cap and/or base liner and preferred characteristics of the liner includes, but is not limited to, any one or more of the following: flexibility, transparency/clear, low dielectric constant, chemically insert (non-reactive), low co-efficient of friction, anti-stick properties (non-stick), UV resistant, not hygroscopic, FDA approved or any combination thereof.

Liner 1800 has roof 1801, ramped sides 1802, ledge 1803, and rim 1804. Ramped sides 1802 circumferentially extend from roof 1801, and ledge 1803 circumferentially extends from ramped sides 1802. Rim 1804 extends from ledge 1803. Liner 1800 has a unitary structure. Liner 1800 is sized and configured to securely fit inside container cap 700B. However, liner can be thermoformed, die-cut or injection molded, to be sized and configured to fit any shaped container cap or base. Generally, liners are used in with a container cap or base that is substantially square in shape having rounded corners.

Figure 19A:
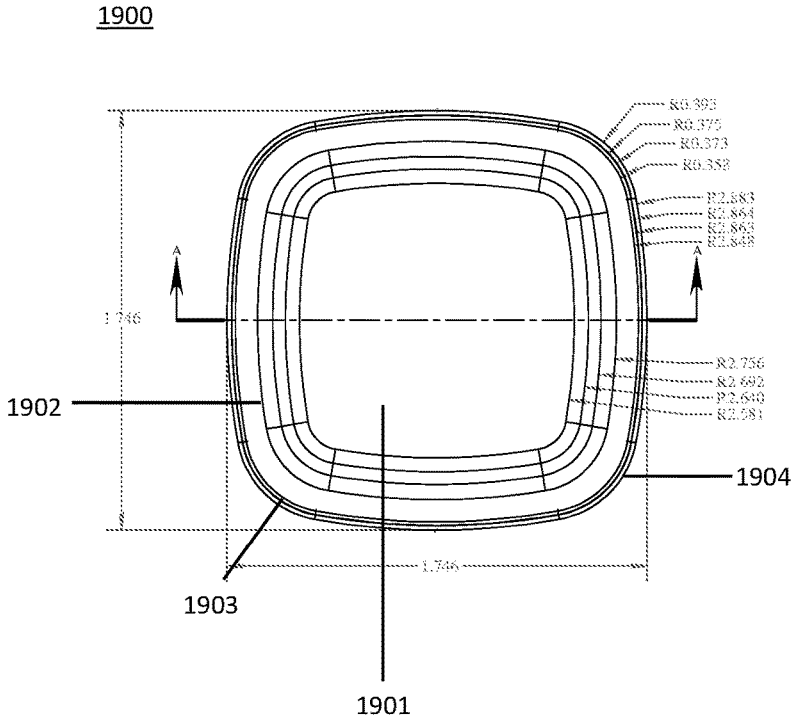
FIG. 19A illustrates a bottom view of an embodiment of a container liner.
Figure 19B:
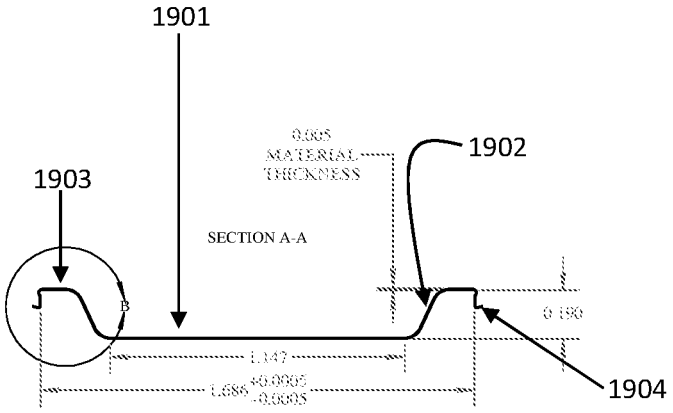
FIG. 19B illustrates a cross-sectional view (Section A-A) of the embodiment of the liner of FIG. 19A.
Figure 19C:
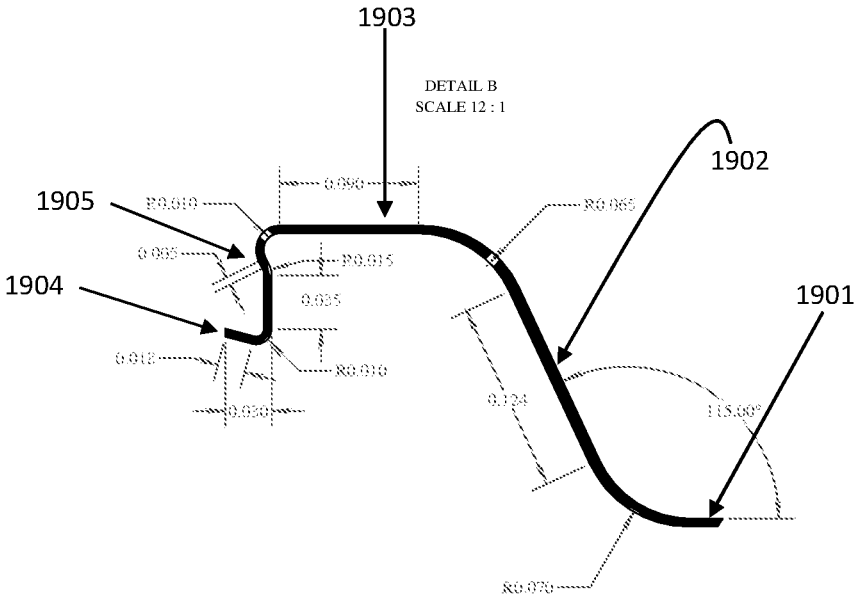
FIG. 19C illustrates an enlarged view of a portion of the cross-sectional view (Detail B) of the embodiment of the liner of FIG. 19B.

FIGS. 19A-19C illustrates another embodiment of a liner. Liner 1900 has roof 1901, ramped sides 1903, ledge 1903 and rim 1904, which all form a unitary structure. Ramped sides 1902 circumferentially extend from roof 1901, and ledge 1903 circumferentially extends from ramped sides 1902. Rim 1904 extends from ledge 1903 and elbow 1905. Liner roof 1901, ramped sides 1903, ledge 1903, and rim 1904 are sized to sit directly on top of, for example, roof 790, ramped edges 791, and annular ring 792, respectively, of container cap 700B of FIG. 7B. Liner rim 1904 fits into the space between annular ring 792 and interior side 789 of cap 700B to help secure liner 1900 within cap 700B. Liner ledge 1903 and elbow 1905 are sized and configured to securely sit on and partially circumscribe annular ring/seal. Although liner 1900 securely sits within container cap, liner 1900 is removeable from a container cap. In some embodiments, liner 1900 is permanently affixed to container cap.

Compositions

The containers, including the container base and container cap, described herein can be formed of glass (e.g., any non-crystalline amorphous solid), a plastic, a polymer, combinations thereof, or any other suitable material.

The container base can be made of any suitable material. Generally, the base has a generally rigid and/or non-deformable structure. Suitable materials include, for example, glass (e.g., any non-crystalline amorphous solid), other glass materials, recycled glass, polymer glass, glass-ceramic, plexiglass, ceramic material, metal, metal-alloy, or combinations thereof. Examples of suitable glass used to construct the container base includes, but is not limited to, flint glass, amber glass, green glass, opal glass, transparent glass, recycled glass, tempered glass, soda lime glass, borosilicate glass and others. The glass can be colored, patterned, textured, clear, and/or opaque.

The container cap can be made of any suitable material. Generally, the cap has a generally non-rigid or semi-rigid and/or deformable structure. Suitable materials include, for example, plastics, recycled plastic, plastic composite, reinforced plastic, polymers, cardboard, recycled materials, or combinations thereof. For example, suitable polymers and plastics include, but is not limited to, a thermoplastic, a thermoplastic elastomer (TPE), a thermoplastic vulcanizate (TPV), a thermoplastic polyurethane (TPU), polypropylene, polypropylene copolymer, ultra-clarified polypropylene, colored polypropylene, polyethylene terephthalate (PET or PETE), fluorinated ethylene propylene (FEP), acrylonitrile butadiene styrene, polystyrene (PS), high-impact polystyrene, polycarbonate (PC), polyvinyl chloride (PVC), high density polyethylene, polytetrafluoroethylene, polychlorotrifluoroethylene, phenol-formaldehyde resin, para-aramid, polyethylene terephthalate, polychloroprene, polyamide, polyacrylonitrile, copolyimide, aromatic polyester, poly-p-phenylene-2,6-benzobisoxazole, resin, wood, rubber, elastomeric rubber, silicone, vulcanized rubber or combinations thereof.

The plastic can be injection molded, thermoformed, vacuum formed, or manufactured in any way suitable to make the components described herein to achieve the desired functionality.

Other materials or additives can be added to the container (e.g., the base and/or cap). For example, an antimicrobial additive can be added. Other additives can include as oxo-degradable additives, biodegradable additives, UV-resistance additives, and anti-static additives.

The container cap and/or base can also have polytetrafluoroethylene (PTFE) coatings. Clear plastisol can be applied to an exterior surface of a glass base which helps prevent breaking and makes the glass opaque. Oleic acid vapor is added to prevent glass from sticking together on production line. Silicon dioxide ($SiO_2$) vapor is deposited to provide plastic caps with a flexible layer of glass.

The container base and/or the container cap can have an UV resistant or blocking material. The container base and/or the container cap are composed of a material having complete opacity. Complete opacity or an opaque material is described herein as exhibiting 100% opacity, wherein the material is light impermeable. In certain embodiments the base or the cap or both are composed of a material having less than complete opacity. Such material can include characteristics having 90%, 80%, 70%, 60%, 50%, 40%, 30%, 20% 10% or 0% opacity, or any range in between. In certain embodiments, the container cap and/or base is completely opaque, and light protective. In some embodiments the container cap and/or base is transparent, wherein the opacity is less than 100%. In some embodiments the container cap and/or base is transparent, wherein the opacity about 0% to about 10%.

In various embodiments, the container cap and/or the container base, are protected by a removable sleeve. The removable sleeve can be opaque. The removable sleeve can be UV-resistant. In some embodiments the removable sleeve is moisture resistant. In some embodiments the removable sleeve is light impermeable. In some embodiments the removable sleeve comprises surface markings for product identification, security notice or any combination thereof.

Other Components

The container can include a tamper evident element. The tamper evident element can be found anywhere on the child-resistant containers, such as the base, the cap or both. For example, the tamper evident element is a break-away component. The break-away component can be a seal, a tape, or a combination thereof. The tamper evident element can be a shrink band.

The modular containers can further comprise a product identification, a manufacturer's note, a radio frequency identification (RFID) tag, near-field communication (NFC) tag, barcode, or a combination thereof.

In some embodiments, the parts of the containers further comprise a writing surface compatible with a pen, a pencil, or a marker. In some embodiments, the containers further comprise a space available for a specialty material or a surface application to easily remove stickers and labels without leaving residue.

In some embodiments, the modular containers further comprise one or more sensors. For example, any sensor can be used in the modular container storage system such as an environmental sensor (e.g., a humidity sensor, an oxygen sensor, a temperature sensor, a barometric pressure sensor, a light sensor), a gyroscope, an accelerometer, a global positioning sensor (GPS) sensor, a magnetometer, a proximity sensor, a fingerprint sensor, and a retinal sensor.

Methods of Using and Storing

The present disclosure relates to a method for packaging and/or storing a material. The method of packaging comprises providing a child-resistant container and introducing the material into the container.

The material being packaged can be a material sensitive to one or more environmental factors. Sensitivities include, but is not limited to, air, water, oxygen, light, UV, temperature, bacteria, other microorganisms, or combinations thereof. For example, the material is a consumer product, pharmaceutical, nutraceutical, herbal material, botanical material, food product, animal-based product, plant-based product, or the like. The containers disclosed herein create a substantially air-tight seal, liquid-tight seal or a both.

The cap engagement mechanism and base engagement elements are configured to cooperatively engage in a locked position that releasably secures the container cap to the container base in a closed position in which the open end of the base is covered by the cap prohibiting access to the open cavity. Securing the container cap on the container base comprises the following steps: sliding and pressing the container cap over the open end of the container base along the long axis of the container. The container is locked by sliding and pressing the cap over the cap engagement mechanisms of the container base, until an audible noise is heard as well as a tactile snap. In other words, the sides of the container cap have to be pressed with a force sufficient to overcome the hindrance of the base engagement elements and then settle in a secure base-cap engagement, such that the base engagement elements of the container cap fit within or around the cap engagement mechanism. This forms a secure coupling of the base engagement element of the container cap and the cap engagement mechanism of the container base. Additional grooves and ridges can be included in order to increase the hardship or complexity of accessing the contents or using the container.

In some embodiments the complete coupling of the base engagement mechanism and the cap engagement element is designed to release an acoustic signal, a snap-sound, which lets the operator know that the cap is secure on the base and thereby the contained elements are secure in the child-resistant container.

Visual signals are provided on the surface of the container which correspond to the site and direction of force to be applied. For example, one or more markings are provided on the surface of the container base, designating the side of the container base that does not have the cap engagement mechanisms. The markings correspond to application of pulling force on the container cap to dissociate the cap from the base, while the container base is held by another hand.

To access the contents from a closed container, application of a predetermined amount of compression force inward on two opposing sides of the cap is necessary. For example, the method of affecting a child-resistant closure of a container further comprises removing the container cap by simultaneously applying compression force on opposite sides of the container cap. One would press two opposing sides of the cap not having the cap engagement mechanism, and resiliently reduce a first width of the cap along a compression axis to a second width, which releases the cap engagement mechanism from the base engagement element. This frees the cap from the pressure of the ramps and/or ridges on the sides of the base. In one embodiment, the predetermined amount of force can be applied to a position on opposed caps sides adjacent to the cap engagement elements. The markings on the container base constitute the visual indicator of the side for the application of the compression force in order to open the container. The container cap and container base can be uncoupled from the closed position by axially pulling the container cap away from the container base along a longitudinal axis of the container. The pulling can occur after the engagement elements are in an unlocked position.

The predetermined amount of force is between about 1 to about 10 pounds of external compression force to opposite sides of the container cap and pulling the container cap off of the container base. In one embodiment, a user applies about 2 to about 8 pounds of external compression force to opposite sides of the container cap and pulling the container cap off the container base. In another embodiment, a user applies about 3 to about 7 pounds of external compression force to opposite sides of the container cap and pulling the container cap off the container base. In another embodiment, a user applies about 4 to about 6 pounds of external compression force to opposite sides of the container cap and pulling the container cap off the container base. In some embodiments, the predetermined amount of force is 1, 2, 3, 4, 5, 6, 7, 8, 9, 10, or more pounds of external compression force. In some embodiments, the predetermined amount of force is at least about 3 pounds, at least about 4 pounds, at least about 5 pounds, at least about 6 pounds, or at least about 7 pounds.

The cap engagement mechanism and base engagement element can be configured to disengage from a locked position to an unlocked position in which the container cap and container base can be uncoupled from a closed position to an open position such that the open cavity of the container is accessible. A change from a locked position to an unlocked position is achieved by radially inwardly applying a predetermined amount of compression force at two opposing sides of the cap to resiliently reduce a first width of the cap along a compression axis to a second width, where the second width is slightly less than the first width. In some embodiments, the predetermined amount of force can be applied to a position on opposing base sides, wherein, at least one side of the base comprises the cap engagement mechanism. The cap and base can be uncoupled from the closed position by pulling apart the cap along a longitudinal axis of the container by simultaneously applying a predetermined force of compression on two opposing sides of the cap, where at least one of the two opposing sides comprises the cap engagement mechanism, and pulling the cap away from the base along the longitudinal axis. In still other embodiments, the cap can be pulled using cap sides corresponding to a position parallel to the expansion axis. In some embodiments, the reduction is from a first width to a second width, where the second width is less than the first width, and the second width expands to the first with resiliently upon release of pressure.

The present disclosure relates, in various embodiments, to containers and devices for storing substances of restricted use. The consumer Product Safety Commission (CSPC, www.cspc.gov) provides guidance for packaging drugs and other controlled substances for special child-resistant and senior friendly packaging (CRP). The CSPC also administers the Poison Prevention Packaging Act of 1970 (PPPA), 15 U.S.C. § 1471-1476. Substances for restricted use as intended in this application include but are not limited to tobacco, medicines or federally controlled substances, nutraceuticals or vitamins. The substance may be sensitive to environmental exposure and is liable to decay, decomposition, loss of desirable property upon exposure, for example, pharmaceutical medications, herbal products, botanical products. A substance for storage in a container of the present disclosure may include but is not limited to one or more of the components or drugs classified under Schedules I, II, III, or Schedule IV in the Controlled Substance Act (CSA) by the Drug Enforcement Authority of the United States of America (https://www.dea.gov/druginfo/ds.shtml): combination products with less than 15 milligrams of hydrocodone per dosage unit (Vicodin®), cocaine, methamphetamine, methadone, hydromorphone (Dilaudid®), meperidine (Demerol®), oxycodone (OxyContin®), fentanyl, Dexedrine®, Adderall®, and Ritalin®; products containing less than 90 milligrams of codeine per dosage unit (Tylenol® with codeine), ketamine, anabolic steroids, testosterone; or products including Xanax®, Soma®, Darvon®, Darvocet®, Valium®, Ativan®, Talwin®, Ambien®, Tramadol.

The disclosure provides a method of storing a material in a child resistant container. The method involves providing a child-resistant container comprising a container base having a cap engagement element and a container cap having a base engagement element, wherein the cap engagement element is configured to engage and reversibly couple to the base engagement element cooperatively; introducing the material in the base; and securing the cap over the base, wherein the cap engagement element engages and couples to the base engagement element to form a child-resistant container.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A child-resistant container comprising:

a substantially symmetrical container base comprising:

a closed bottom end;

an open top end;

a first cap engagement mechanism on a first side of the container base; and a second cap engagement mechanism on a second side of the container base opposite the first cap engagement mechanism;

wherein each of the first cap engagement mechanism and the second cap engagement mechanism comprise:

a pair of ramps each extending from the open top end to a transfer neck arranged on the container base, the ramps having rounded ends to provide guidance and alignment with a container cap on the container base; and a ridge substantially parallel to the open top end, the ridge connecting the pair of ramps for locking the container cap to the container base, and wherein the pair of ramps and the ridge form an H-shaped configuration.

2. The child-resistant container of claim 1, wherein the container base comprises a glass, a polymer glass, a glass-ceramic, a ceramic material, or a combination thereof.

3. The child-resistant container of claim 2, wherein the glass is selected from the group consisting of a flint glass, an amber glass, a green glass, an opal glass, and a transparent glass.

4. The child-resistant container of claim 1, further comprising the container cap, wherein the container cap is sized and configured to mate with the container base.

5. The child-resistant container of claim 4, wherein the closed bottom end further comprises a recessed portion configured to mate with an elevated portion of a top end of the container cap.

6. The child-resistant container of claim 5, wherein the container cap comprises one or more base engagement elements.

7. The child-resistant container of claim 6, wherein each of the one or more base engagement elements comprise one or more teeth.

8. The child-resistant container of claim 7, wherein each of the one or more base engagement elements is configured to engage with the first cap engagement mechanism.

9. The child-resistant container of claim 8, wherein each of the one or more base engagement elements are disposed on an interior side of the container cap.

10. The child-resistant container of claim 9, wherein engagement of the container base with the container cap enables the one or more base engagement elements to lockably mate with the first and second cap engagement mechanisms to substantially provide a child resistant container.

11. The child-resistant container of claim 9, wherein the container cap comprises a polymer.

12. The child-resistant container of claim 11, wherein the polymer comprises a thermoplastic elastomer (TPE), a thermoplastic vulcanizate (TPV), a thermoplastic polyurethane (TPU), polypropylene, polypropylene copolymer, ultra-clarified polypropylene, colored polypropylene, PET, polycarbonate, polystyrene, or a combination thereof.

13. The child-resistant container of claim 12, wherein the container cap further comprises an annular sealing ring positioned on an inner surface of the top end of the cap.

14. The child-resistant container of claim 13, wherein the container is substantially air-tight, liquid-tight, light resistant, temperature resistant, moisture resistant, bacterial resistant, tamper resistant, or a combination thereof.

15. A child-resistant container comprising:

a substantially square glass container base comprising a closed bottom end, an open top end, a first cap engagement mechanism positioned on a first side of the container base, and a second cap engagement mechanism positioned on a second side of the container base, wherein each of the first cap engagement mechanism and the second cap engagement mechanism comprise: a pair of ramps each extending from the open top end to a transfer neck arranged on the container base, the ramps having rounded ends to provide guidance and alignment with a container cap on the container base; and a ridge substantially parallel to the open top end, the ridge connecting the pair of ramps for locking the container cap to the container base, and wherein the pair of ramps and the ridge form an H-shaped configuration; and the container cap sized and configured to mate with the container base.

16. The child-resistant container of claim 15, wherein the container cap comprises an elevated portion configured to nest in a recessed portion of the closed bottom end of the container base.

17. The child-resistant container of claim 16, wherein the container cap further comprises one or more base engagement elements; wherein each of the one or more base engagement elements comprise one or more teeth configured to engage with the ridge of each of the cap engagement mechanisms.

18. The child-resistant container of claim 17, wherein each base engagement element independently comprises 1, 2, 3, 4, 5, or 6 teeth.

19. The child-resistant container of claim 18, wherein the container cap comprises a thermoplastic elastomer (TPE), a thermoplastic vulcanizate (TPV), a thermoplastic polyurethane (TPU), polypropylene, polypropylene copolymer, ultra-clarified polypropylene, colored polypropylene, PET, polycarbonate, polystyrene, or a combination thereof.

20. The child-resistant container of claim 15, wherein the glass is selected from the group consisting of a flint glass, an amber glass, a green glass, an opal glass, and a transparent glass.

21. The child-resistant container of claim 15, further comprising a liner sized and configured to fit inside the container cap.

22. The child-resistant container of claim 21, wherein the liner is thermoformed, die-cut or injection molded.

23. The child-resistant container of claim 22, wherein the liner comprises a fluoropolymer.

24. The child-resistant container of claim 23, wherein the fluoropolymer is selected from the group consisting of FEP, PTFE and PFA.

25. The child-resistant container of claim 24, wherein the liner comprises a roof, a ramped side, and a ledge.

26. A child-resistant glass container comprising:

a substantially symmetrical container base comprising:

a foot having a closed bottom end;

a neck having an open top end;

a first cap engagement mechanism positioned on a first side of the neck; and a second cap engagement mechanism positioned on a second side of the neck opposite from the first cap engagement mechanism;

wherein each of the first cap engagement mechanism and the second cap engagement mechanism comprise:

a plurality of ramps substantially perpendicular to the open top end, each of the ramps extending from the open top end to a transfer neck arranged on the container base, the ramps having rounded ends to provide guidance and alignment with a container cap on the container base; and a ridge substantially perpendicular to and disposed between the plurality of ramps, the ridge being substantially parallel to the open top end, and the ridge connecting the pair of ramps for locking the container cap to the container base, and wherein the plurality of ramps and the ridge form an H-shaped configuration.

27. The child-resistant glass container of claim 26, wherein the neck further comprises a third side and a fourth side, each substantially perpendicular to the foot.

28. The child-resistant glass container of claim 26, wherein the neck further comprises a third side and a fourth side, each sloped inwardly relative to the foot.

29. The child-resistant glass container claim 26, further comprising a ledge extending from the open top end partially down the side of the neck.

* * * * *